US006960417B2

(12) United States Patent
Suzuki

(10) Patent No.: US 6,960,417 B2
(45) **Date of Patent: *Nov. 1, 2005**

(54) ELECTROPHOTOGRAPHIC PHOTOCONDUCTOR

(75) Inventor: Yasuo Suzuki, Fuji (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 08/550,808

(22) Filed: Oct. 31, 1995

(65) Prior Publication Data

US 2004/0214101 A1 Oct. 28, 2004

Related U.S. Application Data

(63) Continuation-in-part of application No. 08/336,047, filed on Nov. 4, 1994, now abandoned.

(30) Foreign Application Priority Data

| | | |
|---|---|---|
| Nov. 5, 1993 | (JP) | 5-301292 |
| Nov. 5, 1993 | (JP) | 5-301293 |
| Jul. 13, 1994 | (JP) | 6-183923 |
| Oct. 31, 1994 | (JP) | 6-290470 |

(51) Int. Cl.[7] ..... G03G 5/047

(52) U.S. Cl. ..... 430/59.2; 430/59.4; 430/72; 430/78; 430/83

(58) Field of Search ..... 430/72, 78, 83, 430/59.2, 59.4, 59.5, 58, 59

(56) References Cited

U.S. PATENT DOCUMENTS

| | | | | |
|---|---|---|---|---|
| 5,298,353 A | * | 3/1994 | Ohmori | 430/78 |
| 6,136,483 A | * | 10/2000 | Suzuki et al. | 430/59.2 |

FOREIGN PATENT DOCUMENTS

| | | | | |
|---|---|---|---|---|
| JP | 1-200261 | * | 8/1989 | 430/970 |
| JP | 01-257862 | | 10/1989 | |
| JP | 01-270060 | | 10/1989 | |
| JP | 04-128846 | | 9/1990 | |
| JP | 03-037658 | | 2/1991 | |
| JP | 03-037666 | | 2/1991 | |
| JP | 4-113363 | | 4/1992 | |
| JP | 04-221962 | | 4/1992 | |
| JP | 05-032905 | * | 2/1993 | |
| JP | 05-100461 | | 4/1993 | |
| JP | 05-188614 | | 7/1993 | |
| JP | 05-204178 | | 8/1993 | |
| JP | 06-049433 | * | 2/1994 | |

OTHER PUBLICATIONS

US Patent & Trademark Office English–Language Translation of JP 1–200261 (pub Aug. 1989).*
Japanese Patent Office Machine–Assisted Translation of JP 05–032905 (pub Feb. 1993).*
Japanese Patent Office Machine–Assisted Translation of JP 06–049433 (pub Feb. 1994).*
Thomson–Derwent machine–assisted translation of JP 06–49433 (pub. Feb. 1994).*
Thomson–Derwent machine–assisted translation of JP 05–32905 (pub. Feb. 1993).*
Patent & Trademark English Language Translation of JP 3–196049 (Pub Aug. 1991).*
Patent & Trademark English Language Translation of JP 3–37672 (Pub Feb. 1991).*
Japanese Patent Office English–Language Abstract of JP 01–270060, pub. Oct. 27, 1989.
Japanese Patent Office English–Language Abstract of JP 05–204178, pub. Aug. 13, 1993.

* cited by examiner

*Primary Examiner*—Janis L. Dote
(74) *Attorney, Agent, or Firm*—Oblon, Spivak, McClelland, Maier & Neustadt, P.C.

(57) ABSTRACT

An electrophotographic photoconductor including an electroconductive support and a photoconductive layer formed thereon, which contains a phthalocyanine pigment and a disazo pigment of formula (I):

(I)

wherein A and B are coupler radicals having different structures.

2 Claims, 5 Drawing Sheets

ELECTROPHOTOGRAPHIC PHOTOCONDUCTOR

This application is a continuation-in-part of application Ser. No. 08/336,047, filed Nov. 4, 1994, abandoned.

BACKGROUND OF THE INVENTION

1. Field of the Invention

The present invention relates to an electrophotographic photoconductor, and more particularly to a panchromatic electrophotographic photoconductor which exhibits remarkably high photosensitivity in a broad wave range from the visible region extending to the near infrared region.

2. Discussion of Background

Inorganic materials such as Se, CdS and ZnO are conventionally employed as the photoconductive materials for use in an electrophotographic photoconductor. However, because of poor photosensitivity, low thermal stability, and toxicity of the inorganic photoconductors, electrophotographic photoconductors using organic photoconductive materials have been actively developed in recent years. Some organic photoconductors, which comprises a photoconductive layer containing a charge generating material and a charge transporting material are put to practical use.

The electrophotographic photoconductor is required to exhibit spectral sensitivity in a broad wave range from the visible region extending to the near infrared region to use in a variety of electrophotographic apparatuses which employ a semiconductor laser beam as a light source, such as a laser printer and a digital copying machine, and to cope with various kinds of light source employed for exposure system in such apparatuses.

It is proposed to use in the photoconductor two or more kinds of pigments serving as the charge generating materials which exhibit spectral sensitivities in different ranges, as disclosed in Japanese Laid-Open Patent Applications Nos. 63-148264, 1-17753 and 1-270060.

However, the sensitivities of the photoconductor thus obtained are not flat in a broad wave range due to local decrease, and do not attain to a sufficient level as a whole although the spectral range in which the photoconductor can show the spectral sensitivity expands. In addition, the characteristics of the pigments cannot be effectively utilized in such a photoconductor.

SUMMARY OF THE INVENTION

Accordingly, a first object of the present invention is to provide an electrophotographic photoconductor with high photosensitivity and capable of exhibiting flat spectral sensitivities in a broad wave range from the visible region extending to the near infrared region.

A second object of the present invention is to provide an electrophotographic photoconductor with high photosensitivity and improved resistance to oxidizing gases such as ozone and $NO_x$.

The above-mentioned objects of the present invention can be achieved by an electrophotographic photoconductor comprising an electroconductive support and a photoconductive layer formed thereon, which comprises a phthalocyanine pigment and a disazo pigment of formula (I):

(I)

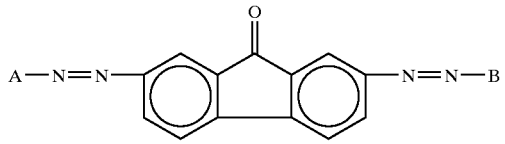

wherein A and B are coupler radicals having different structures.

In the first mentioned electrophotographic photoconductor, the photoconductive layer may comprise a charge generation layer and a charge transport layer, with at least the charge generation layer comprising the above-mentioned phthalocyanine pigment and disazo pigment of formula (I).

In the above-mentioned electrophotographic photoconductor, it is preferable that the phthalocyanine pigment for use in the photoconductive layer be a metal-free τ-type phthalocyanine pigment, a metal free X-type phthalocyanine pigment, or a titanyl phthalocyanine pigment.

Furthermore, when the titanyl phthalocyanine pigment is employed in the electrophotographic photoconductor, it is preferable that the titanyl phthalocyanine pigment exhibit main peaks of Bragg angle 2θ at least at 9.0°±0.2° and 27.2°±0.2°, or at least at 9.6°±0.2° and 27.2°±0.2°, in the X-ray diffraction spectrum thereof by using a Cu—Kα characteristic X-ray with a wavelength of 1.54 Å. Alternatively, it is preferable that the titanyl phthalocyanine pigment exhibit only one main peak of Bragg angle 2θ at least at 27.2°±0.2° in the X-ray diffraction spectrum thereof by using a Cu—Kα characteristic X-ray with a wavelength of 1.54 Å.

In the first mentioned electrophotographic photoconductor, it is preferable that the disazo pigment for use in the photoconductive layer be a compound of formula (II):

(II)

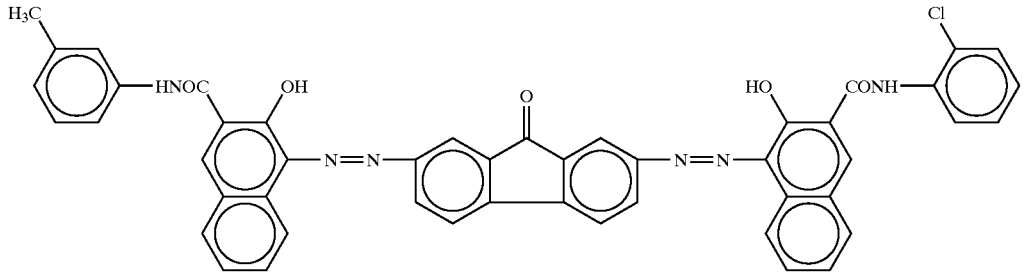

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
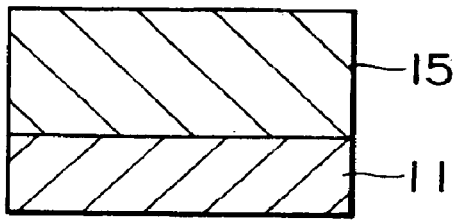
FIGS. 1 through 5 are schematic cross-sectional views which show five embodiments of the structure of an electrophotographic photoconductor according to the present invention.

The photoconductive layer of an electrophotographic photoconductor comprises a phthalocyanine pigment.

Examples of the phthalocyanine pigment for use in the present invention include metal-free τ-type phthalocyanine, metal-free X-type phthalocyanine, vanadyl phthalocyanine, alumichloro phthalocyanine, indiumchloro phthalocyanine, titanyl phthalocyanine, hydroxygallium phthalocyanine, hydroxyaluminum phthalocyanine, hydroxyindium phthalocyanine, dichlorotin phthalocyanine, and chlorogallium phthalocyanine.

The phthalocyanine pigments for use in the present invention are not limited to the above pigments. Of the above-mentioned pigments, a metal-free τ-type phthalocyanine, a metal-free X-type phthalocyanine, and a titanyl phthalocyanine with a specific crystal form to be described later are preferably employed.

The X-type metal-free phthalocyanine for use in the present invention, which is described in U.S. Pat. No. 3,357,989 and U.S. Pat. No. 3,594,163, can be obtained by subjecting α-type metal-free phthalocyanine to milling process.

The basic structure of the titanyl phthalocyanine pigment for use in the present invention is represented by the following formula (III):

(III)

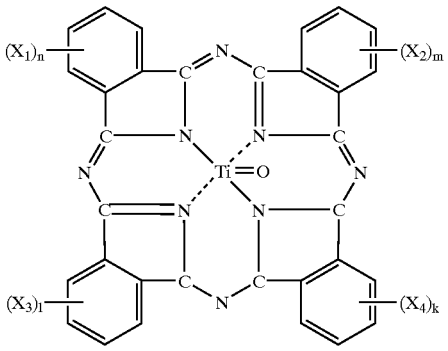

wherein $X_1$, $X_2$, $X_3$ and $X_4$ each is a halogen atom; and n, m, l, k each is an integer of 0 to 4.

Conventionally known A-type titanyl phthalocyanine pigment as disclosed in Japanese Laid-Open Patent Application 62-67094, B-type titanyl phthalocyanine pigment as in Japanese Laid-Open Patent Application 61-239248, and C-type titanyl phthalocyanine pigment as in Japanese Laid-Open Patent Application 63-366 can be employed in the present invention. It is preferable that the titanyl phthalocyanine pigment have such a crystal form as to exhibit main peaks of Bragg angle 2θ at least at 9.0°±0.2° and 27.2°±0.2°, or at least at 9.6°±0.2° and 27.2°±0.20 in the X-ray diffraction spectrum thereof by using a Cu—Kα characteristic X-ray with a wavelength of 1.54 Å. Alternatively, it is preferable that the titanyl phthalocyanine pigment have such a crystal form as to exhibit only one main peak of Bragg angle 2θ at 27.2°±0.2° in the X-ray diffraction spectrum thereof by using a Cu—Kα characteristic X-ray with a wavelength of 1.54 Å. In the crystal form of the titanyl phthalocyanine pigment which gives rise to only one peak of Bragg angle 2θ at 27.2°±0.2° in the X-ray diffraction spectrum thereof, the intensities, namely, the heights, of any other peaks are 35% or less of the intensity, namely, the height of the peak at 27.2°±0.2°.

The above-mentioned titanyl phthalocyanine pigments having the specific crystal forms give absorption peaks in the 780 to 860 nm region with respect to the visible to near infrared spectra, and exhibit remarkably high sensitivity to the semiconductor laser beam as compared with other conventional titanyl phthalocyanine pigments having different crystal forms, such as A-type, B-type and C-type.

The titanyl phthalocyanine pigments for use in the present invention can be obtained by synthesizing methods as disclosed in Japanese Laid-Open Patent Applications Nos. 64-17066, 2-28265, 3-35064, 3-200790 and 3-269064.

The τ-type metal-free phthalocyanine for use in the present invention, which is described in Japanese Laid-Open Patent Application No. 58-182639, can be obtained by subjecting α-type metal-free phthalocyanine to wet milling with heating in polyethylene glycol.

The photoconductive layer of the photoconductor according to the present invention also comprises a disazo pigment of formula (I):

(I)

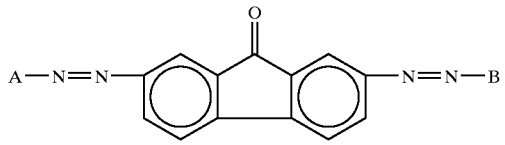

wherein A and B are coupler radicals having different structures.

The electrophotographic photoconductor of the present invention is advantageous as the panchromatic photoconductor from the viewpoints of light absorption and sensitivity because the previously mentioned phthalocyanine pigment gives rise to light absorption in the wave range with long wavelengths of 600 nm or more, and exhibits high sensitivity therein, and the disazo pigment of formula (I) gives rise to light absorption in the visible region, and especially exhibits high sensitivity in the wave range of 400 to 700 nm.

Preferable examples of the coupler radicals represented by A and B in formula (I) are as follows:

(IV)

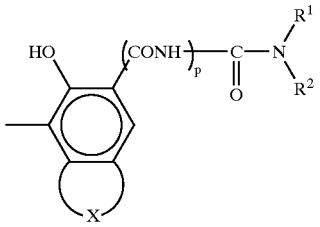

(V)

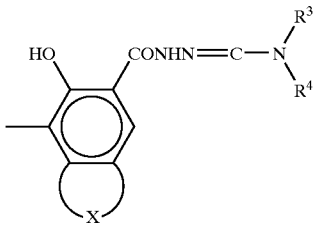

wherein X is a radical necessary for forming a hydro-carbon ring or a heterocyclic group, such as naphthalene ring, anthracene ring, carbazole ring, benzocarbazole ring, dibenzofuran ring, or dibenzothiophene ring, which is obtained by condensation with a benzene ring and may have a substituent; $R^1$, $R^2$, $R^3$ and $R^4$ each is hydrogen, an alkyl group which may have a substituent, an aryl group, an aralkyl group, or a heterocyclic group, and $R^1$ and $R^2$ may form a nitrogen-containing cyclic amino group; and p in formula (IV) is an integer of 0 or 1.

(VI)

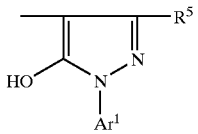

wherein $R^5$ is hydrogen, an alkyl group which may have a substituent, an aryl group, an aralkyl group, or a heterocyclic group; and $Ar^1$ is an aryl group which may have a substituent, or a heterocyclic group.

(VII)

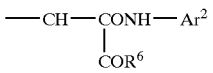

wherein $R^6$ is an alkyl group which may have a substituent, an aryl group, an aralkyl group, or a heterocyclic group; and $Ar^2$ is an aryl group which may have a substituent, or a heterocyclic group.

(VIII)

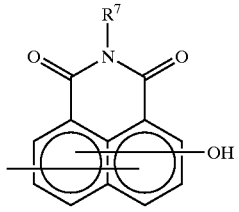

wherein $R^7$ is an alkyl group which may have a substituent, an aryl group, an aralkyl group, or a heterocyclic group.

(IX)

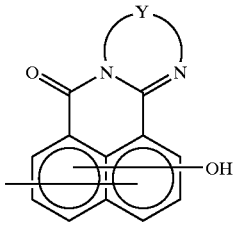

wherein Y is a bivalent aromatic hydrocarbon group which may have a substituent, or a bivalent heterocyclic group containing nitrogen atom in the ring thereof.

Examples of the alkyl group for use in the above-mentioned coupler radicals include methyl group, ethyl group and propyl group.

Examples of the aralkyl group are benzyl group and phenethyl group.

Examples of the aryl group are phenyl group, naphthyl group and anthryl group.

Examples of the heterocyclic group are pyridyl group, thienyl group, thiazolyl group, carbazolyl group, benzoimidazolyl group and benzothiazolyl group.

Examples of the cyclic amino group containing nitrogen atom include pyrrole, pyrroline, pyrrolidine, pyrrolidone, indole, indolyl, carbazole, imidazole, pyrazole, pyrazoline, oxazine and phenoxazine.

Examples of the substituent for use in the coupler radicals of formulae (IV) to (IX) include an alkyl group such as methyl group, ethyl group, propyl group or butyl group; an alkoxyl group such as methoxy group, ethoxy group or propoxy group; a halogen atom such as fluorine, chlorine or bromine; a dialkylamino group such as dimethylamino group or diethylamino group; and phenyl-carbamoyl group, nitro group, cyano group, and a halomethyl group such as trifluoromethyl group.

Specific examples of the disazo pigment of formula (I) for use in the present invention are as follows:

TABLE 1-(1)
(I)-1
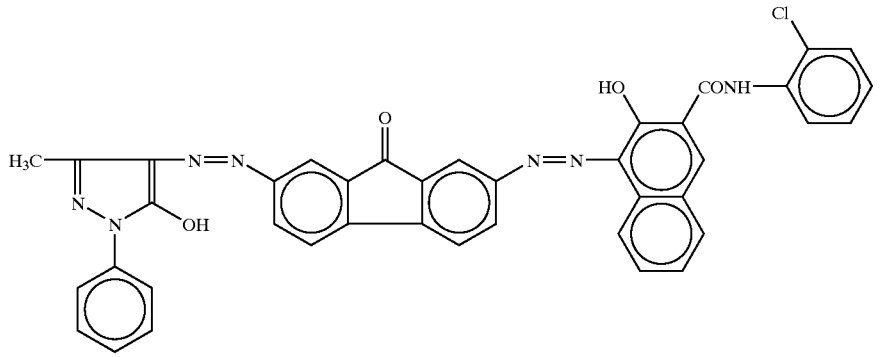
(I)-2
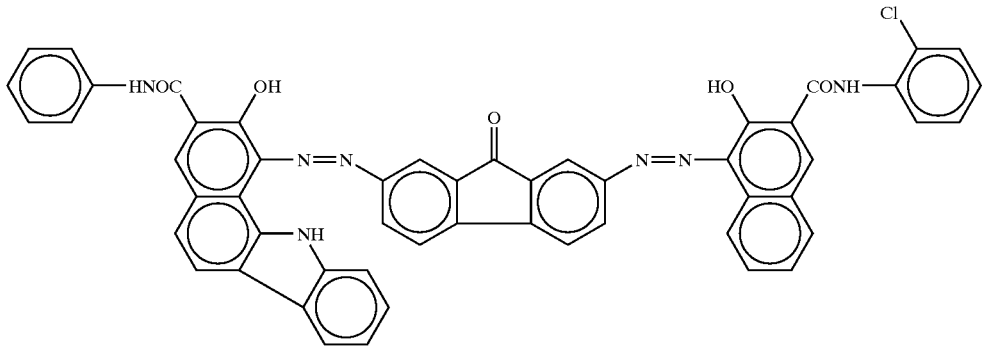
(I)-3
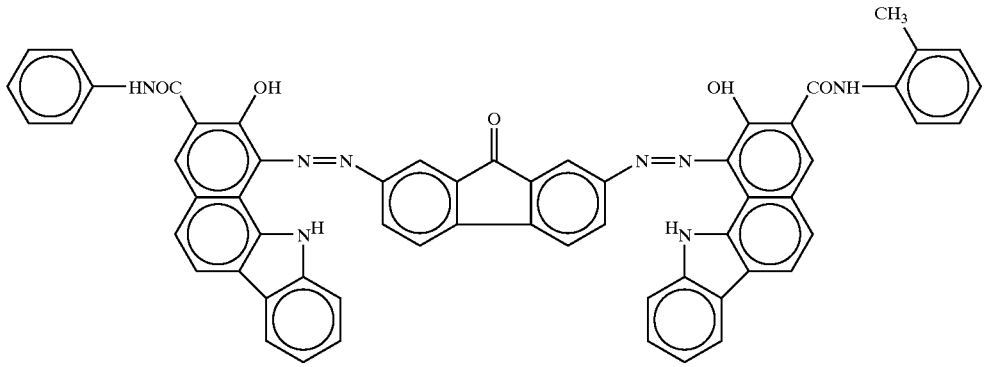
(I)-4
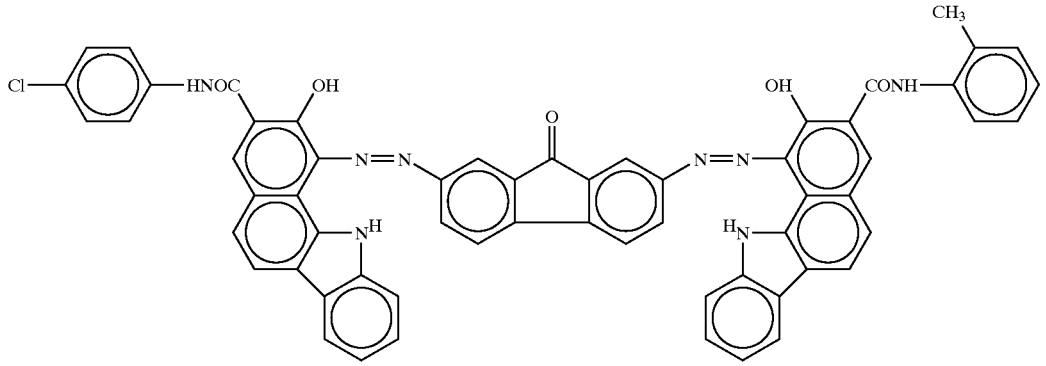

TABLE 1-(1)-continued
(I)-5
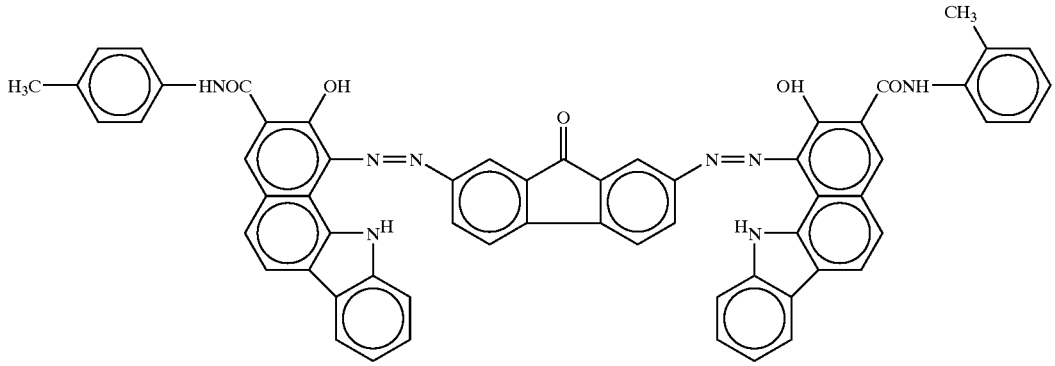
TABLE 1-(2)
(I)-6
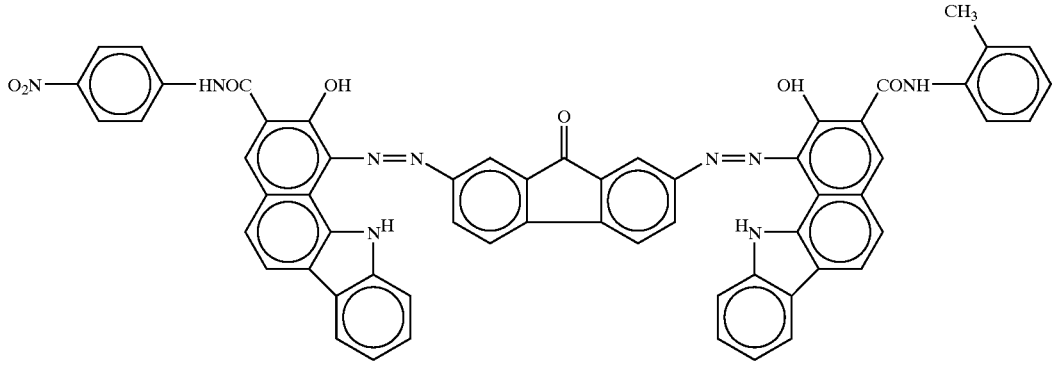
(I)-7
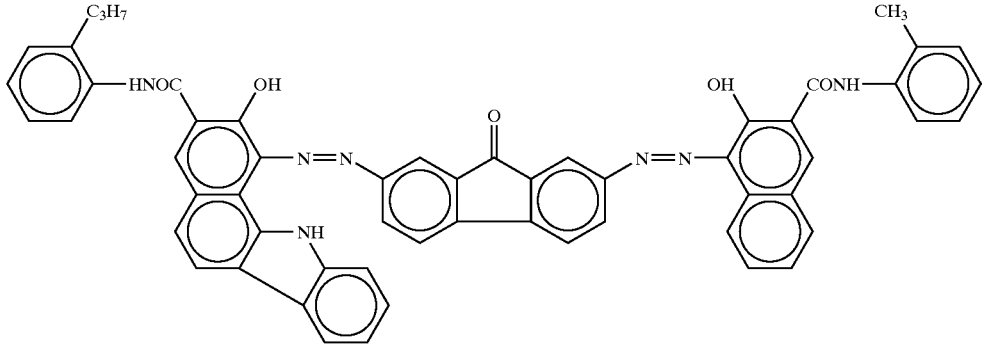
(I)-8
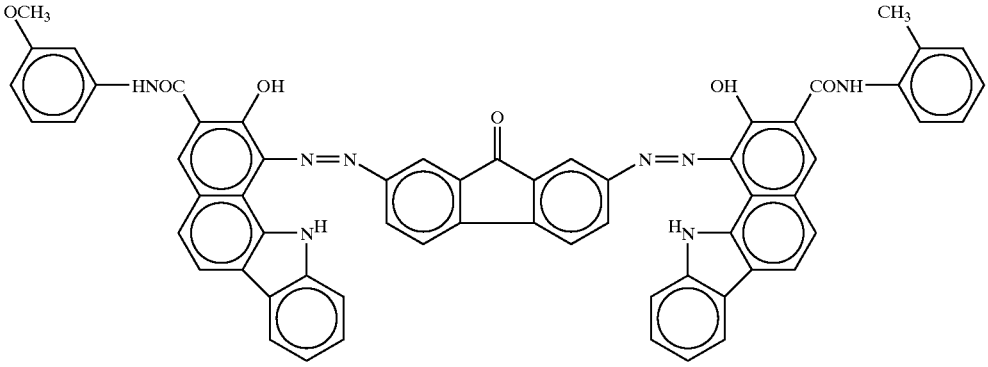

TABLE 1-(2)-continued
(I)-9
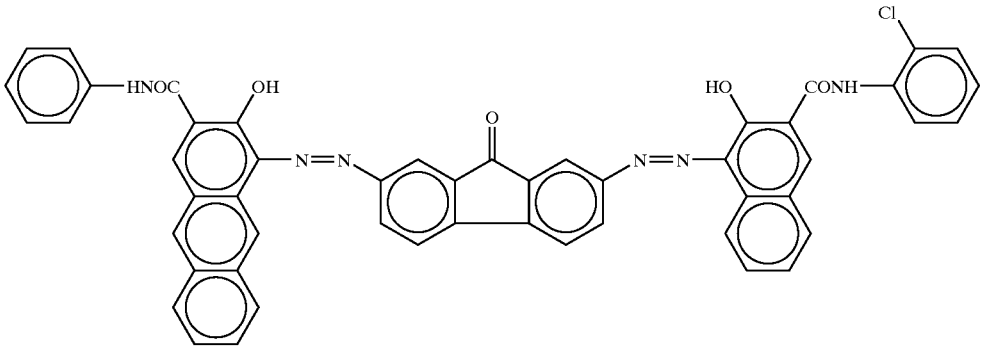
(I)-10
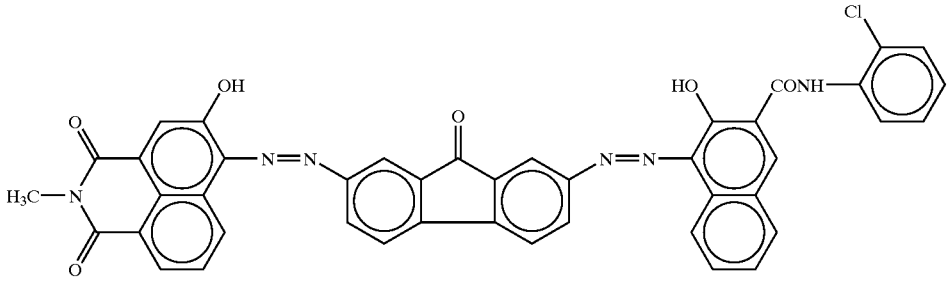
TABLE 1-(3)
(I)-11
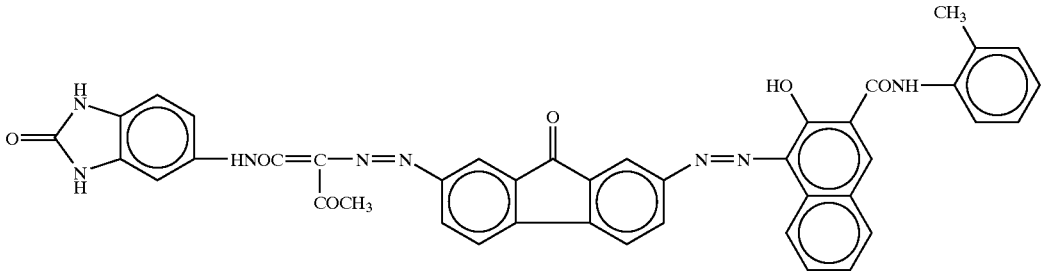
(I)-12
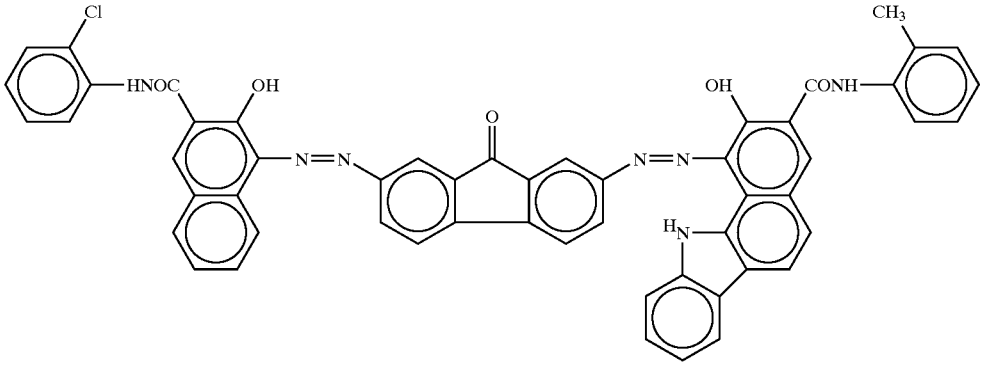

TABLE 1-(3)-continued
(I)-13
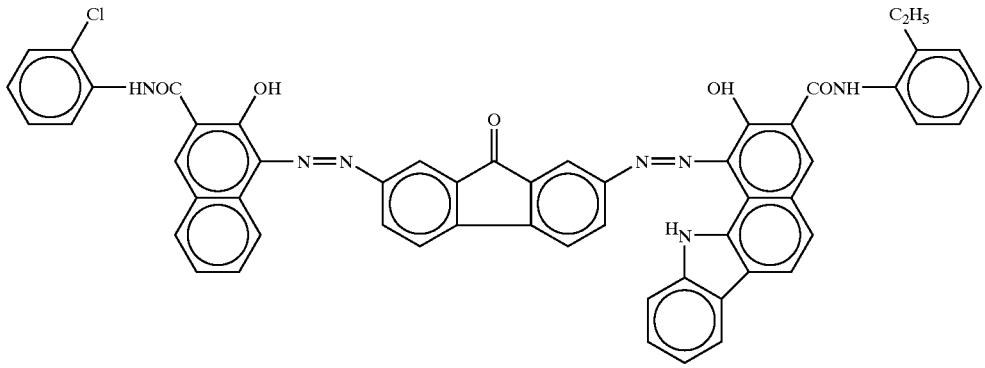
(I)-14
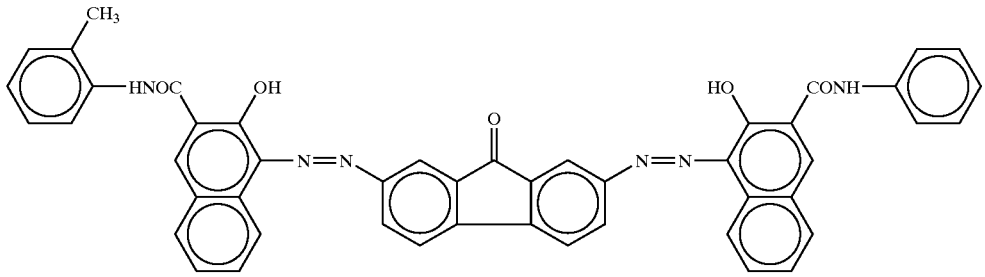
(I)-15
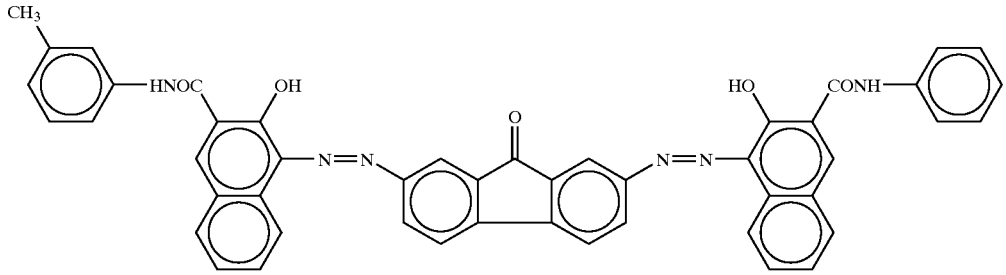
TABLE 1-(4)
(I)-16
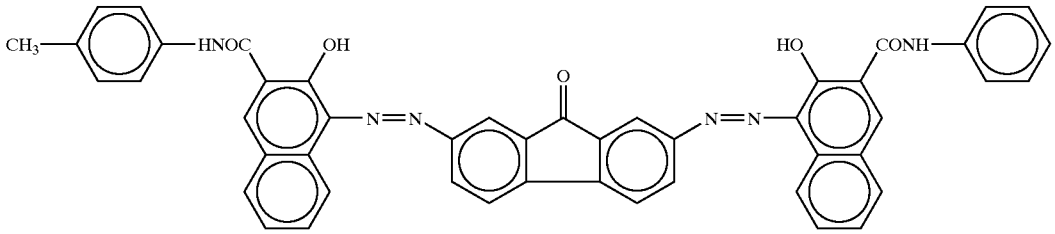
(I)-17
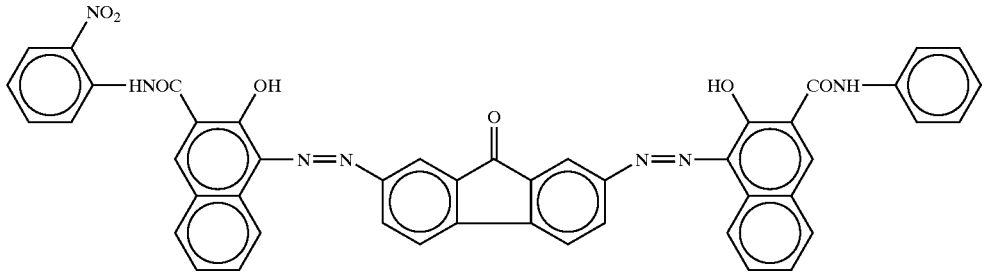

TABLE 1-(4)-continued
(I)-18
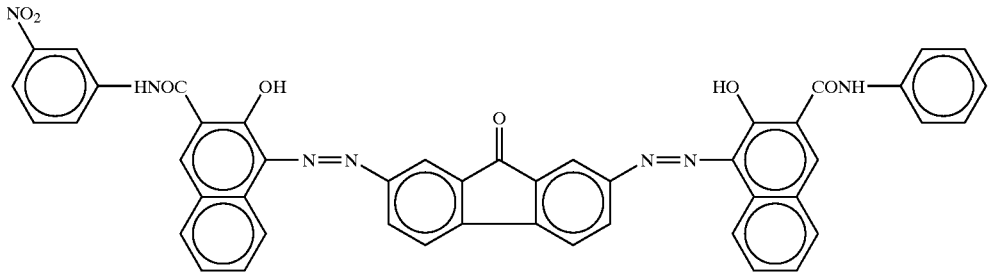
(I)-19
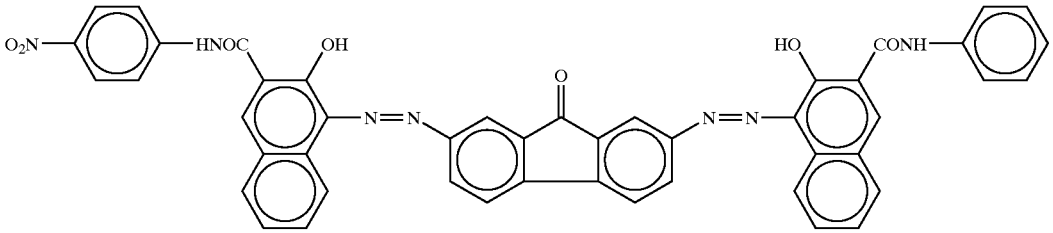
(I)-20
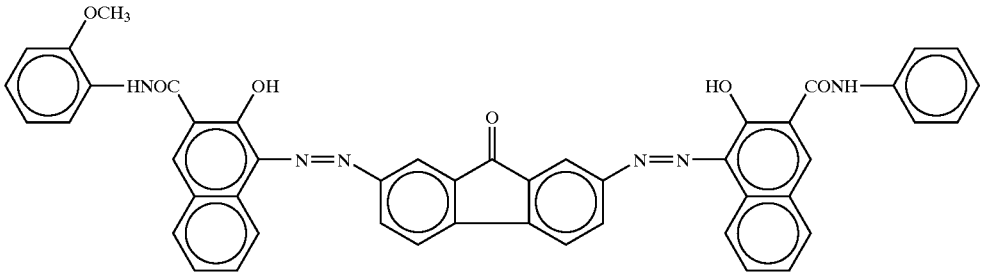
TABLE 1-(5)
(I)-21
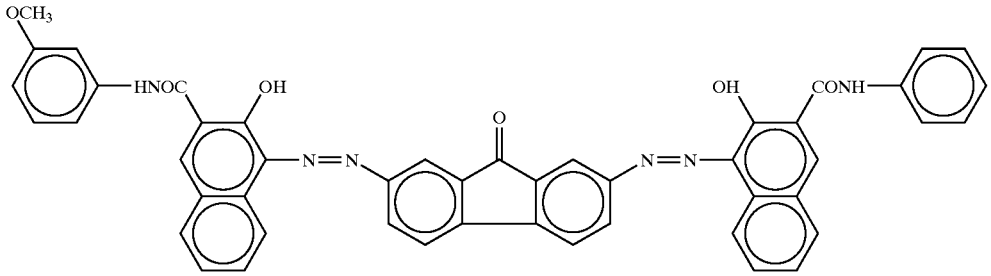
(I)-22
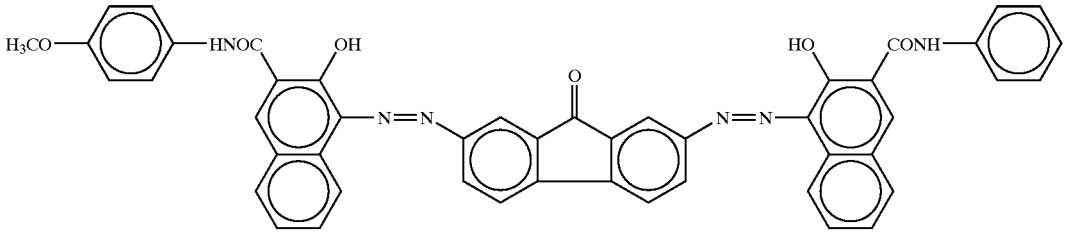

TABLE 1-(5)-continued
(I)-23
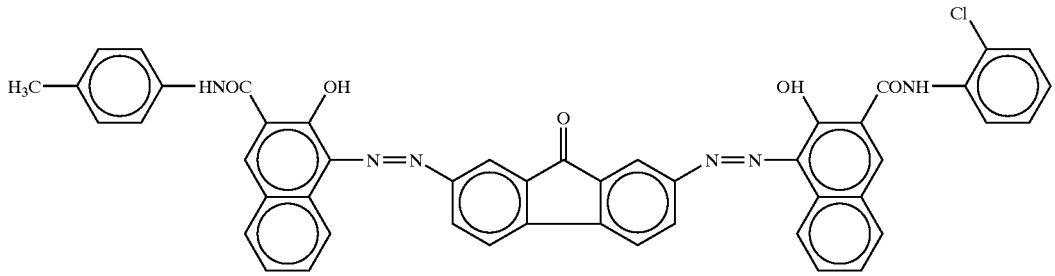
(I)-24
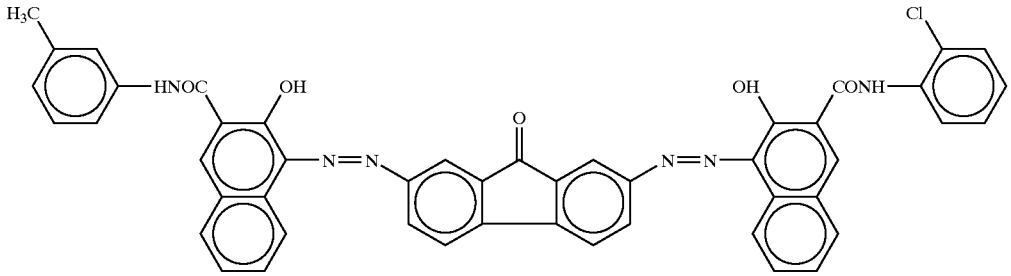
(I)-25
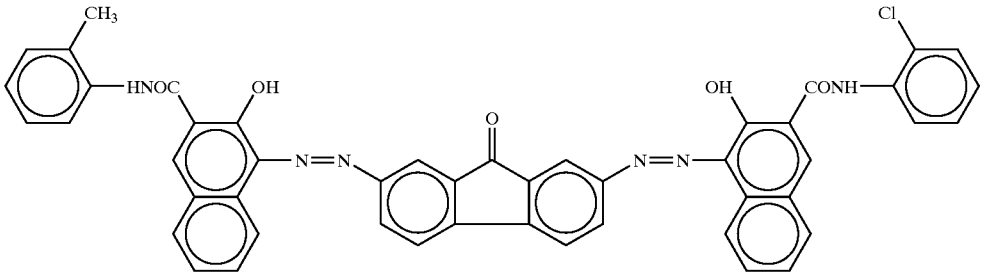
TABLE 1-(6)
(I)-26
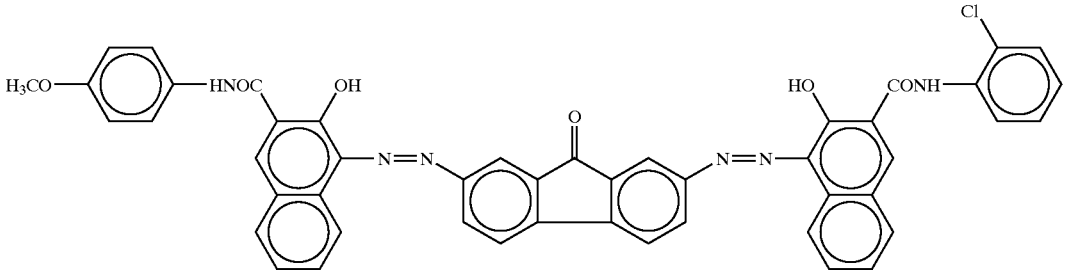
(I)-27
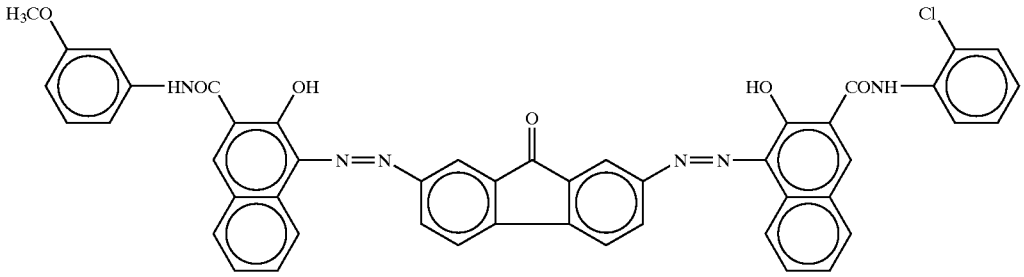

TABLE 1-(6)-continued
(I)-28
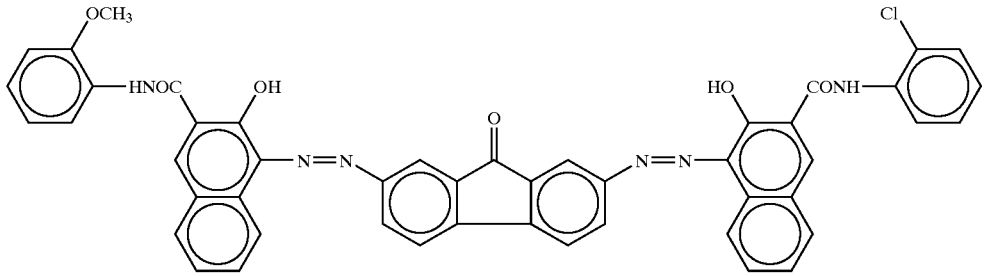
(I)-29
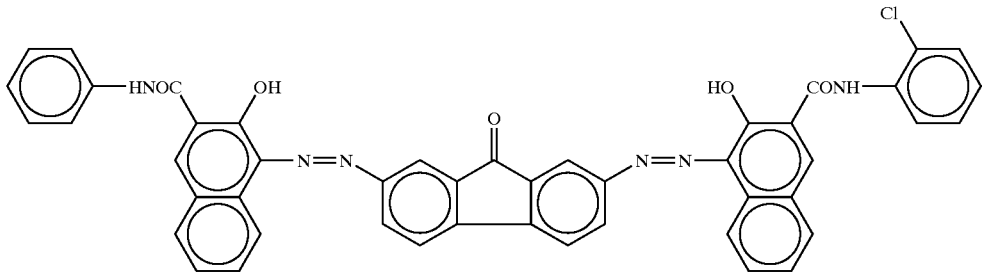
(I)-30
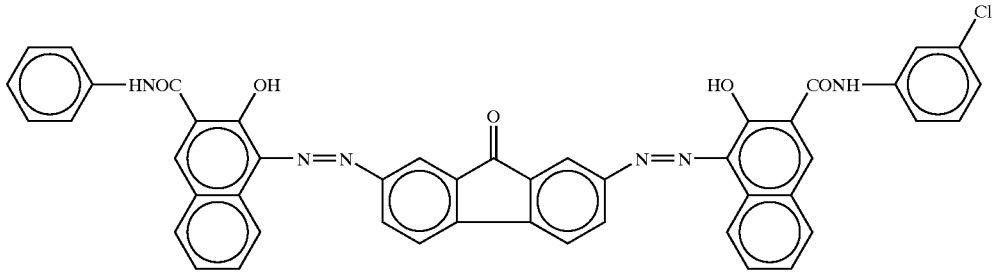
TABLE 1-(7)
(I)-31
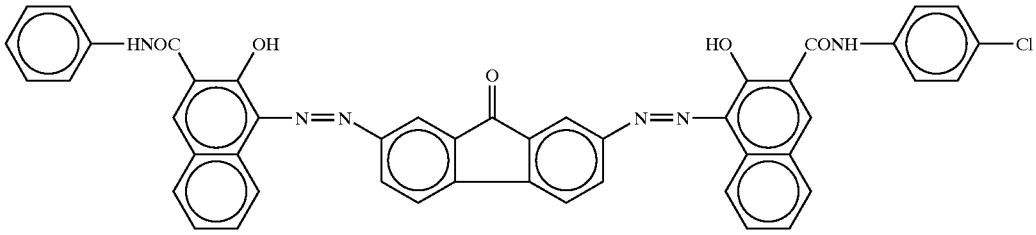
(I)-32
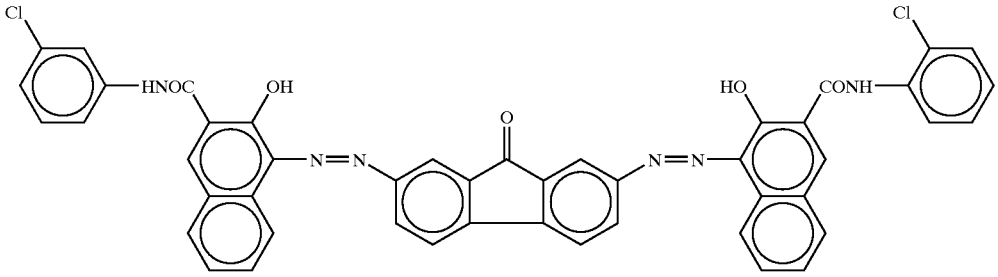

TABLE 1-(7)-continued
(I)-33
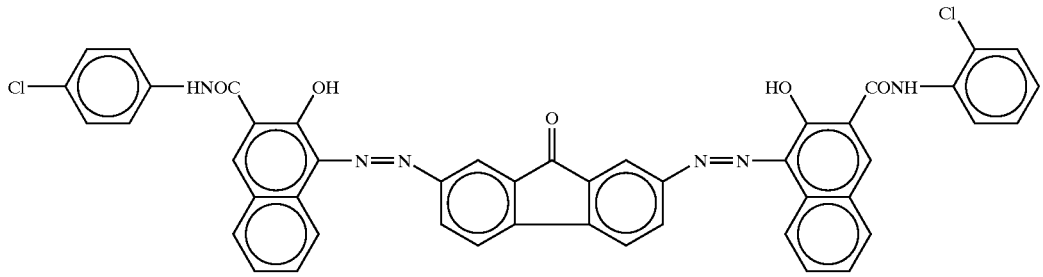
(I)-34
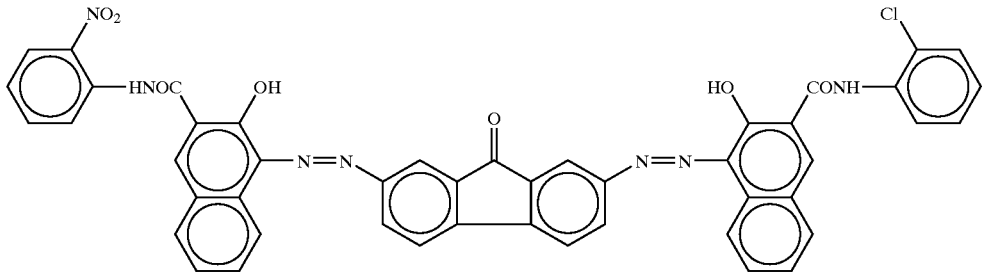
(I)-35
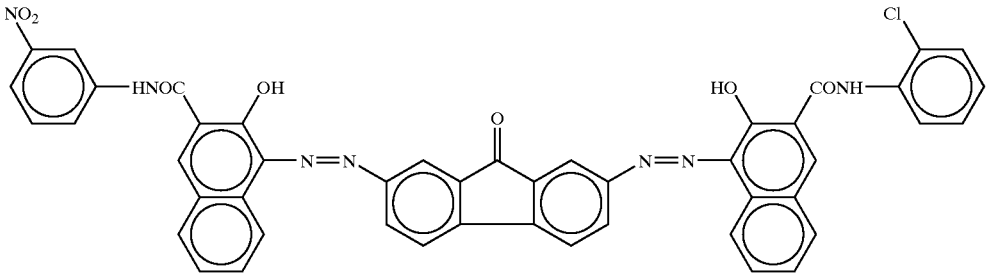
TABLE 1-(8)
(I)-36
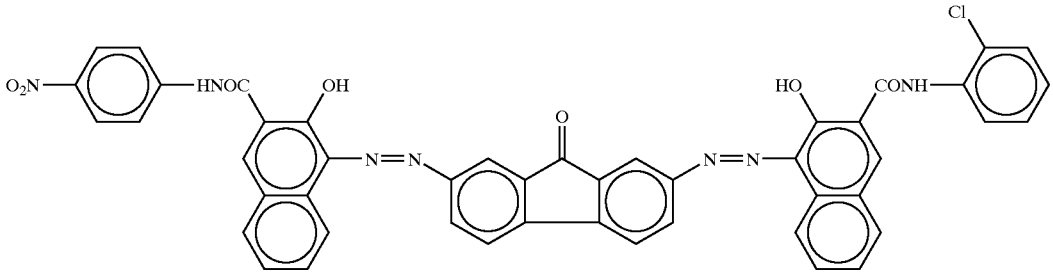
(I)-37
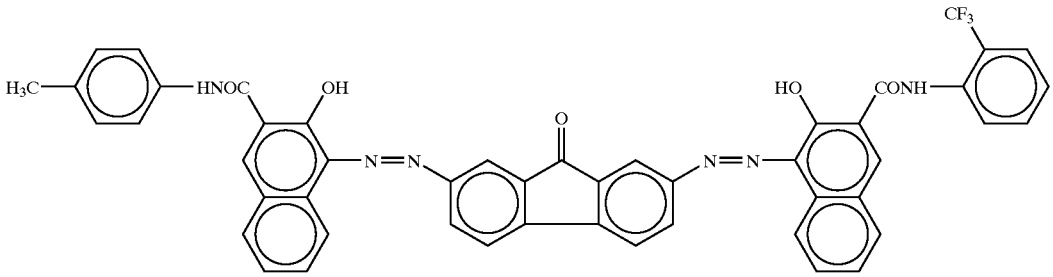

TABLE 1-(8)-continued
(I)-38
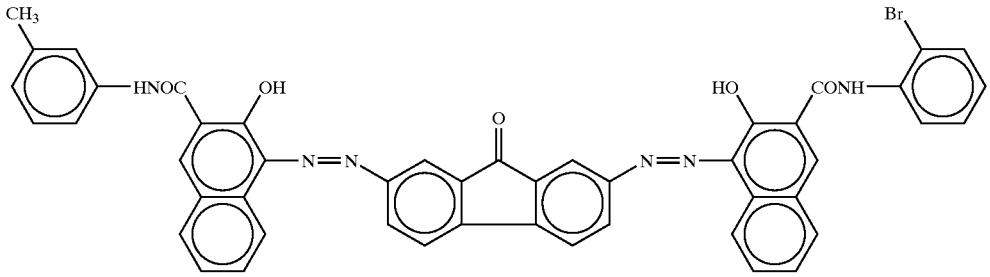
(I)-39
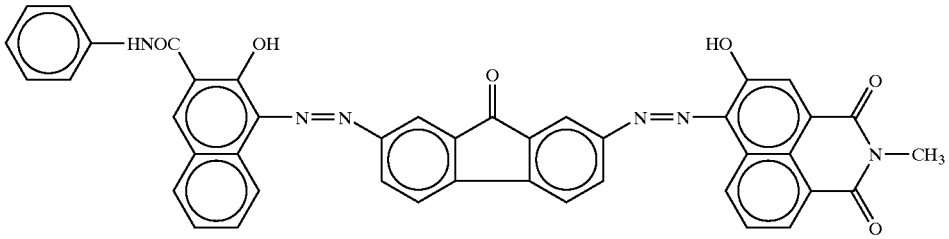
(I)-40
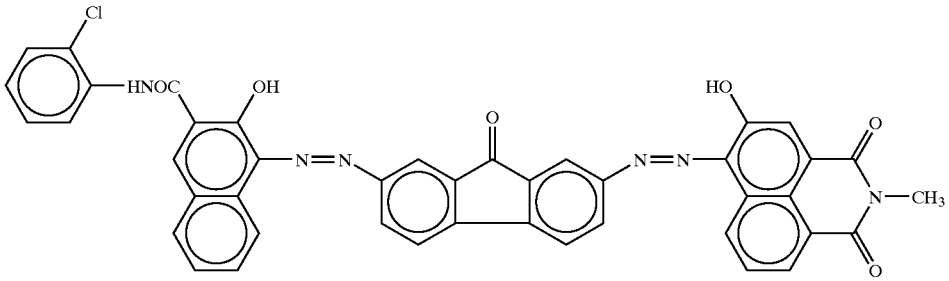
(I)-41
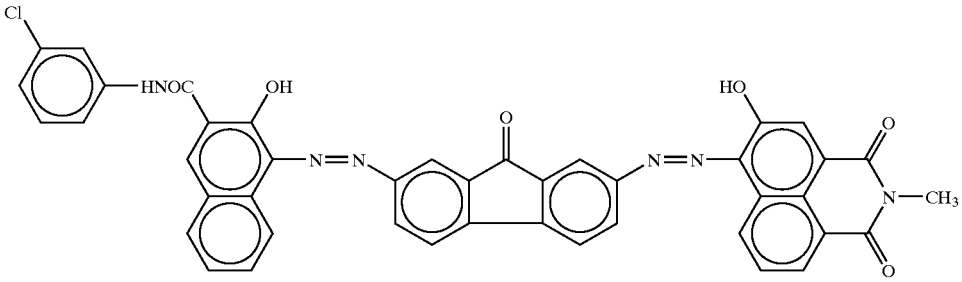
TABLE 1-(9)
(I)-42
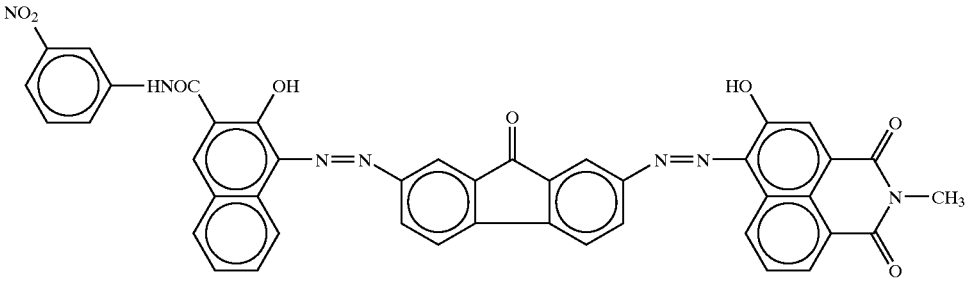

TABLE 1-(9)-continued
(I)-43
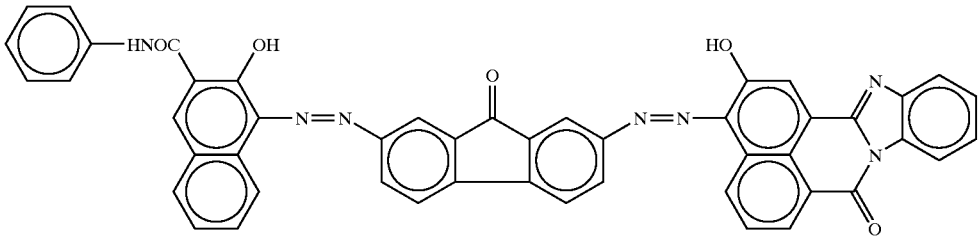
(I)-44
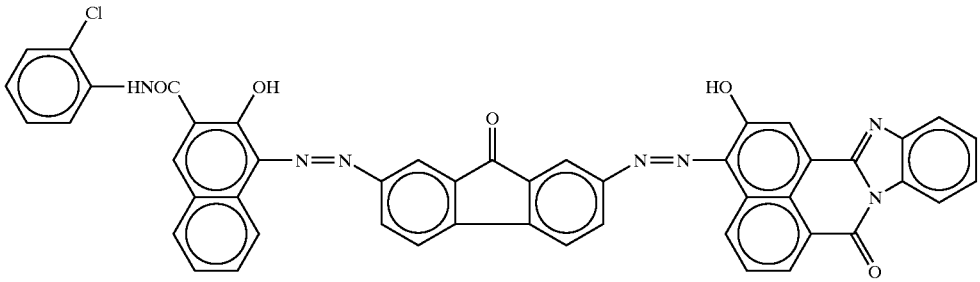
(I)-45
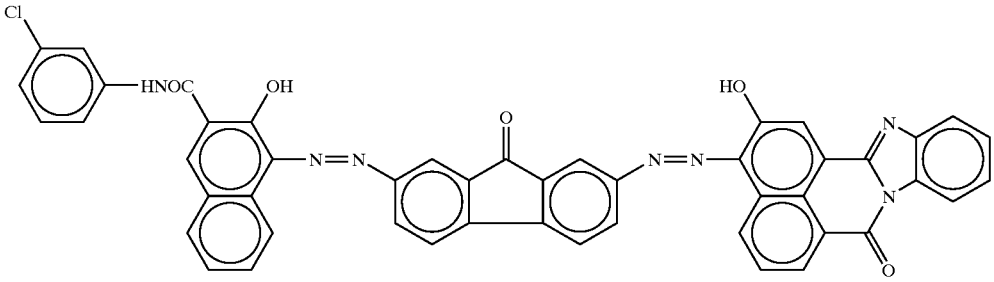
(I)-46
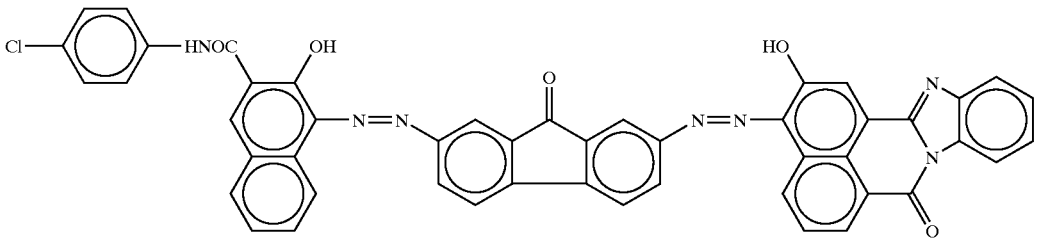
(I)-47
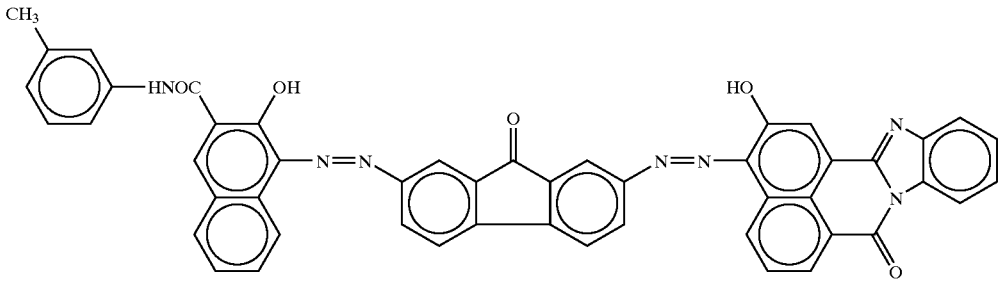

TABLE 1-(10)

(I)-48

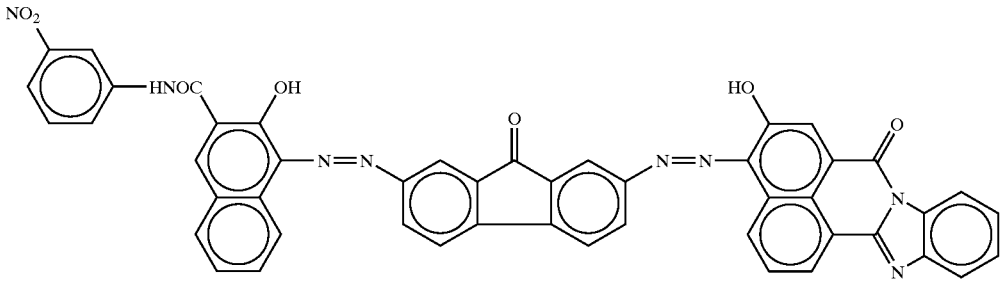

(I)-49

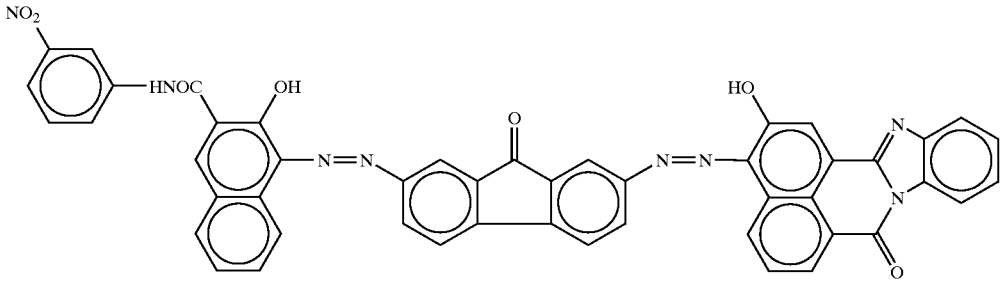

(I)-50

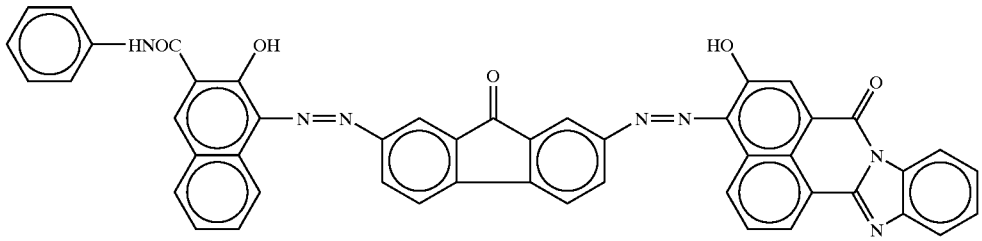

(I)-51

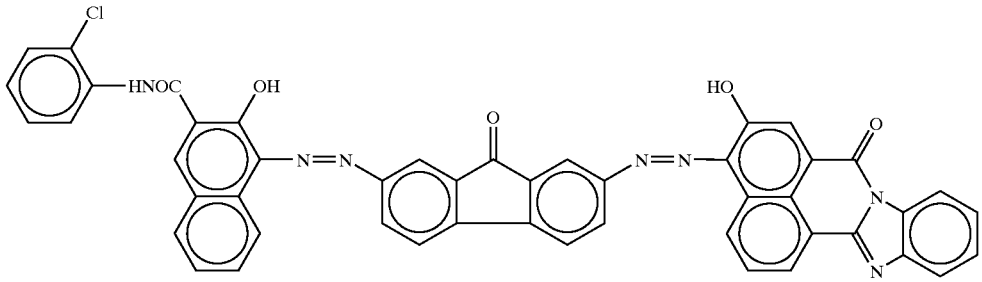

(I)-52

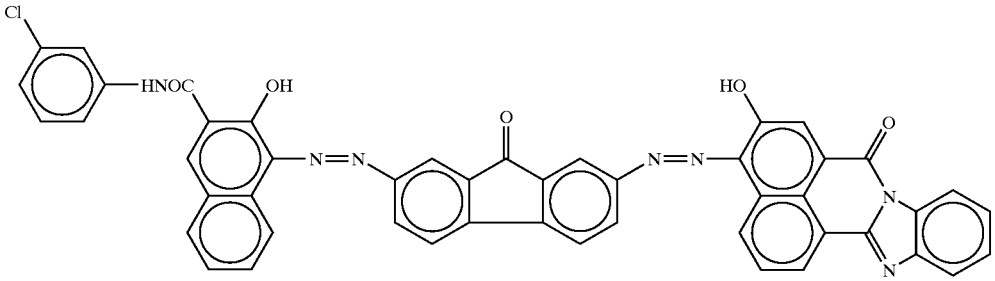

The disazo pigment of formula (I) can be obtained by allowing a diazonium salt compound to subsequently react with couplers corresponding to the coupler radicals A and B by two steps. Alternatively, a diazonium salt compound is allowed to react with one coupler corresponding to the coupler radical A or B. After the reaction product thus obtained is isolated, it is allowed to react with the other coupler corresponding to the coupler radical A or B.

The combination of the disazo pigment of formula (I) and the specific phthalocyanine pigment is excellent because both pigments have good dispersion properties and they can easily match from the viewpoint of energy level, thereby activating the mutual action between the two pigments and promoting the sensitizing effects.

In particular, the disazo pigment of the following formula (II), which corresponds to Pigment No. (I)-24 in Table 1-(5), is preferably employed in the photoconductor of the present invention:

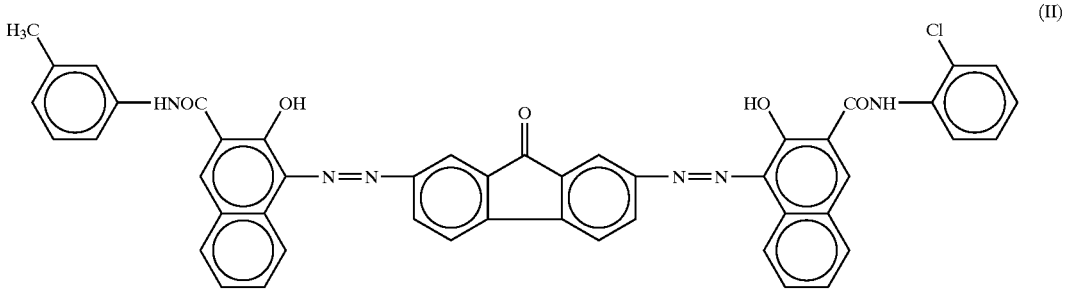

(II)

The reasons why the combination of the disazo pigment of formula (II) and the phthalocyanine pigment is advantageous are as follows:

(a) The disazo pigment of formula (II) exhibits remarkably high photosensitivity in the visible region.

(b) The disazo pigment of formula (II) shows excellent matching properties with the phthalocyanine pigment from the viewpoint of energy level, so that the photosensitivity does not locally decrease through a broad wave range.

(c) The disazo pigment of formula (II) is well dispersed in a dispersion medium and the particle size of the disazo pigment can be remarkably reduced. As a result, the disazo pigment can be thoroughly mixed with the phthalocyanine pigment, which enables the uniform photoconductive layer to be formed.

The present invention will now be explained in detail by referring to FIGS. 1 to 5.

FIG. 1 is a schematic cross-sectional view which shows an example of the electrophotographic photoconductor according to the present invention. The photoconductor as shown in FIG. 1 comprises an electroconductive support 11 and a photoconductive layer 15 formed thereon, which comprises the phthalocyanine pigment and the disazo pigment of formula (I).

Figure 2:
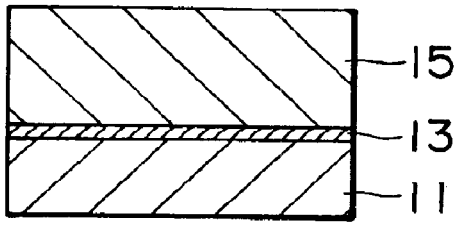

FIG. 2 is a schematic cross-sectional view which shows another example of the electrophotographic photoconductor according to the present invention. In the photoconductor as shown in FIG. 2, an intermediate layer 13 is provided between an electroconductive support 11 and a photoconductive layer 15.

Figure 3:
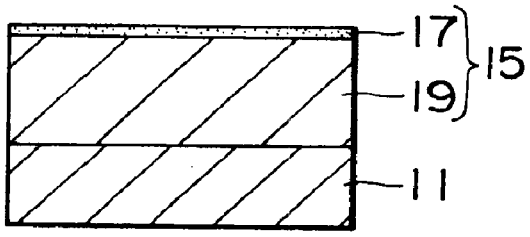
Figure 4:
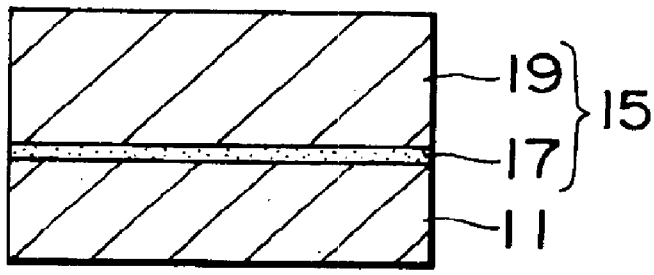

FIGS. 3 and 4 are schematic cross-sectional views which show further examples of the electrophotographic photoconductor according to the present invention. The photoconductor as shown in FIG. 3 comprises an electroconductive support 11, and a photoconductive layer 15 formed thereon, which comprises a charge transport layer 19 and a charge generation layer 17 successively formed on the electroconductive support 11 in this order. In the electrophotographic photoconductor shown in FIG. 4, a charge generation layer 17 and a charge transport layer 19 are successively provided on an electroconductive support 11 in this order. At least the charge generation layer 17 comprises the phthalocyanine pigment and the disazo pigment of formula (I) in the photoconductors as shown in FIGS. 3 and 4.

Figure 5:
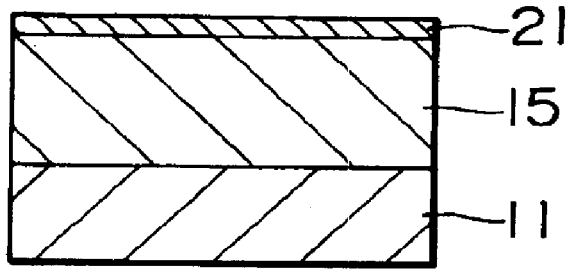

FIG. 5 is a schematic cross-sectional view which shows still another example of the electrophotographic photoconductor according to the present invention. The photoconductor as shown in FIG. 5 comprises an electroconductive support 11, a photoconductive layer 15 formed thereon, and a protective layer 21 formed on the photoconductive layer 15.

The electroconductive support 11 of the photoconductor according to the present invention may exhibit electroconductive properties, and have a volume resistivity of $10^{10}$ Ω·cm or less. For instance, the electroconductive support 11 can be prepared by coating a plastic film or a sheet of paper, which may be in the cylindrical form, with metals such as aluminum, nickel, chromium, nichrome, copper, silver, gold and platinum, or metallic oxides such as tin oxide and indium oxide by the vacuum deposition or sputtering method. Alternatively, a sheet of aluminum, aluminum alloys, nickel, or stainless steel may be formed into a tube by extrusion or drawing method. Subsequently, the tube thus obtained may be subjected to surface treatment such as machining or abrasion to obtain the electroconductive support 11 for use in the photoconductor of the present invention. In addition, an endless nickel belt and an endless stainless steel belt as disclosed in Japanese Laid-Open Patent Application 52-36016 can be used as the electroconductive supports 11.

Further, an electroconductive layer may be provided on the electroconductive support 11. In such a case, electroconductive particles and a binder resin may be dispersed in a proper solvent such as tetrahydrofuran (THF), dichloromethane (MDC), methyl ethyl ketone (MEK), or toluene, and the thus obtained dispersion may be coated on the above-mentioned electroconductive support 11. Examples of the electroconductive particles are finely-divided particles of carbon black, acetylene black, metals such as aluminum, nickel, iron, nichrome, copper, zinc and silver, and metallic oxides such as electroconductive tin oxide, ITO and electroconductive titanium oxide. Examples of the binder resin in which the electroconductive particles are dispersed include thermoplastic resins, thermosetting resins and photo-setting resins such as polystyrene, styrene-acrylonitrile copolymer, styrene-butadiene copolymer, styrene-maleic anhydride copolymer, polyester, polyvinyl chloride, vinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenolic resin and alkyd resin.

In addition, a heat-shrinkable tubing obtained by adding the above-mentioned electroconductive particles to a material such as polyvinyl chloride, polypropylene, polyester, polystyrene, polyvinylidene chloride, polyethylene, chlorinated rubber or Teflon may be provided on an appropriate cylindrical support to prepare the electroconductive support 11.

When the photoconductive layer 15 comprises the charge generation layer 17 and the charge transport layer 19 as shown in FIGS. 3 and 4, the charge generation layer 17 may consist of the phthalocyanine pigment and the disazo pigment of formula (I), or may comprise a binder resin, and the phthalocyanine pigment and the disazo pigment of formula (I) which are dispersed in the binder resin.

To prepare the charge generation layer 17, the above-mentioned components are dispersed in a proper solvent in a ball mill, an attritor or a sand mill, or using the ultrasonic wave to prepare a coating liquid for the charge generation layer 17. The coating liquid for the charge generation layer 17 is applied to the electroconductive support 11, the intermediate layer 13 or the charge transport layer 19, by dip coating, spray coating, beads coating, nozzle coating, spinner coating or ring coating, and then dried.

It is preferable that the amount ratio by weight of the phthalocyanine pigment to the disazo pigment of formula (I) be in the range of 8:1 to 1:8. When two kinds of pigments are contained in such an amount, the photosensitivities of the obtained photoconductor are sufficient not only in the visible region, but also in the near infrared region.

Examples of the binder resin for use in the charge generation layer 17 are polyamide, polyurethane, epoxy resin, polyketone, polycarbonate, silicone resin, acrylic resin, polyvinyl butyral, polyvinyl formal, polyvinyl ketone, polystyrene, polysulfone, poly-N-vinylcarbazole, polyacrylamide, polyvinyl benzal, polyester, phenoxy resin, vinyl chloride-vinyl acetate copolymer, polyvinyl acetate, polyphenylene oxide, polyamide, polyvinyl pyridine, cellulose resin, casein, polyvinyl alcohol, and polyvinyl pyrrolidone.

It is preferable that the amount of the binder resin be in the range of 0 to 500 parts by weight, more preferably in the range of 10 to 300 parts by weight, to 100 parts by weight of the charge generating material in the charge generation layer 17.

Examples of the solvent used for the preparation of the charge generation layer 17 are isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene and ligroine.

It is preferable that the thickness of the charge generation layer 17 be in the range of about 0.01 to 5 $\mu$m, more preferably in the range of 0.1 to 2 $\mu$m.

To prepare the coating liquid for the charge generation layer 17, the dispersion of the phthalocyanine pigment and that of the disazo pigment of formula (I) may be separately prepared, and then, those dispersions may be mixed. However, the sensitivity of the obtained photoconductor is superior when the charge generation layer coating liquid is prepared by simultaneously pulverizing the above-mentioned two kinds of pigments and subjecting the mixture to milling process. The reason for this fact has not been clarified, but it is supposed that the mutual action between the two kinds of pigments is activated by the simultaneous pulverizing and milling, which improves the charge generating efficiency of the charge generating materials.

To prepare the charge transport layer 19, a charge transporting material and a binder resin are dissolved or dispersed in a proper solvent such as tetrahydrofuran, dioxane, toluene, dichloromethane, monochlorobenzene, dichloroethane, cyclohexanone, methyl ethyl ketone or acetone. The thus obtained coating liquid is coated on the electroconductive support 11 as shown in FIG. 3, or on the charge generation layer 17 as in FIG. 4, and then dried.

The charge transporting material includes a positive hole transporting material and an electron transporting material.

Examples of the electron transporting material include electron acceptors such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-on, 1,3,7-trinitrodibenzothiophene-5,5-dioxide, and benzoquinone derivatives.

Examples of the positive hole transporting material are poly-N-vinylcarbazole and derivatives thereof; poly-γ-carbazolylethylglutamate and derivatives thereof; pyrene-formaldehyde condensation product and derivatives thereof, polyvinyl pyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, and pyrene derivatives.

Those charge transporting materials may be used alone or in combination.

Examples of the binder resin for use in the charge transport layer 19 are thermoplastic resins and thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenolic resin and alkyd resin.

It is preferable that the amount of the binder resin be in the range of 20 to 300 parts by weight, more preferably in the range of 40 to 150 parts by weight, to 100 parts by weight of the charge transporting material in the charge transport layer 19.

It is preferable that the thickness of the charge transport layer 19 be in the range of about 5 to 50 $\mu$m.

The charge transport layer 19 may further comprise a plasticizer, a leveling agent, and an antioxidant.

Any plasticizers used for general resins, such as dibutyl phthalate and dioctyl phthalate, may be contained in the charge transport layer 19. Such a plasticizer may be contained in the charge transport layer 19 in an amount of about 0 to 30 wt. % of the total weight of the binder resin.

Silicone oils such as dimethyl silicone oil and methylphenyl silicone oil, and polymers and oligomers having a perfluoroalkyl group on the side chain thereof can be used as the leveling agents in the charge transport layer 19. Such a leveling agent may be contained in the charge transport layer 19 in an amount of about 0 to 1 wt. % of the total weight of the binder resin.

In the case where the electrophotographic photoconductor of the present invention comprises a single-layered photoconductive layer 15 as shown in FIG. 1, the photoconductive layer 15 comprises the phthalocyanine pigment and the disazo pigment of formula (I) serving as the charge generating materials, and the charge transporting material as previously described.

To prepare the single-layered photoconductive layer 15, the charge generating materials, the charge transporting material, and the binder resin are dissolved or dispersed in a proper solvent such as tetrahydrofuran, dioxane, dichloroethane, dichloromethane or cyclohexane. Then, the thus prepared coating liquid may be coated on the electroconductive support 11, as shown in FIG. 1, by dip coating, spray coating or beads coating, and then dried.

The same binder resins as given in the formation of the charge transport layer 19 are usable as they are, and those binder resins may be used in combination with the same binder resins as given in the formation of the charge generation layer 17.

It is preferable that the amount of the charge generating material be in the range of 5 to 40 parts by weight, and the amount of the charge transporting material be in the range of 50 to 150 parts by weight, to 100 parts by weight of the binder resin in the single-layered photoconductive layer 15.

The single-layered photoconductive layer 15 may further comprise a plasticizer, a leveling agent and an antioxidant when necessary.

The thickness of the single-layered photoconductive layer 15 is preferably in the range of about 5 to 50 $\mu$m.

In the electrophotographic photoconductor of the present invention, the intermediate layer 13 may be provided between the electroconductive support 11 and the photoconductive layer 15 as shown in FIG. 2. The intermediate layer for use in the present invention comprises a resin as the main component. A resin with high resistance to generally used organic solvents is preferably employed because the photoconductive layer 15 is provided on the intermediate layer 13 using a solvent.

Examples of such a resin for use in the intermediate layer 13 include water-soluble resins such as polyvinyl alcohol, casein and sodium polyacrylate; alcohol-soluble resins such as copolymer nylon and methoxymethylated nylon; and cured resins with three dimensional network structure such as polyurethane, melamine resin, phenolic resin, alkyd-melamine resin and epoxy resin.

In addition, finely-divided pigment particles of metallic oxides such as titanium oxide, silica, alumina, zirconium oxide, tin oxide and indium oxide may be contained in the intermediate layer 13 to prevent the appearance of moire and to reduce the residual potential.

The intermediate layer 14 can be provided on the electroconductive support 11 using an appropriate solvent in accordance with the proper coating method as previously explained in the formation of the photoconductive layer 15.

The intermediate layer 13 for use in the present invention may further comprise a coupling agent such as silane coupling agent, titanium coupling agent or chromium coupling agent.

Furthermore, to provide the intermediate layer 13, $Al_2O_3$ may be deposited on the electroconductive support 11 by the anodizing process, or an organic material such as poly-para-xylylene (parylene), or inorganic materials such as $SiO_2$, $SnO_2$, $TiO_2$, ITO and $CeO_2$ may be vacuum-deposited on the electroconductive support 11.

It is proper that the thickness of the intermediate layer 13 be in the range of 0 to 5 $\mu$m.

In the present invention, the protective layer 21 may be provided on the photoconductive layer 15 to protect the photoconductive layer 15 as shown in FIG. 5.

The protective layer 21 for use in the present invention comprises a resin. Examples of such a resin include ABS resin, ACS resin, olefin-vinyl monomer copolymer, chlorinated polyether, allyl resin, phenolic resin, polyacetal, polyamide, polyamideimide, polyacrylate, polyallyl sulfone, polybutylene, polybutylene terephthalate, polycarbonate, polyether sulfone, polyethylene, polyethylene terephthalate, polyimide, acrylic resin, polymethylpentene, polypropylene, polyphenylene oxide, polysulfone, polystyrene, AS resin, butadiene-styrene copolymer, polyurethane, polyvinyl chloride, polyvinylidene chloride and epoxy resin.

The protective layer 21 may further comprise a fluorine-containing resin such as polytetrafluoroethylene, and a silicone resin to improve the abrasion resistance. In addition, inorganic materials such as titanium oxide, tin oxide and potassium titanate may be dispersed in the above-mentioned resins.

The protective layer 21 may be provided on the photoconductive layer 15 by the conventional coating method. The thickness of the protective layer 21 is preferably in the range of about 0.1 to 10 $\mu$m. Furthermore, a vacuum-deposited thin film of a-C or a-SiC may be used as the protective layer 21 in the present invention.

Further, another intermediate layer (not shown in FIG. 5) may be interposed between the photoconductive layer 15 and the protective layer 21. This kind of intermediate layer comprises as the main component a binder resin such as polyamide, alcohol-soluble nylon resin, water-soluble vinyl butyral resin, polyvinyl butyral and polyvinyl alcohol. This intermediate layer may also be provided by the conventional coating method. The proper thickness of the intermediate layer provided between the photoconductive layer 15 and the protective layer 21 is in the range of about 0.05 to 2 $\mu$m.

Other features of this invention will become apparent in the course of the following description of exemplary embodiments, which are given for illustration of the invention and are not intended to be limiting thereof.

EXAMPLE 1

[Formation of Intermediate Layer]

Three parts by weight of a commercially available alcohol-soluble polyamide (Trademark "CM-8000", made by Toray Industries, Inc.) was dissolved in 100 parts by weight of a mixed solvent of methanol and n-butanol with a volume ratio of 8:2 under the application of heat. Thus, a coating liquid for an intermediate layer was prepared.

The thus prepared intermediate layer coating liquid was coated on an aluminum plate (Trademark "A1080", made by Sumitomo Light Metal Industries, Ltd.) with a thickness of 0.2 mm, dried at 100° C. for 20 minutes, so that an intermediate layer with a thickness of 0.1 $\mu$m was formed on the electroconductive support.

[Formation of Charge Generation Layer]

Three parts by weight of a commercially available butyral resin (Trademark "XYHL", made by Union Carbide Japan K.K.) was dissolved in 150 parts by weight of cyclohexanone. Six parts by weight of a disazo pigment of formula (I)-24 (shown in TABLE 1-(5)) were added to the above prepared resin solution and dispersed in a ball mill for 120 hours. With the addition of 300 parts by weight of cyclohexanone, the dispersion was continued for further 3 hours. Thus, a charge generation layer coating liquid A comprising a disazo pigment was prepared.

Three parts by weight of a commercially available butyral resin (Trademark "XYHL", made by Union Carbide Japan K.K.) was dissolved in 150 parts by weight of cyclohexanone. Six parts by weight of a metal-free X-type phthalocyanine pigment (Trademark "Fastgen blue 8120B", made by Dainippon Ink & Chemicals, Incorporated) was added to the above prepared resin solution and dispersed in a ball mill for 120 hours. With the addition of 300 parts by weight of cyclohexanone, the dispersion was continued for further 3 hours. Thus, a charge generation layer coating liquid B comprising a metal-free X-type phthalocyanine pigment was prepared.

The previously obtained charge generation layer coating liquids A and B in the equal amount were mixed with stirring, so that a coating liquid for the charge generation layer was prepared.

The charge generation layer coating liquid was coated on the previously obtained intermediate layer, and dried at 130°

C. for 10 minutes, so that a charge generation layer with a thickness of 0.25 μm was provided on the intermediate layer.

[Formation of Charge Transport Layer]

Eight parts by weight of a charge transporting material of formula (a), 10 parts by weight of a polycarbonate resin (Trademark "Z-200", made by Mitsubishi Gas Chemical Company, Inc.), and 0.002 parts by weight of a silicone oil (Trademark "KF-50", made by Shin-Etsu Chemical Co., Ltd.) were dissolved in 85 parts by weight of tetrahydrofuran, so that a coating liquid for a charge transport layer was prepared.

Charge Transporting Material (a)

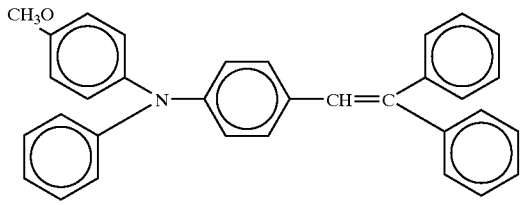

The thus prepared charge transport layer coating liquid was coated on the above obtained charge generation layer, and dried at 130° C. for 20 minutes, so that a charge transport layer with a thickness of 20 μm was provided on the charge generation layer.

Thus, an electrophotographic photoconductor No. 1 according to the present invention was obtained.

EXAMPLES 2 AND 3

The procedure for preparation of the electrophotographic photoconductor No. 1 in Example 1 was repeated except that the disazo pigment (I)-24 for use in the charge generation layer coating liquid A in Example 1 was replaced by disazo pigments (I)-29 and (I)-30 (shown in TABLE 1-(6)) respectively in Examples 2 and 3.

Thus, electrophotographic photoconductors Nos. 2 and 3 according to the present invention were obtained.

COMPARATIVE EXAMPLE 1

The procedure for preparation of the electrophotographic photoconductor No. 1 in Example 1 was repeated except that only the charge generation layer coating liquid B comprising the metal-free X-type phthalocyanine pigment was used as the charge generation layer coating liquid, not using the charge generation layer coating liquid A comprising the disazo pigment (I)-24.

Thus, a comparative electrophotographic photoconductor No. 1 was obtained.

COMPARATIVE EXAMPLE 2

The procedure for preparation of the electrophotographic photoconductor No. 1 in Example 1 was repeated except that only the charge generation layer coating liquid A comprising the disazo pigment (I)-24 was used as the charge generation layer coating liquid, not using the charge generation layer coating liquid B comprising the metal-free X-type phthalocyanine pigment.

Thus, a comparative electrophotographic photoconductor No. 2 was obtained.

COMPARATIVE EXAMPLE 3

The procedure for preparation of the electrophotographic photoconductor No. 2 in Example 2 was repeated except that only the charge generation layer coating liquid A comprising the disazo pigment (I)-29 was used as the charge generation layer coating liquid, not using the charge generation layer coating liquid B comprising the metal-free X-type phthalocyanine pigment.

Thus, a comparative electrophotographic photoconductor No. 3 was obtained.

COMPARATIVE EXAMPLE 4

The procedure for preparation of the electrophotographic photoconductor No. 3 in Example 3 was repeated except that only the charge generation layer coating liquid A comprising the disazo pigment (I)-30 was used as the charge generation layer coating liquid, not using the charge generation layer coating liquid B comprising the metal-free X-type phthalocyanine pigment.

Thus, a comparative electrophotographic photoconductor No. 4 was obtained.

The dynamic electrostatic properties of each of the electrophotographic photoconductors No. 1 to No. 3 according to the present invention and the comparative electrophotographic photoconductors No. 1 to No. 4 were measured by using a commercially available test apparatus (Trademark "EPA-8100", made by Kawaguchi Electro Works Co., Ltd.).

More specifically, each photoconductor was charged negatively in the dark under application of −6 kV by corona charge for 5 seconds. Then, each photoconductor was allowed to stand in the dark without applying any charge thereto. When the surface potential of the photoconductor reached −800 V, the photoconductor was illuminated by the light of 500 nm, 600 nm, 700 nm and 780 nm separated by use of a band pass filter. In each case, the exposure $E_{1/2}$ ($\mu J/cm^2$) required to reduce the surface potential to ½ the surface potential, that is, −400 V, was measured.

The results are shown in TABLE 2.

TABLE 2

| | Exposure $E_{1/2}$($\mu J/cm^2$) | | | |
|---|---|---|---|---|
| | 500 nm | 600 nm | 700 nm | 780 nm |
| Ex. 1 | 0.34 | 0.25 | 0.31 | 0.29 |
| Ex. 2 | 0.39 | 0.29 | 0.35 | 0.33 |
| Ex. 3 | 0.41 | 0.30 | 0.37 | 0.34 |
| Comp. Ex. 1 | 2.56 | 0.56 | 0.52 | 0.46 |
| Comp. Ex. 2 | 0.27 | 0.19 | 0.77 | * |
| Comp. Ex. 3 | 0.30 | 0.21 | 0.88 | * |
| Comp. Ex. 4 | 0.31 | 0.22 | 0.92 | * |

*Light decay did not take place.

EXAMPLE 4

[Formation of Intermediate Layer]

Three parts by weight of a commercially available alcohol-soluble polyamide (Trademark "CM-8000", made by Toray Industries, Inc.) was dissolved in 100 parts by weight of a mixed solvent of methanol and n-butanol with a volume ratio of 8:2 under the application of heat. Thus, a coating liquid for an intermediate layer was prepared.

The thus prepared intermediate layer coating liquid was coated on an aluminum plate (Trademark "A1080", made by Sumitomo Light Metal Industries, Ltd.) with a thickness of 0.2 mm, dried at 100° C. for 20 minutes, so that an intermediate layer with a thickness of 0.1 μm was formed on the electroconductive support.

[Formation of Charge Generation Layer]

Three parts by weight of a commercially available butyral resin (Trademark "XYHL", made by Union Carbide Japan K.K.) was dissolved in 150 parts by weight of cyclohexanone. A mixture of 3.0 parts by weight of a disazo pigment of formula (I)-24 (shown in TABLE 1-(5)) and 2.5 parts by weight of a metal-free X-type phthalocyanine pigment was added to the above prepared resin solution and dispersed in a ball mill for 120 hours. With the addition of 300 parts by weight of cyclohexanone, the dispersion was continued for further 3 hours. Thus, a coating liquid for a charge generation layer was prepared.

The charge generation layer coating liquid was coated on the previously obtained intermediate layer, and dried at 130° C. for 10 minutes, so that a charge generation layer with a thickness of 0.25 μm was provided on the intermediate layer.

[Formation of Charge Transport Layer]

Seven parts by weight of a charge transporting material of formula (b), 10 parts by weight of a polycarbonate resin (Trademark "Z-200", made by Mitsubishi Gas Chemical Company, Inc.), and 0.002 parts by weight of a silicone oil (Trademark "KF-50", made by Shin-Etsu Chemical Co., Ltd.) were dissolved in 85 parts by weight of tetrahydrofuran, so that a coating liquid for a charge transport layer was prepared.

(Charge Transporting Material)

(b)

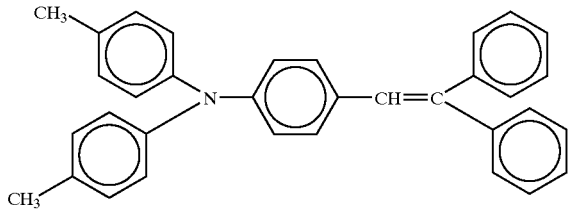

The thus prepared charge transport layer coating liquid was coated on the above obtained charge generation layer, and dried at 130° C. for 20 minutes, so that a charge transport layer with a thickness of 20 μm was provided on the charge generation layer.

Thus, an electrophotographic photoconductor No. 4 according to the present invention was obtained.

EXAMPLES 5 AND 6

The procedure for preparation of the electrophotographic photoconductor No. 4 in Example 4 was repeated except that the disazo pigment (I)-24 for use in the charge generation layer coating liquid in Example 4 was replaced by disazo pigments (I)-29 and (I)-30 (shown in TABLE 1-(6)) respectively in Examples 5 and 6.

Thus, electrophotographic photoconductors Nos. 5 and 6 according to the present invention were obtained.

EXAMPLE 7

[Formation of Intermediate Layer]

The same intermediate layer was provided on the same aluminum plate (Trademark "A1080", made by Sumitomo Light Metal Industries, Ltd.) as used in Example 4.

[Formation of Charge Generation Layer]

A mixture of 3.0 parts by weight of a disazo pigment of formula (I)-24 (shown in TABLE 1-(5)) and 2.5 parts by weight of a metal-free X-type phthalocyanine pigment was placed in a ball mill and subjected to dry milling for 4 hours. To the above obtained mixture, a resin solution prepared by dissolving 3 parts by weight of a commercially available butyral resin (Trademark "XYHL", made by Union Carbide Japan K.K.) in 150 parts by weight of cyclohexanone was added, and the mixture was dispersed in a ball mill for 72 hours. With the addition of 300 parts by weight of cyclohexanone, the dispersion was continued for further 3 hours. Thus, a coating liquid for a charge generation layer was prepared.

The charge generation layer coating liquid was coated on the previously obtained intermediate layer, and dried at 130° C. for 10 minutes, so that a charge generation layer with a thickness of 0.25 μm was provided on the intermediate layer.

[Formation of Charge Transport Layer]

The same charge transport layer as used in Example 4 was provided on the above prepared charge generation layer.

Thus, an electrophotographic photoconductor No. 5 according to the present invention was obtained.

COMPARATIVE EXAMPLE 5

The procedure for preparation of the electrophotographic photoconductor No. 4 in Example 4 was repeated except that the disazo pigment of formula (I)-24 for use in the charge generation layer coating liquid in Example 4 was replaced by a polycyclic quinone pigment of the following formula (c):

(c)

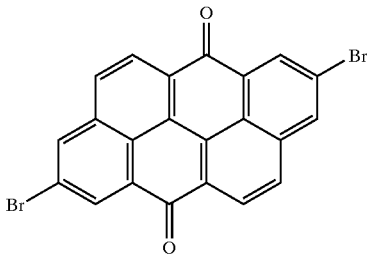

Thus, a comparative electrophotographic photoconductor No. 5 was obtained.

COMPARATIVE EXAMPLES 6 TO 8

The procedure for preparation of the electrophotographic photoconductor No. 4 in Example 4 was repeated except that the disazo pigment of formula (I)-24 for use in the charge generation layer coating liquid in Example 4 was replaced by disazo pigments of formulae (d), (e) and (f) respectively in Comparative Examples 6, 7 and 8:

(d)

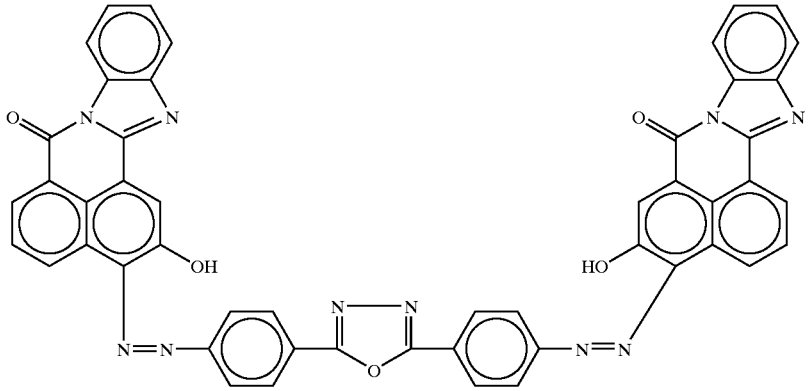

(e)

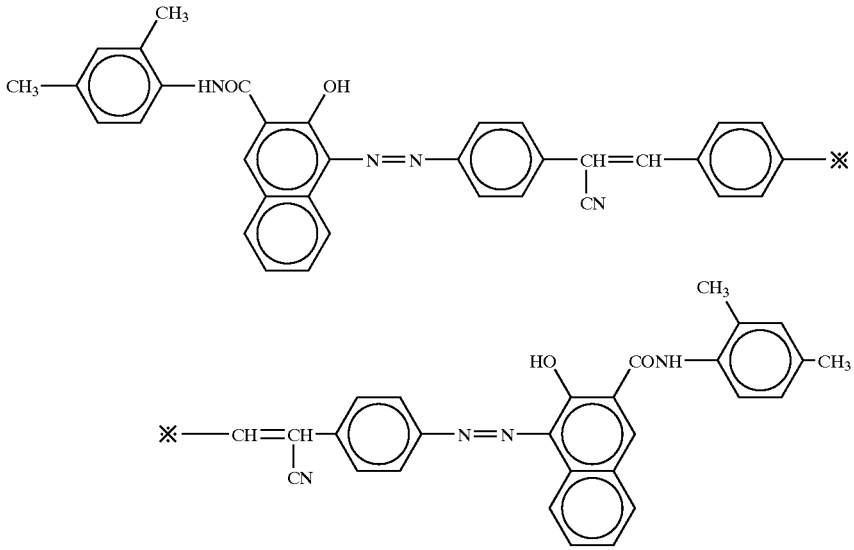

(f)

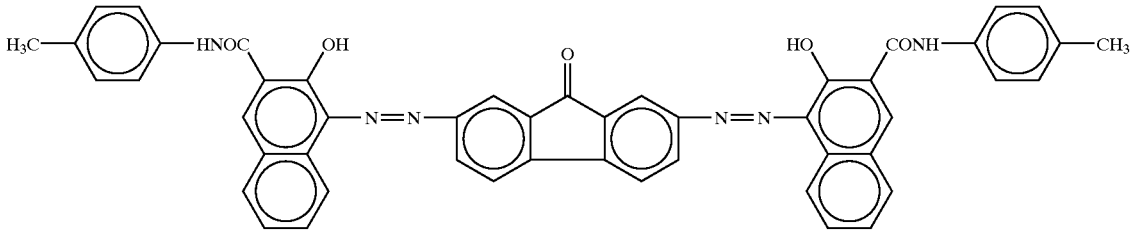

Thus, comparative electrophotographic photoconductors Nos. 6 to 8 were obtained.

The dynamic electrostatic properties of each of the electrophotographic photoconductors No. 4 to No. 7 according to the present invention and the comparative electrophotographic photoconductors No. 5 to No. 8 were evaluated in the same manner as in Example 1.

The results are shown in TABLE 3.

TABLE 3

| | Exposure $E_{1/2}$($\mu$J/cm$^2$) | | | |
|---|---|---|---|---|
| | 500 nm | 600 nm | 700 nm | 780 nm |
| Ex. 4 | 0.33 | 0.24 | 0.28 | 0.25 |
| Ex. 5 | 0.37 | 0.28 | 0.32 | 0.29 |

TABLE 3-continued

| | Exposure $E_{1/2}$($\mu$J/cm$^2$) | | | |
|---|---|---|---|---|
| | 500 nm | 600 nm | 700 nm | 780 nm |
| Ex. 6 | 0.39 | 0.29 | 0.32 | 0.30 |
| Ex. 7 | 0.33 | 0.23 | 0.28 | 0.25 |
| Comp. Ex. 5 | 0.40 | 0.58 | 0.55 | 0.50 |
| Comp. Ex. 6 | 0.57 | 0.66 | 0.57 | 0.52 |
| Comp. Ex. 7 | 0.67 | 0.55 | 0.54 | 0.50 |
| Comp. Ex. 8 | 0.59 | 0.54 | 0.54 | 0.50 |

EXAMPLES 8 TO 10

The procedure for preparation of each of the electrophotographic photoconductors Nos. 4, 5 and 6 in Examples 4, 5 and 6 was independently repeated except that the aluminum plate (Trademark "A1080", made by Sumitomo Light Metal Industries, Ltd.) used as the electroconductive support in each Example was replaced by an aluminum cylinder with a diameter of 80 mm.

Thus, electrophotographic photoconductors Nos. 8 to 10 according to the present invention were obtained.

COMPARATIVE EXAMPLES 9 TO 11

The procedure for preparation of each of the comparative electrophotographic photoconductors Nos. 5, 6 and 7 in Comparative Examples 5, 6 and 7 was independently repeated except that the aluminum plate (Trademark "A1080", made by Sumitomo Light Metal Industries, Ltd.) used as the electroconductive support in each Comparative Example was replaced by an aluminum cylinder with a diameter of 80 mm.

Thus, comparative electrophotographic photoconductors Nos. 9 to 11 were obtained.

To evaluate the electrophotographic properties, each of the electrophotographic photoconductors Nos. 8 to 10 according to the present invention and the comparative electrophotographic photoconductors Nos. 9 to 11 was placed in a commercially available digital copying machine (Trademark "IMAGIO MF530", made by Ricoh Company, Ltd.) employing as a quenching light source a halogen lamp emitting the light of less than 650 nm.

The voltage applied to the photoconductor in the charging process, the light quantity of a laser beam with a wavelength of 780 nm employed in the exposure process, and the light quantity of the halogen lamp in the quenching process were respectively controlled in such a manner that the surface potential (Vd) of the photoconductor reached about −850 V by charging, the surface potential (Vl) of the photoconductor reached about −130 V after exposure, and the surface potential (Vr) of the photoconductor reached about −50 V after quenching. The surface potentials (Vd), (Vl) and (Vr) of each photoconductor were measured at the initial stage and after continuously making 2,000 copies.

The results are shown in TABLE 4.

TABLE 4

| | Initial Stage | | | After making 2,000 copies | | |
|---|---|---|---|---|---|---|
| | Vd(−V) | Vl(−V) | Vr(−V) | Vd(−V) | Vl(−V) | Vr(−V) |
| Ex. 8 | 850 | 130 | 50 | 830 | 125 | 45 |
| Ex. 9 | 850 | 130 | 55 | 835 | 125 | 45 |
| Ex. 10 | 855 | 135 | 50 | 835 | 130 | 40 |
| Comp. Ex. 9 | 855 | 135 | 50 | 825 | 170 | 65 |
| Comp. Ex. 10 | 850 | 130 | 50 | 780 | 140 | 60 |
| Comp. Ex. 11 | 845 | 135 | 45 | 785 | 140 | 50 |

EXAMPLE 11

[Formation of Intermediate Layer]

Three parts by weight of a commercially available alcohol-soluble polyamide (Trademark "CM-8000", made by Toray Industries, Inc.) was dissolved in 100 parts by weight of a mixed solvent of methanol and n-butanol with a volume ratio of 8:2 under the application of heat. Thus, a coating liquid for an intermediate layer was prepared.

The thus prepared intermediate layer coating liquid was coated on an aluminum-deposited surface of an aluminum-deposited polyethylene terephthalate (PET) film with a thickness of 75 μm, dried at 100° C. for 20 minutes, so that an intermediate layer with a thickness of 0.1 μm was formed on the electroconductive support.

[Formation of Photoconductive Layer]

One part by weight of a metal-free X-type phthalocyanine pigment, 1 part by weight of a disazo pigment of formula (I)-24 (shown in TABLE 1-(5)), and 100 parts by weight of tetrahydrofuran were dispersed in a sand mill for 2 hours. The thus obtained dispersion was mixed with a solution obtained by dissolving 7 parts by weight of a charge transporting material of formula (a) and 10 parts by weight of a polycarbonate resin (Trademark "Z-200", made by Mitsubishi Gas Chemical Company, Inc.) in 100 parts by weight of tetrahydrofuran. Thus, a coating liquid for a photoconductive layer was prepared.

(Charge Transporting Material)

(a)

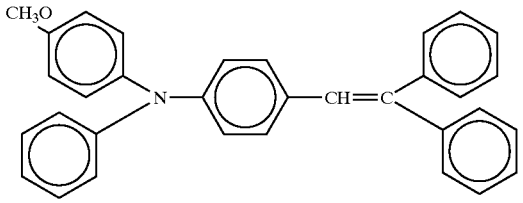

The photoconductive layer coating liquid was coated on the previously obtained intermediate layer, and dried at 130° C. for 15 minutes, so that a photoconductive layer with a thickness of 20 μm was provided on the intermediate layer.

Thus, an electrophotographic photoconductor No. 11 according to the present invention was obtained.

EXAMPLES 12 AND 13

The procedure for preparation of the electrophotographic photoconductor No. 11 in Example 11 was repeated except that the disazo pigment (I)-24 for use in the photoconductive layer coating liquid in Example 11 was replaced by disazo pigments (I)-29 and (I)-30 (shown in TABLE 1-(6)) respectively in Examples 12 and 13.

Thus, electrophotographic photoconductors Nos. 12 and 13 according to the present invention were obtained.

COMPARATIVE EXAMPLES 12 AND 13

The procedure for preparation of the electrophotographic photoconductor No. 11 in Example 11 was repeated except that the disazo pigment (I)-24 for use in the photoconductive layer coating liquid in Example 11 was replaced by disazo pigments of formulae (d) and (e) respectively in Comparative Examples 12 and 13.

(d)

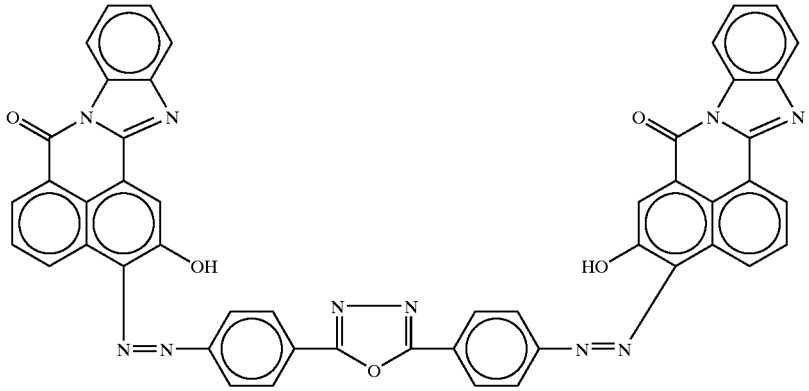

(e)

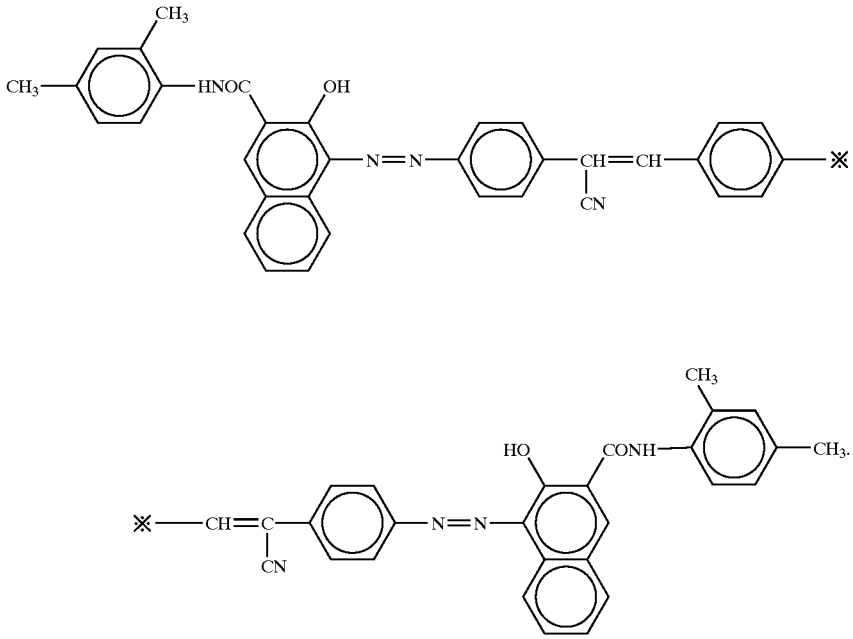

Thus, comparative electrophotographic photoconductors Nos. 12 and 13 were obtained.

The dynamic electrostatic properties of each of the electrophotographic photoconductors No. 11 to No. 13 according to the present invention and the comparative electrophotographic photoconductors No. 12 and No. 13 were measured by using a commercially available test apparatus (Trademark "EPA-8100", made by Kawaguchi Electro Works Co., Ltd.).

More specifically, each photoconductor was charged positively in the dark under application of +7 kV by corona charge for 5 seconds. Then, each photoconductor was allowed to stand in the dark without applying any charge thereto. When the surface potential of the photoconductor reached +800 V, the photoconductor was illuminated by the light of 500 nm, 600 nm, 700 nm and 780 nm separated by use of a band pass filter. In each case, the exposure $E_{1/2}$ ($\mu J/cm^2$) required to reduce the surface potential to ½ the surface potential, that is, +400 V, was measured.

The results are shown in TABLE 5.

TABLE 5

| | Exposure $E_{1/2}$($\mu J/cm^2$) | | | |
|---|---|---|---|---|
| | 500 nm | 600 nm | 700 nm | 780 nm |
| Ex. 11 | 0.36 | 0.34 | 0.34 | 0.30 |
| Ex. 12 | 0.42 | 0.38 | 0.39 | 0.35 |
| Ex. 13 | 0.43 | 0.39 | 0.39 | 0.36 |
| Comp. Ex. 12 | 0.71 | 0.63 | 0.60 | 0.60 |
| Comp. Ex. 13 | 0.85 | 0.85 | 0.62 | 0.60 |

EXAMPLES 14

[Formation of Intermediate Layer]

Three parts by weight of a commercially available alcohol-soluble polyamide (Trademark "CM-8000", made by Toray Industries, Inc.) was dissolved in 100 parts by weight of a mixed solvent of methanol and n-butanol with a volume ratio of 8:2 under the application of heat. Thus, a coating liquid for an intermediate layer was prepared.

The thus prepared intermediate layer coating liquid was coated on an aluminum plate (Trademark "A1080", made by Sumitomo Light Metal Industries, Ltd.) with a thickness of 0.2 mm, dried at 100° C. for 20 minutes, so that an intermediate layer with a thickness of 0.1 μm was formed on the electroconductive support.

[Formation of Charge Generation Layer]

Three parts by weight of a commercially available butyral resin (Trademark "S-Lec BL-1", made by Sekisui Chemical Co., Ltd.) was dissolved in 150 parts by weight of cyclohexanone. Six parts by weight of a disazo pigment of formula (I)-24 (shown in TABLE 1-(5)) was added to the above prepared resin solution and dispersed in a ball mill for 120 hours. With the addition of 300 parts by weight of cyclohexanone, the dispersion was continued for further 3 hours. Thus, a charge generation layer coating liquid A comprising a disazo pigment was prepared.

Three parts by weight of a commercially available butyral resin (Trademark "S-Lec BL-1", made by Sekisui Chemical Co., Ltd.) was dissolved in 150 parts by weight of cyclohexanone. Six parts by weight of a commercially available metal-free τ-type phthalocyanine pigment, made by Toyo Ink Mfg. Co., Ltd., was added to the above prepared resin solution and dispersed using ultrasonic wave for 5 hours. With the addition of 300 parts by weight of cyclohexanone, the dispersion was continued for further one hour. Thus, a charge generation layer coating liquid B comprising a metal-free τ-type phthalocyanine pigment was prepared.

The previously obtained charge generation layer coating liquids A and B in the equal amount were mixed with stirring, so that a coating liquid for the charge generation layer was prepared.

The charge generation layer coating liquid was coated on the previously obtained intermediate layer, and dried at 130° C. for 10 minutes, so that a charge generation layer with a thickness of 0.25 μm was provided on the intermediate layer.

[Formation of Charge Transport Layer]

Eight parts by weight of a charge transporting material of formula (g), 10 parts by weight of a polycarbonate resin (Trademark "Z-200", made by Mitsubishi Gas Chemical Company, Inc.), and 0.002 parts by weight of a silicone oil (Trademark "KF-50", made by Shin-Etsu Chemical Co., Ltd.) were dissolved in 85 parts by weight of tetrahydrofuran, so that a coating liquid for a charge transport layer was prepared.

(Charge Transporting Material)

(g)

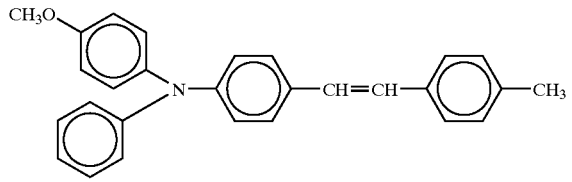

The thus prepared charge transport layer coating liquid was coated on the above obtained charge generation layer, and dried at 130° C. for 20 minutes, so that a charge transport layer with a thickness of 20 μm was provided on the charge generation layer.

Thus, an electrophotographic photoconductor No. 14 according to the present invention was obtained.

EXAMPLES 15 AND 16

The procedure for preparation of the electrophotographic photoconductor No. 14 in Example 14 was repeated except that the disazo pigment (I)-24 for use in the charge generation layer coating liquid A in Example 14 was replaced by disazo pigments (I)-29 and (I)-30 (shown in TABLE 1-(6)) respectively in Examples 15 and 16.

Thus, electrophotographic photoconductors Nos. 15 and 16 according to the present invention were obtained.

COMPARATIVE EXAMPLE 14

The procedure for preparation of the electrophotographic photoconductor No. 14 in Example 14 was repeated except that only the charge generation layer coating liquid B comprising the metal-free τ-type phthalocyanine pigment was used as the charge generation layer coating liquid, not using the charge generation layer coating liquid A comprising the disazo pigment (I)-24.

Thus, a comparative electrophotographic photoconductor No. 14 was obtained.

COMPARATIVE EXAMPLE 15

The procedure for preparation of the electrophotographic photoconductor No. 14 in Example 14 was repeated except that only the charge generation layer coating liquid A comprising the disazo pigment (I)-24 was used as the charge generation layer coating liquid, not using the charge generation layer coating liquid B comprising the metal-free τ-type phthalocyanine pigment.

Thus, a comparative electrophotographic photoconductor No. 15 was obtained.

COMPARATIVE EXAMPLE 16

The procedure for preparation of the electrophotographic photoconductor No. 15 in Example 15 was repeated except that only the charge generation layer coating liquid A comprising the disazo pigment (I)-29 was used as the charge generation layer coating liquid, not using the charge generation layer coating liquid B comprising the metal-free τ-type phthalocyanine pigment.

Thus, a comparative electrophotographic photoconductor No. 16 was obtained.

COMPARATIVE EXAMPLE 17

The procedure for preparation of the electrophotographic photoconductor No. 16 in Example 16 was repeated except that only the charge generation layer coating liquid A comprising the disazo pigment (I)-30 was used as the charge generation layer coating liquid, not using the charge generation layer coating liquid B comprising the metal-free τ-type phthalocyanine pigment.

Thus, a comparative electrophotographic photoconductor No. 17 was obtained.

The dynamic electrostatic properties of each of the electrophotographic photoconductors No. 14 to No. 16 according to the present invention and the comparative electrophotographic photoconductors No. 14 to No. 17 were evaluated in the same manner as in Example 1.

The results are shown in TABLE 6.

TABLE 6

| | Exposure $E_{1/2}$ ($\mu$J/cm$^2$) | | | |
|---|---|---|---|---|
| | 500 nm | 600 nm | 700 nm | 780 nm |
| Ex. 14 | 0.34 | 0.24 | 0.31 | 0.29 |
| Ex. 15 | 0.39 | 0.30 | 0.35 | 0.34 |
| Ex. 16 | 0.40 | 0.30 | 0.37 | 0.34 |
| Comp. Ex. 14 | 2.53 | 0.54 | 0.51 | 0.45 |
| Comp. Ex. 15 | 0.27 | 0.19 | 0.75 | * |
| Comp. Ex. 16 | 0.30 | 0.22 | 0.86 | * |
| Comp. Ex. 17 | 0.30 | 0.22 | 0.90 | * |

*Light decay did not take place.

EXAMPLE 17

[Formation of Intermediate Layer]

The same intermediate layer was provided on the same aluminum plate (Trademark "A1080", made by Sumitomo Light Metal Industries, Ltd.) as used in Example 14.

[Formation of Charge Generation Layer]

Three parts by weight of a commercially available butyral resin (Trademark "S-Lec BL-1", made by Sekisui Chemical Co., Ltd.) was dissolved in 150 parts by weight of cyclohexanone. A mixture of 3.5 parts by weight of a disazo pigment of formula (I)-24 (shown in TABLE 1-(5)) and 3.0 parts by weight of a metal-free τ-type phthalocyanine pigment was added to the above prepared resin solution and dispersed in a ball mill for 120 hours. With the addition of 300 parts by weight of cyclohexanone, the dispersion was continued for further 3 hours. Thus, a coating liquid for a charge generation layer was prepared.

The charge generation layer coating liquid was coated on the previously obtained intermediate layer, and dried at 130° C. for 10 minutes, so that a charge generation layer with a thickness of 0.25 $\mu$m was provided on the intermediate layer.

[Formation of Charge Transport Layer]

Eight parts by weight of a charge transporting material of formula (h), 10 parts by weight of a polycarbonate resin (Trademark "Z-200", made by Mitsubishi Gas Chemical Company, Inc.), and 0.002 parts by weight of a silicone oil (Trademark "KF-50", made by Shin-Etsu Chemical Co., Ltd.) were dissolved in 85 parts by weight of tetrahydrofuran, so that a coating liquid for a charge transport layer was prepared.

(Charge Transporting Material)

(h)

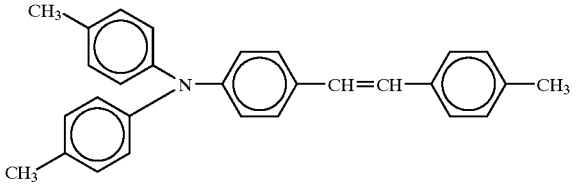

The thus prepared charge transport layer coating liquid was coated on the above obtained charge generation layer, and dried at 130° C. for 20 minutes, so that a charge transport layer with a thickness of 20 $\mu$m was provided on the charge generation layer.

Thus, an electrophotographic photoconductor No. 17 according to the present invention was obtained.

EXAMPLES 18 AND 19

The procedure for preparation of the electrophotographic photoconductor No. 17 in Example 17 was repeated except that the disazo pigment (I)-24 for use in the charge generation layer coating liquid in Example 17 was replaced by disazo pigments (I)-29 and (I)-30 (shown in TABLE 1-(6)) respectively in Examples 18 and 19.

Thus, electrophotographic photoconductors Nos. 18 and 19 according to the present invention were obtained.

EXAMPLE 20

[Formation of Intermediate Layer]

The same intermediate layer was provided on the same aluminum plate (Trademark "A1080", made by Sumitomo Light Metal Industries, Ltd.) as used in Example 17.

[Formation of Charge Generation Layer]

A mixture of 3.5 parts by weight of a disazo pigment of formula (I)-24 (shown in TABLE 1-(5)) and 3.5 parts by weight of a metal-free τ-type phthalocyanine pigment was placed in a ball mill and subjected to dry milling for 4 hours. To the above obtained mixture, a resin solution prepared by dissolving 3 parts by weight of a commercially available butyral resin (Trademark "S-Lec BL-1", made by Sekisui Chemical Co., Ltd.) in 150 parts by weight of cyclohexanone was added, and the mixture was dispersed in a ball mill for 72 hours. With the addition of 300 parts by weight of cyclohexanone, the dispersion was continued for further 3 hours. Thus, a coating liquid for a charge generation layer was prepared.

The charge generation layer coating liquid was coated on the previously obtained intermediate layer, and dried at 130° C. for 10 minutes, so that a charge generation layer with a thickness of 0.25 $\mu$m was provided on the intermediate layer.

[Formation of Charge Transport Layer]

The same charge transport layer as used in Example 17 was provided on the above prepared charge generation layer.

Thus, an electrophotographic photoconductor No. 20 according to the present invention was obtained.

COMPARATIVE EXAMPLE 18

The procedure for preparation of the electrophotographic photoconductor No. 17 in Example 17 was repeated except that the disazo pigment of formula (I)-24 for use in the charge generation layer coating liquid in Example 17 was replaced by a polycyclic quinone pigment of the following formula (c):

(c)

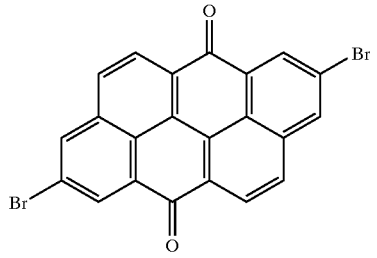

Thus, a comparative electrophotographic photoconductor No. 18 was obtained.

COMPARATIVE EXAMPLES 19 TO 21

The procedure for preparation of the electrophotographic photoconductor No. 17 in Example 17 was repeated except that the disazo pigment of formula (I)-24 for use in the charge generation layer coating liquid in Example 17 was replaced by disazo pigments of formulae (d), (e) and (f) respectively in Comparative Examples 19, 20 and 21:

(d)

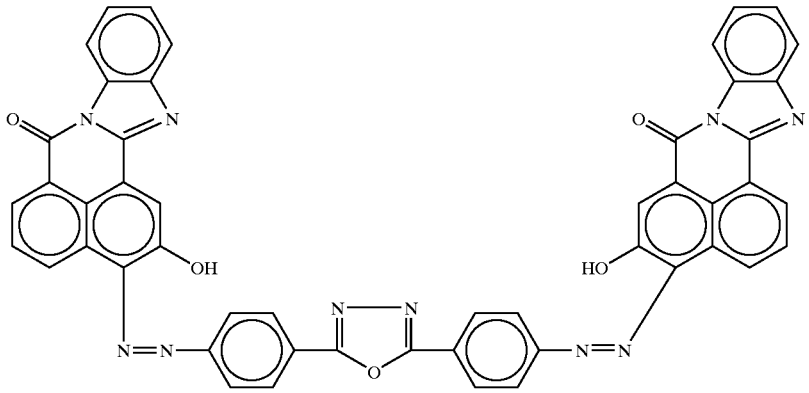

(e)

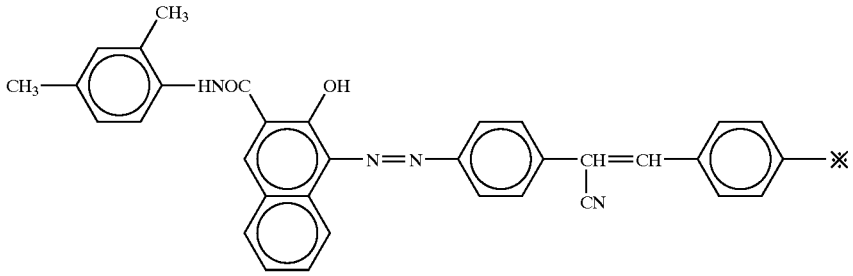

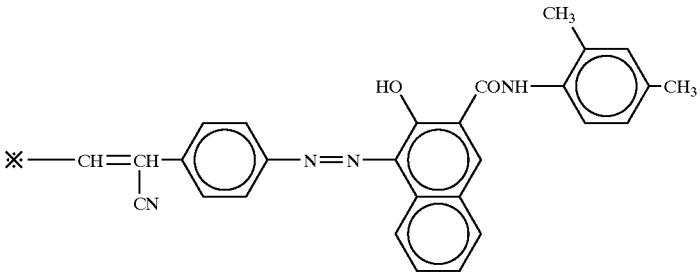

(f)

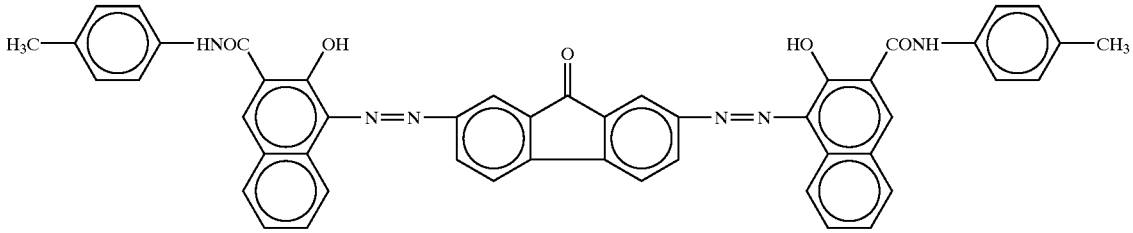

Thus, comparative electrophotographic photoconductors Nos. 19 to 21 were obtained.

The dynamic electrostatic properties of each of the electrophotographic photoconductors No. 17 to No. 20 according to the present invention and the comparative electrophotographic photoconductors No. 18 to No. 21 were evaluated in the same manner as in Example 1.

The results are shown in TABLE 7.

TABLE 7

| | Exposure $E_{1/2}$ ($\mu$J/cm$^2$) | | | |
|---|---|---|---|---|
| | 500 nm | 600 nm | 700 nm | 780 nm |
| Ex. 17 | 0.35 | 0.26 | 0.29 | 0.25 |
| Ex. 18 | 0.37 | 0.29 | 0.36 | 0.30 |
| Ex. 19 | 0.40 | 0.30 | 0.35 | 0.32 |
| Ex. 20 | 0.34 | 0.26 | 0.29 | 0.25 |
| Comp. Ex. 18 | 0.42 | 0.60 | 0.58 | 0.53 |
| Comp. Ex. 19 | 0.58 | 0.66 | 0.58 | 0.54 |
| Comp. Ex. 20 | 0.68 | 0.57 | 0.56 | 0.51 |
| Comp. Ex. 21 | 0.60 | 0.54 | 0.55 | 0.51 |

EXAMPLES 21 TO 23

The procedure for preparation of each of the electrophotographic photoconductors Nos. 17, 18 and 19 in Examples 17, 18 and 19 was independently repeated except that the aluminum plate (Trademark "A1080", made by Sumitomo Light Metal Industries, Ltd.) used as the electroconductive support in each Example was replaced by an aluminum cylinder with a diameter of 80 mm.

Thus, electrophotographic photoconductors Nos. 21 to 23 according to the present invention were obtained.

COMPARATIVE EXAMPLES 22 TO 24

The procedure for preparation of each of the comparative electrophotographic photoconductors Nos. 18, 19 and 20 in Comparative Examples 18, 19 and 20 was independently repeated except that the aluminum plate (Trademark "A1080", made by Sumitomo Light Metal Industries, Ltd.) used as the electroconductive support in each Comparative Example was replaced by an aluminum cylinder with a diameter of 80 mm.

Thus, comparative electrophotographic photoconductors Nos. 22 to 24 were obtained.

To evaluate the electrophotographic properties, each of the electrophotographic photoconductors Nos. 21 to 23 according to the present invention and the comparative electrophotographic photoconductors Nos. 22 to 24 was placed in a commercially available digital copying machine (Trademark "IMAGIO MF530", made by Ricoh Company, Ltd.) employing as a quenching light source a halogen lamp emitting the light of less than 650 nm.

The voltage applied to the photoconductor in the charging process, the light quantity of a laser beam with a wavelength of 780 nm employed in the exposure process, and the light quantity of the halogen lamp in the quenching process were respectively controlled in such a manner that the surface potential (Vd) of the photoconductor reached about −850 V by charging, the surface potential (Vl) of the photoconductor reached about −130 V after exposure, and the surface potential (Vr) of the photoconductor reached about −50 V after quenching. The surface potentials (Vd), (Vl) and (Vr) of each photoconductor were measured at the initial stage and after continuously making 2,000 copies.

The results are shown in TABLE 8.

TABLE 8

| | Initial Stage | | | After making 2,000 copies | | |
|---|---|---|---|---|---|---|
| | Vd(−V) | Vl(−V) | Vr(−V) | Vd(−V) | Vl(−V) | Vr(−V) |
| Ex. 21 | 850 | 130 | 50 | 830 | 135 | 55 |
| Ex. 22 | 850 | 130 | 55 | 835 | 135 | 60 |
| Ex. 23 | 850 | 135 | 50 | 830 | 140 | 60 |
| Comp. Ex. 22 | 855 | 130 | 50 | 825 | 190 | 85 |
| Comp. Ex. 23 | 845 | 135 | 50 | 790 | 160 | 70 |
| Comp. Ex. 24 | 845 | 130 | 45 | 770 | 120 | 45 |

EXAMPLE 24

[Formation of Intermediate Layer]

Three parts by weight of a commercially available alcohol-soluble polyamide (Trademark "CM-8000", made by Toray Industries, Inc.) was dissolved in 100 parts by weight of a mixed solvent of methanol and n-butanol with a volume ratio of 8:2 under the application of heat. Thus, a coating liquid for an intermediate layer was prepared.

The thus prepared intermediate layer coating liquid was coated on an aluminum-deposited surface of an aluminum-deposited polyethylene terephthalate (PET) film with a thickness of 75 $\mu$m, dried at 100° C. for 20 minutes, so that an intermediate layer with a thickness of 0.1 $\mu$m was formed on the electroconductive support.

[Formation of Photoconductive Layer]

One part by weight of a metal-free τ-type phthalocyanine pigment, 1 part by weight of a disazo pigment of formula (I)-24 (shown in TABLE 1-(5)), and 100 parts by weight of tetrahydrofuran were dispersed in a sand mill for 2 hours. The thus obtained dispersion was mixed with a solution obtained by dissolving 7 parts by weight of a charge transporting material of formula (g) and 10 parts by weight of a polycarbonate resin (Trademark "Z-200", made by Mitsubishi G as Chemical Company, Inc.) in 100 parts by weight of tetrahydrofuran. Thus, a coating liquid for a photoconductive layer was prepared.

(Charge Transporting Material)

(g)

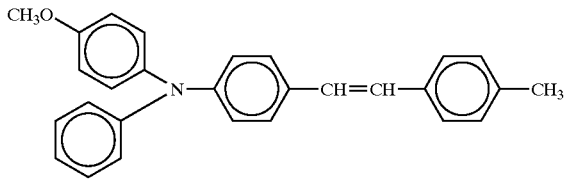

The photoconductive layer coating liquid was coated on the previously obtained intermediate layer, and dried at 130° C. for 15 minutes, so that a photoconductive layer with a thickness of 20 $\mu$m was provided on the intermediate layer.

Thus, an electrophotographic photoconductor No. 24 according to the present invention was obtained.

EXAMPLES 25 AND 26

The procedure for preparation of the electrophotographic photoconductor No. 24 in Example 24 was repeated except that the disazo pigment (I)-24 for use in the photoconductive layer coating liquid in Example 24 was replaced by disazo pigments (I)-29 and (I)-30 (shown in TABLE 1-(6)) respectively in Examples 25 and 26.

Thus, electrophotographic photoconductors Nos. 25 and 26 according to the present invention were obtained.

COMPARATIVE EXAMPLES 25 AND 26

The procedure for preparation of the electrophotographic photoconductor No. 24 in Example 24 was repeated except that the disazo pigment (I)-24 for use in the photoconductive layer coating liquid in Example 24 was replaced by disazo pigments of formulae (d) and (e) respectively in Comparative Examples 25 and 26.

(d)

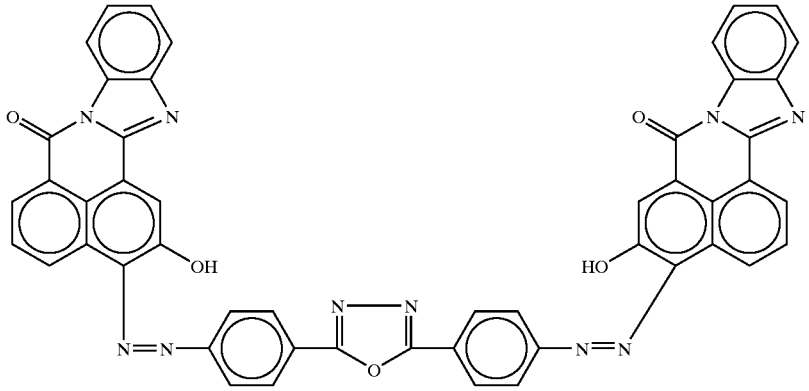

(e)

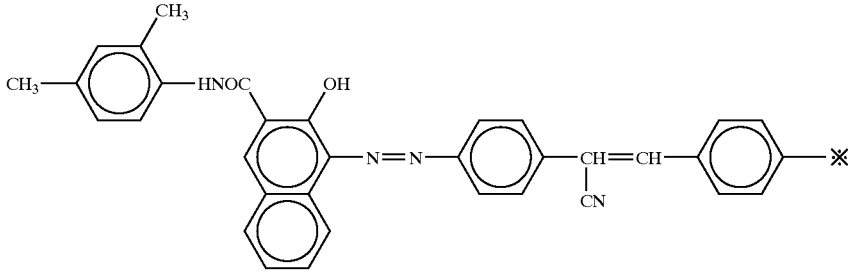

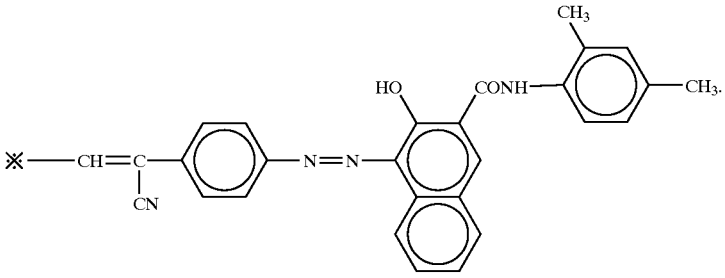

Thus, comparative electrophotographic photoconductors Nos. 25 and 26 were obtained.

The dynamic electrostatic properties of each of the electrophotographic photoconductors No. 24 to No. 26 according to the present invention and the comparative electrophotographic photoconductors No. 25 and No. 26 were measured by using a commercially available test apparatus (Trademark "EPA-8100", made by Kawaguchi Electro Works Co., Ltd.).

More specifically, each photoconductor was charged positively in the dark under application of +7 kV by corona charge for 5 seconds. Then, each photoconductor was allowed to stand in the dark without applying any charge thereto. When the surface potential of the photoconductor reached +800 V, the photoconductor was illuminated by the light of 500 nm, 600 nm, 700 nm and 780 nm separated by use of a band pass filter. In each case, the exposure $E_{1/2}$ ($\mu J/cm^2$) required to reduce the surface potential to ½ the surface potential, that is, +400 V, was measured.

The results are shown in TABLE 9.

TABLE 9

| | Exposure $E_{1/2}$ ($\mu J/cm^2$) | | | |
|---|---|---|---|---|
| | 500 nm | 600 nm | 700 nm | 780 nm |
| Ex. 24 | 0.35 | 0.34 | 0.34 | 0.31 |
| Ex. 25 | 0.42 | 0.39 | 0.40 | 0.35 |
| Ex. 26 | 0.43 | 0.40 | 0.39 | 0.36 |
| Comp. Ex. 25 | 0.73 | 0.63 | 0.60 | 0.61 |
| Comp. Ex. 26 | 0.85 | 0.85 | 0.62 | 0.61 |

SYNTHESIS EXAMPLE 1

[Synthesis of Titanyl Phthalocyanine Pigment]

52.5 g (0.41 mol) of phthalodinitrile and 300 ml of 1-chloronaphthalene were mixed with stirring. 19.0 g (0.10 mol) of titanium tetrachloride was added dropwise to the above mixture in a stream of nitrogen. After the completion of addition, the mixture was gradually heated to 200° C. and the reaction was carried out with stirring for 5 hours, with the reaction temperature being maintained within the range of 190 to 210° C.

After the completion of the reaction, the reaction mixture was allowed to stand at room temperature until the temperature of the reaction mixture decreased to 130° C. Then, the reaction mixture was filtered, and the resulting solid particles were washed with 1-chloronaphthalene until the solid particles assumed a blue color. Subsequently, the particles were washed with methanol several times, and with hot water of 80° C. several times, and then dried, so that 42.2 g of a crude titanyl phthalocyanine pigment was obtained in a 73.3% yield.

40 ml of N-methylpyrrolidone was added to 4 g of the above obtained crude titanyl phthalocyanine pigment to wash by suspension at 140 to 145° C. for 2 hours. This step was repeated twice. After the process of filtration and drying, 3.52 g of a blue titanyl phthalocyanine pigment for use in the present invention was obtained.

SYNTHESIS EXAMPLE 2

[Synthesis of Titanyl Phthalocyanine Pigment]

The crude titanyl phthalocyanine pigment was prepared in the same manner as in Synthesis Example 1.

6 g of the crude titanyl phthalocyanine pigment was dissolved in 100 g of a 96% sulfuric acid with stirring at a temperature of 3 to 5° C., and this solution was filtered. A sulfuric acid solution obtained by filtration was added dropwise to 3.5 l of ice water with stirring. The separating crystals were obtained by filtration, and repeatedly washed with a cleaning fluid until the cleaning fluid became neutral. Thus, a wet cake of the titanyl phthalocyanine pigment was obtained.

100 ml of 1,2-dichloroethane was added to the wet cake of the phthalocyanine pigment, and the mixture was stirred at room temperature for 2 hours. With the addition of 300 ml of methanol, the mixture was further stirred and filtered. The residue was washed with methanol, and dried, so that 4.9 g of titanyl phthalocyanine pigment for use in the present invention was obtained.

The X-ray diffraction spectrum of each of the titanyl phthalocyanine pigments obtained in Synthesis Examples 1 and 2 was measured under the following conditions:

X-ray tube: Cu

Applied voltage: 40 kV

Applied current: 20 mA

Scanning speed: 1°/min.

Scanning range: 3 to 35°

Time constant: 2 sec.

Figure 6:
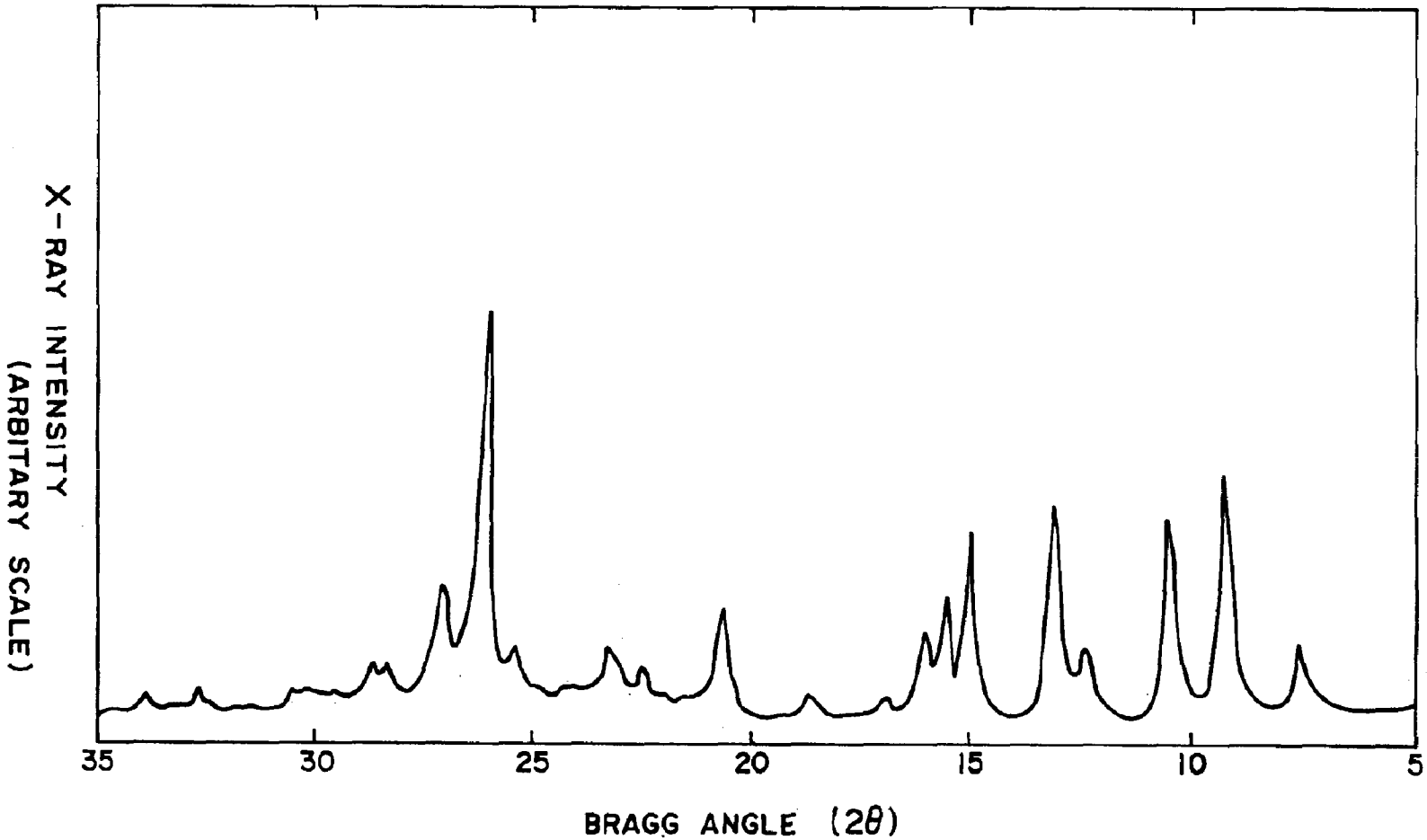
FIG. 6 is a X-ray diffraction spectrum of a titanyl phthalocyanine pigment obtained in Synthesis Example 1.
Figure 7:
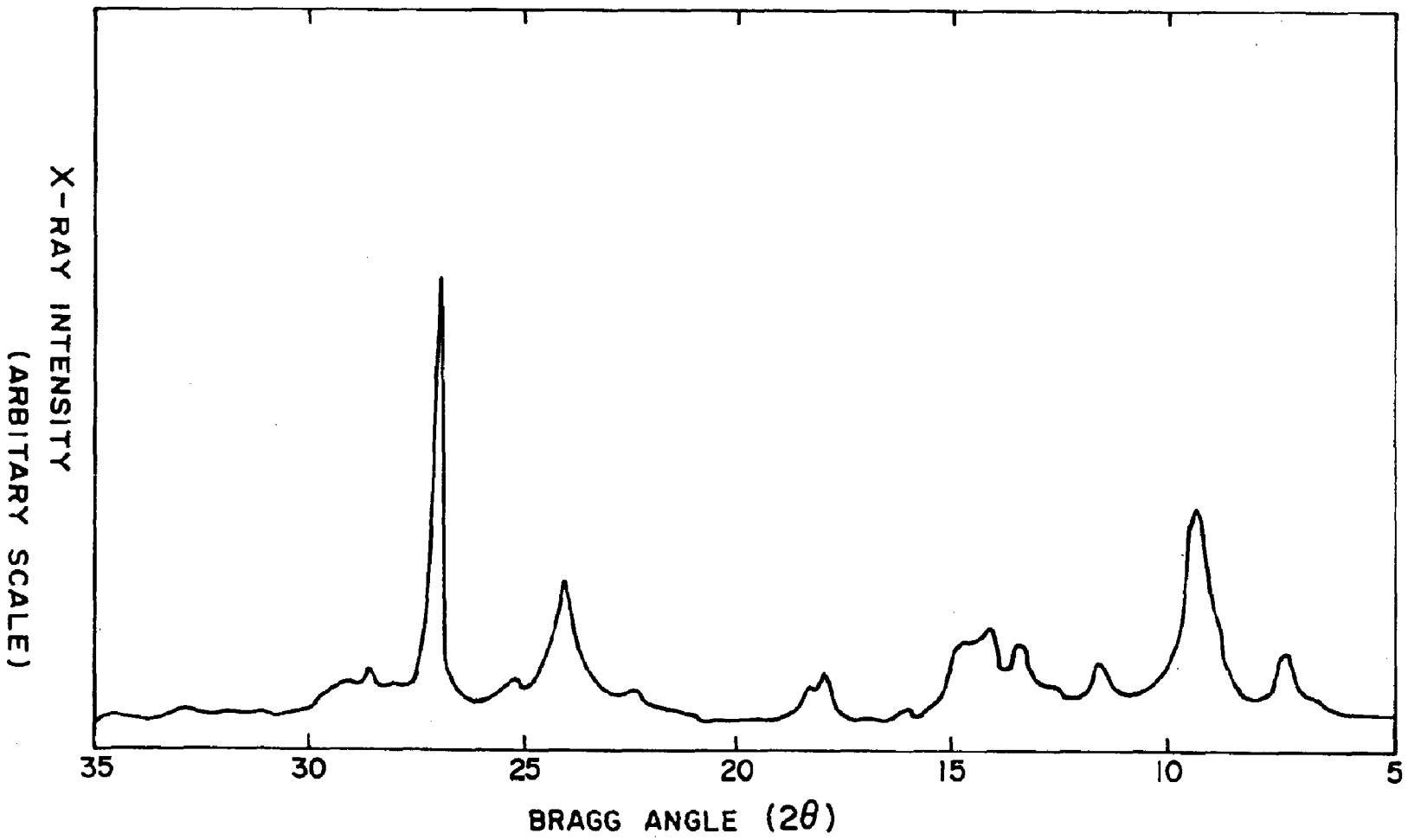
FIG. 7 is a X-ray diffraction spectrum of a titanyl phthalocyanine pigment obtained in Synthesis Example 2.

The X-ray diffraction spectrum of the titanyl phthalocyanine pigment obtained in Synthesis Example 1 is shown in FIG. 6; and that of the titanyl phthalocyanine pigment obtained in Synthesis Example 2, in FIG. 7.

As is apparent from the-graph shown in FIG. 7, there are main peaks of Bragg angle of 2θ at 9.5° and 27.2° in the X-ray diffraction spectrum.

SYNTHESIS EXAMPLE 3

[Synthesis of Titanyl Phthalocyanine Pigment]

The crude titanyl phthalocyanine pigment was prepared in the same manner as in Synthesis Example 1.

6 g of the crude titanyl phthalocyanine pigment was dissolved in 100 g of a 96% sulfuric acid with stirring at a temperature of 3 to 5° C., and this solution was filtered. A sulfuric acid solution obtained by filtration was added dropwise to 3.5 l of ice water with stirring. The separating crystals were obtained by filtration, and repeatedly washed with a cleaning fluid until the cleaning fluid became neutral, and then dried.

Thus, 5.8 g of a wet cake of a titanyl phthalocyanine pigment was obtained.

100 ml of methanol was added to 4.0 g of the above obtained wet cake of the titanyl phthalocyanine pigment, and the thus obtained suspension was stirred at 30° C. for 5 hours. After that, the mixture was filtered and dried, so that 3.6 g of titanyl phthalocyanine pigment was obtained.

With the addition of 70 ml of n-butyl ether, 3.6 g of the above obtained titanyl phthalocyanine pigment and glass beads with a diameter of 1 mm were subjected to milling process at room temperature for 24 hours. After the completion of milling process, the glass beads were removed from the dispersion, and the dispersion was filtered. The residue was washed with methanol, and then dried. Thus, 3.4 g of titanyl phthalocyanine pigment for use in the present invention was obtained.

The X-ray diffraction spectrum of the titanyl phthalocyanine pigments obtained in Synthesis Example 3 was measured under the same conditions as previously described.

Figure 8:
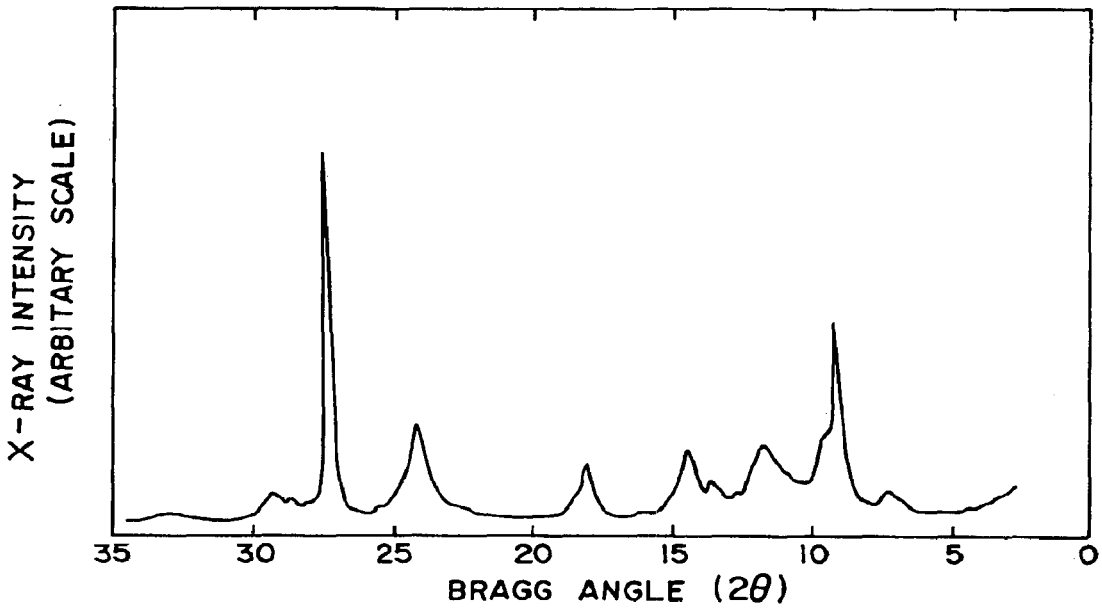
FIG. 8 is a X-ray diffraction spectrum of a titanyl phthalocyanine pigment obtained in Synthesis Example 3.

The X-ray diffraction spectrum of the titanyl phthalocyanine pigment obtained in Synthesis Example 3 is shown in FIG. 8.

As is apparent from the graph shown in FIG. 8, there are main peaks of Bragg angle of 2θ at 9.0° and 27.2° in the X-ray diffraction spectrum.

SYNTHESIS EXAMPLE 4

35.0 g of 1,3-diiminoisoindoline was mixed with 240 ml of α-chloronaphthalene, and 24.5 g of titanium butoxide was added dropwise to the above mixture in a stream of nitrogen. The mixture was heated at 140 to 150° C. for 2 hours, and further heated at 180° C. for 3 hours to carry out the reaction in a stream of nitrogen.

After the reaction mixture was allowed to stand at room temperature, the separating reaction product was obtained by filtration. Then, the reaction product was washed with α-chloronaphthalene, and thoroughly washed with dimethylformamide (DMF) of 90° C., and then washed with methanol. After drying the reaction product, 29.8 g of a titanyl phthalocyanine pigment was obtained.

4.1 g of the above obtained titanyl phthalocyanine pigment was dissolved in a mixed solvent consisting of 8 ml of trifluoroacetic acid and 32 ml of dichloromethane to prepare a solution of the titanyl phthalocyanine pigment. The thus prepared solution of the phthalocyanine pigment was added dropwise to an ice-cooled mixed solvent consisting of 100 ml of methanol and 100 ml of water with stirring, whereby crystals separated out. The crystals were caused to precipitate by allowing to stand for a while, and then, the supernatant liquid was removed. With the addition of 100 ml of methanol to the crystals, the reaction product was stirred for 30 minutes, and then filtered. The thus obtained solid matter was repeatedly dispersed in 200 ml of hot water for washing. Thus, a wet cake of a titanyl phthalocyanine pigment was obtained.

The thus obtained wet cake was dispersed in 100 ml of monochlorobenzene, and stirred for 30 minutes. After the process of filtration and drying, a titanyl phthalocyanine pigment for use in the present invention was obtained.

The X-ray diffraction spectrum of the titanyl phthalocyanine pigments obtained in Synthesis Example 4 was measured under the same conditions as previously described.

Figure 9:
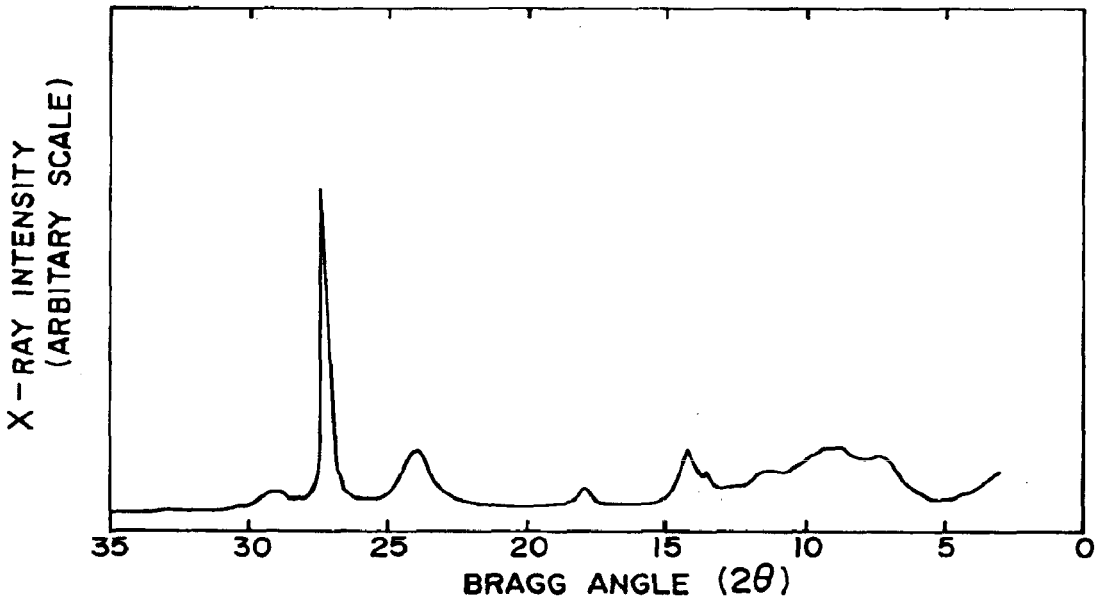
FIG. 9 is a X-ray diffraction spectrum of a titanyl phthalocyanine pigment obtained in Synthesis Example 4.

The X-ray diffraction spectrum of the titanyl phthalocyanine pigment obtained in Synthesis Example 4 is shown in FIG. 9.

As is apparent from the graph shown in FIG. 9, there is a main peak of Bragg angle of 2θ at 27.2°. The intensities of any other peaks are 35% or less of the intensity of the main peak at 27.2° in terms of the height of the peak.

EXAMPLE 27

[Formation of Intermediate Layer]

Three parts by weight of a commercially available alcohol-soluble polyamide (Trademark "CM-8000", made by Toray Industries, Inc.) was dissolved in 100 parts by weight of a mixed solvent of methanol and n-butanol with a volume ratio of 8:2 under the application of heat. Thus, a coating liquid for an intermediate layer was prepared.

The thus prepared intermediate layer coating liquid was coated on an aluminum plate (Trademark "A1080", made by Sumitomo Light Metal Industries, Ltd.) with a thickness of 0.2 mm, dried at 100° C. for 20 minutes, so that an intermediate layer with a thickness of 0.1 μm was formed on the electroconductive support.

[Formation of Charge Generation Layer]

Three parts by weight of a commercially available butyral resin (Trademark "XYHL", made by Union Carbide Japan K.K.) was dissolved in 150 parts by weight of cyclohexanone. A mixture of 3.6 parts by weight of a disazo pigment of formula (I)-24 (shown in TABLE 1-(5)) and 2.5 parts by weight of the titanyl phthalocyanine pigment synthesized in Synthesis Example 1 was added to the above prepared resin solution and dispersed in a ball mill for 120 hours. With the addition of 300 parts by weight of cyclohexanone, the dispersion was continued for further 3 hours. Thus, a charge generation layer coating liquid was prepared.

The thus prepared charge generation layer coating liquid was coated on the previously obtained intermediate layer, and dried at 130° C. for 10 minutes, so that a charge generation layer with a thickness of 0.25 μm was provided on the intermediate layer.

[Formation of Charge Transport Layer]

Eight parts by weight of a charge transporting material of formula (b), 10 parts by weight of a polycarbonate resin (Trademark "Z-200", made by Mitsubishi Gas Chemical Company, Inc.), and 0.002 parts by weight of a silicone oil (Trademark "KF-50", made by Shin-Etsu Chemical Co., Ltd.) were dissolved in 85 parts by weight of tetrahydrofuran, so that a coating liquid for a charge transport layer was prepared.

(Charge Transporting Material)

(b)

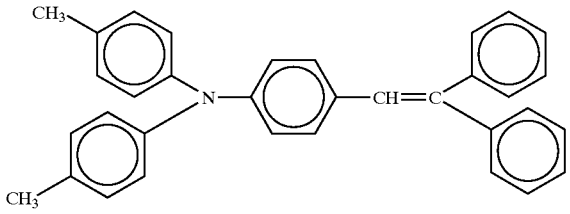

The thus prepared charge transport layer coating liquid was coated on the above obtained charge generation layer, and dried at 130° C. for 20 minutes, so that a charge transport layer with a thickness of 20 μm was provided on the charge generation layer.

Thus, an electrophotographic photoconductor No. 27 according to the present invention was obtained.

EXAMPLES 28 TO 30

The procedure for preparation of the electrophotographic photoconductor No. 27 in Example 27 was repeated except that the disazo pigment (I)-24 for use in the charge generation layer coating liquid in Example 27 was replaced by disazo pigments (I)-20 (shown in TABLE 1-(4)), (I)-29 and (I)-30 (shown in TABLE 1-(6)) respectively in Examples 28, 29 and 30.

Thus, electrophotographic photoconductors Nos. 28, 29 and 30 according to the present invention were obtained.

COMPARATIVE EXAMPLE 27

The procedure for preparation of the electrophotographic photoconductor No. 27 in Example 27 was repeated except that the disazo pigment (I)-24 was not employed and the amount of the titanyl phthalocyanine pigment was changed from 2.5 parts by weight to 3 parts by weight in the charge generation layer coating liquid in Example 27.

Thus, a comparative electrophotographic photoconductor No. 27 was obtained.

COMPARATIVE EXAMPLE 28

The procedure for preparation of the electrophotographic photoconductor No. 27 in Example 27 was repeated except that the titanyl phthalocyanine pigment was not employed and the amount of the disazo pigment (I)-24 was changed from 3.6 parts by weight to 6 parts by weight in the charge generation layer coating liquid in Example 27.

Thus, a comparative electrophotographic photoconductor No. 28 was obtained.

COMPARATIVE EXAMPLE 29

The procedure for preparation of the electrophotographic photoconductor No. 27 in Example 27 was repeated except that the titanyl phthalocyanine pigment was hot employed and the disazo pigment (I)-24 in an amount of 3.6 parts by weight was replaced by the disazo pigment (I)-29 in an amount of 6 parts by weight in the charge generation layer coating liquid in Example 27.

Thus, a comparative electrophotographic photoconductor No. 29 was obtained.

COMPARATIVE EXAMPLE 30

The procedure for preparation of the electrophotographic photoconductor No. 27 in Example 27 was repeated except that the titanyl phthalocyanine pigment was not employed and the disazo pigment (I)-24 in an amount of 3.6 parts by weight was replaced by the disazo pigment (I)-30 in an amount of 6 parts by weight in the charge generation layer coating liquid in Example 27.

Thus, a comparative electrophotographic photoconductor No. 30 was obtained.

The dynamic electrostatic properties of each of the electrophotographic photoconductors No. 27 to No. 30 according to the present invention and the comparative electrophotographic photoconductors No. 27 to No. 30 were evaluated in the same manner as in Example 1.

The results are shown in TABLE 10.

TABLE 10

| | Exposure $E_{1/2}$ ($\mu$J/cm$^2$) | | | |
|---|---|---|---|---|
| | 500 nm | 600 nm | 700 nm | 780 nm |
| Ex. 27 | 0.33 | 0.24 | 0.37 | 0.35 |
| Ex. 28 | 0.41 | 0.33 | 0.42 | 0.39 |
| Ex. 29 | 0.38 | 0.30 | 0.40 | 0.38 |
| Ex. 30 | 0.40 | 0.30 | 0.42 | 0.39 |
| Comp. Ex. 27 | 2.70 | 0.60 | 0.58 | 0.50 |
| Comp. Ex. 28 | 0.27 | 0.19 | 0.77 | * |
| Comp. Ex. 29 | 0.30 | 0.21 | 0.88 | * |
| Comp. Ex. 30 | 0.31 | 0.22 | 0.92 | * |

*Light decay did not take place.

EXAMPLE 31

The procedure for preparation of the electrophotographic photoconductor No. 27 in Example 27 was repeated except that the titanyl phthalocyanine pigment synthesized in Synthesis Example 1 for use in the charge generation layer coating liquid in Example 27 was replaced by the titanyl phthalocyanine pigment synthesized in Synthesis Example 2.

Thus, an electrophotographic photoconductor No. 31 according to the present invention was obtained.

EXAMPLES 32 TO 34

The procedure for preparation of each of the electrophotographic photoconductors Nos. 28, 29 and 30 was repeated except that the titanyl phthalocyanine pigment synthesized in Synthesis Example 1 for use in the charge generation layer coating liquid in each Example was replaced by the titanyl phthalocyanine pigment synthesized in Synthesis Example 2.

Thus, electrophotographic photoconductors Nos. 32 to 34 according to the present invention were obtained.

COMPARATIVE EXAMPLE 31

The procedure for preparation of the electrophotographic photoconductor No. 31 in Example 31 was repeated except that the disazo pigment (I)-24 was not employed and the amount of the titanyl phthalocyanine pigment synthesized in Synthesis Example 2 was changed from 2.5 parts by weight to 3 parts by weight in the charge generation layer coating liquid in Example 31.

Thus, a comparative electrophotographic photoconductor No. 31 was obtained.

COMPARATIVE EXAMPLE 32

The procedure for preparation of the electrophotographic photoconductor No. 31 in Example 31 was repeated except that the disazo pigment of formula (I)-24 for use in the charge generation layer coating liquid in Example 31 was replaced by a polycyclic quinone pigment of the following formula (c):

(c)

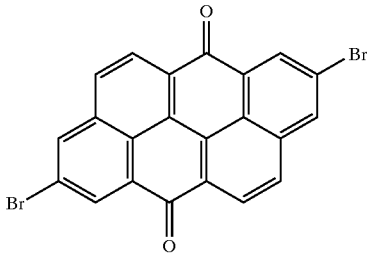

Thus, a comparative electrophotographic photoconductor No. 32 was obtained.

COMPARATIVE EXAMPLES 33 TO 35

The procedure for preparation of the electrophotographic photoconductor No. 31 in Example 31 was repeated except that the disazo pigment of formula (I)-24 for use in the charge generation layer coating liquid in Example 31 was replaced by disazo pigments of formulae (d), (i) and (j) respectively in Comparative Examples 33, 34 and 35:

(d)

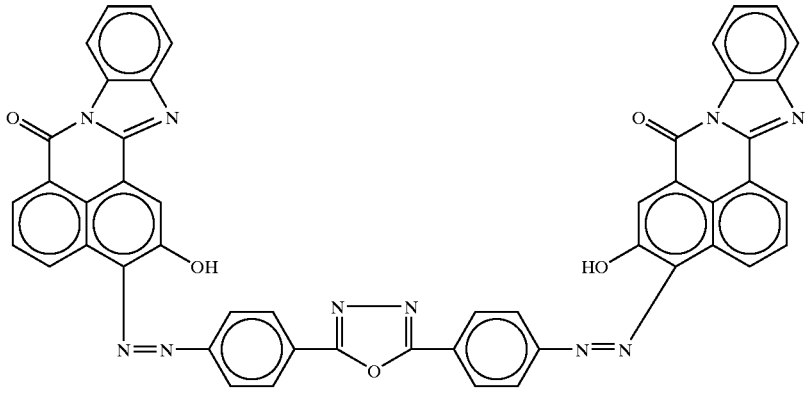

-continued (i)

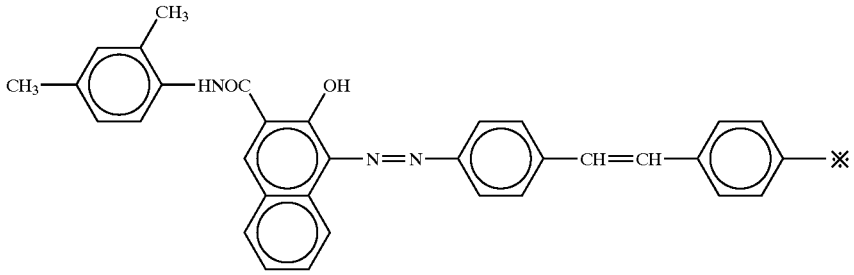

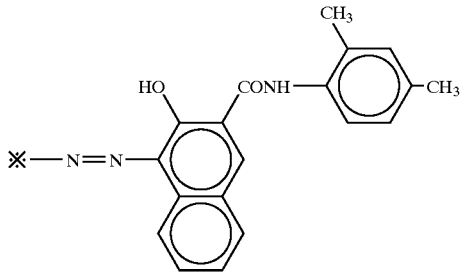

(j)

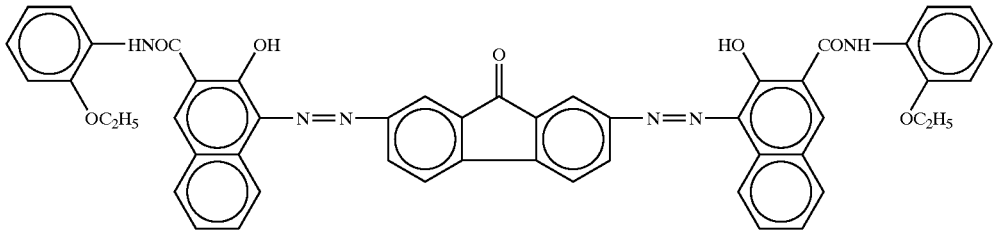

Thus, comparative electrophotographic photoconductors Nos. 33, 34 and 35 were obtained.

The dynamic electrostatic properties of each of the electrophotographic photoconductors No. 31 to No. 34 according to the present invention and the comparative electrophotographic photoconductors No. 31 to No. 35 were evaluated in the same manner as in Example 1.

The results are shown in TABLE 11.

TABLE 11

| | Exposure $E_{1/2}$($\mu$J/cm$^2$) | | | |
|---|---|---|---|---|
| | 500 nm | 600 nm | 700 nm | 780 nm |
| Ex. 31 | 0.30 | 0.22 | 0.23 | 0.21 |
| Ex. 32 | 0.35 | 0.29 | 0.30 | 0.27 |
| Ex. 33 | 0.32 | 0.25 | 0.27 | 0.24 |
| Ex. 34 | 0.34 | 0.28 | 0.29 | 0.26 |
| Comp. Ex. 31 | 1.33 | 0.33 | 0.25 | 0.19 |
| Comp. Ex. 32 | 0.39 | 0.62 | 0.40 | 0.36 |
| Comp. Ex. 33 | 0.56 | 0.65 | 0.42 | 0.38 |
| Comp. Ex. 34 | 0.70 | 0.71 | 0.43 | 0.40 |
| Comp. Ex. 35 | 0.54 | 0.48 | 0.39 | 0.38 |

EXAMPLE 35

[Formation of Intermediate Layer]

Three parts by weight of a commercially available alcohol-soluble polyamide (Trademark "CM-8000", made by Toray Industries, Inc.) was dissolved in 100 parts by weight of a mixed solvent of methanol and n-butanol with a volume ratio of 8:2 under the application of heat. Thus, a coating liquid for an intermediate layer was prepared.

The thus prepared intermediate layer coating liquid was coated on an aluminum-deposited surface of an aluminum-deposited polyethylene terephthalate (PET) film with a thickness of 75 $\mu$m, dried at 100° C. for 20 minutes, so that an intermediate layer with a thickness of 0.1 $\mu$m was formed on the electroconductive support.

[Formation of Photoconductive Layer]

0.75 parts by weight of the titanyl phthalocyanine pigment synthesized in Synthesis Example 2, 1 part by weight of a disazo pigment of formula (I)-24 (shown in TABLE 1-(5)), and 100 parts by weight of tetrahydrofuran were dispersed in a sand mill for 2 hours. The thus obtained dispersion was mixed with a solution obtained by dissolving 7 parts by weight of a charge transporting material of formula (b) and 10 parts by weight of a polycarbonate resin (Trademark "Z-200", made by Mitsubishi Gas Chemical Company, Inc.) in 100 parts by weight of tetrahydrofuran. Thus, a coating liquid for a photoconductive layer was prepared.

(b)

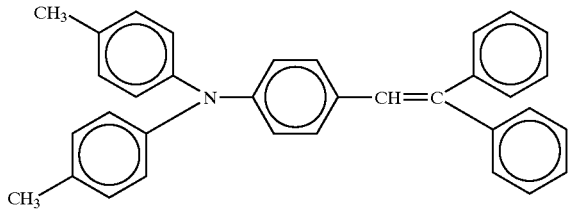

The photoconductive layer coating liquid was coated on the previously obtained intermediate layer, and dried at 130° C. for 15 minutes, so that a photoconductive layer with a thickness of 20 μm was provided on the intermediate layer.

Thus, an electrophotographic photoconductor No. 35 according to the present invention was obtained.

EXAMPLES 36 AND 37

The procedure for preparation of the electrophotographic photoconductor No. 35 in Example 35 was repeated except that the disazo pigment (I)-24 for use in the photoconductive layer coating liquid in Example 35 was replaced by disazo pigments (I)-29 and (I)-30 (shown in TABLE 1-(6)) respectively in Examples 36 and 37.

Thus, electrophotographic photoconductors Nos. 36 and 37 according to the present invention were obtained.

COMPARATIVE EXAMPLES 36 AND 37

The procedure for preparation of the electrophotographic photoconductor No. 35 in Example 35 was repeated except that the disazo pigment (I)-24 for use in the photoconductive layer coating liquid in Example 35 was replaced by disazo pigments of formulae (d) and (i) respectively in Comparative Examples 36 and 37.

(d)

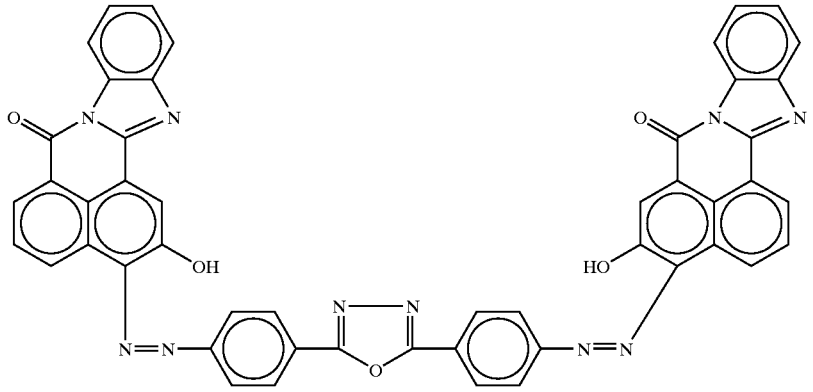

(i)

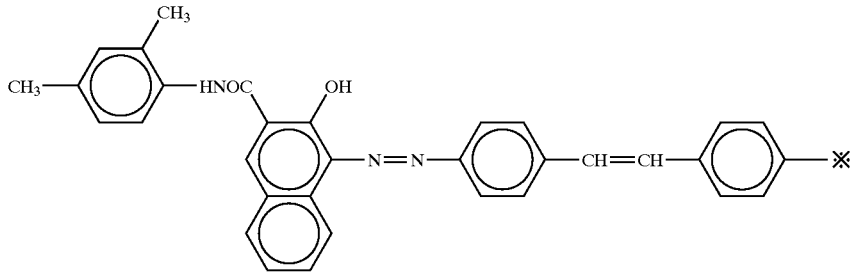

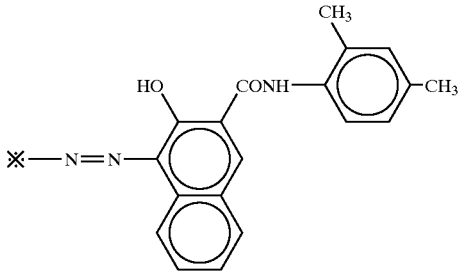

Thus, comparative electrophotographic photoconductors Nos. 36 and 37 were obtained.

The dynamic electrostatic properties of each of the electrophotographic photoconductors No. 35 to No. 37 according to the present invention and the comparative electrophotographic photoconductors No. 36 and No. 37 were measured by using a commercially available test apparatus (Trademark "EPA-8100", made by Kawaguchi Electro Works Co., Ltd.).

More specifically, each photoconductor was charged positively in the dark under application of +7 kV by corona charge for 5 seconds. Then, each photoconductor was allowed to stand in the dark without applying any charge thereto. When the surface potential of the photoconductor reached +800 V, the photoconductor was illuminated by the light of 500 nm, 600 nm, 700 nm and 780 nm separated by use of a band pass filter. In each case, the exposure $E_{1/2}$ ($\mu J/cm^2$) required to reduce the surface potential to ½ the surface potential, that is, +400 V, was measured.

The results are shown in TABLE 12.

TABLE 12

| | Exposure $E_{1/2}$($\mu J/cm^2$) | | | |
|---|---|---|---|---|
| | 500 nm | 600 nm | 700 nm | 780 nm |
| Ex. 35 | 0.35 | 0.32 | 0.28 | 0.25 |
| Ex. 36 | 0.37 | 0.35 | 0.30 | 0.27 |
| Ex. 37 | 0.40 | 0.36 | 0.40 | 0.38 |
| Comp. Ex. 36 | 0.70 | 0.63 | 0.57 | 0.52 |
| Comp. Ex. 37 | 0.90 | 0.90 | 0.69 | 0.65 |

EXAMPLES 38 TO 40

The procedure for preparation of each of the electrophotographic photoconductors Nos. 31, 33 and 34 in Examples 31, 33 and 34 was independently repeated except that the aluminum plate (Trademark "A1080", made by Sumitomo Light Metal Industries, Ltd.) used as the electroconductive support in each Example was replaced by an aluminum cylinder with a diameter of 80 mm.

Thus, electrophotographic photoconductors Nos. 38, 39 and 40 according to the present invention were obtained.

COMPARATIVE EXAMPLES 38 TO 40

The procedure for preparation of each of the comparative electrophotographic photoconductors Nos. 32, 33 and 34 in Comparative Examples 32, 33 and 34 was independently repeated except that the aluminum plate (Trademark "A1080", made by Sumitomo Light Metal Industries, Ltd.) used as the electroconductive support in each Comparative Example was replaced by an aluminum cylinder with a diameter of 80 mm.

Thus, comparative electrophotographic photoconductors Nos. 38, 39 and 40 were obtained.

To evaluate the electrophotographic properties, each of the electrophotographic photoconductors Nos. 38 to 40 according to the present invention and the comparative electrophotographic photoconductors Nos. 38 to 40 was placed in a commercially available digital copying machine (Trademark "IMAGIO MF530", made by Ricoh Company, Ltd.) employing as a quenching light source a halogen lamp emitting the light of less than 650 nm.

The voltage applied to the photoconductor in the charging process, the light quantity of a laser beam with a wavelength of 780 nm employed in the exposure process, and the light quantity of the halogen lamp in the quenching process were respectively controlled in such a manner that the surface potential (Vd) of the photoconductor reached about −850 V by charging, the surface potential (Vl) of the photoconductor reached about −130 V after exposure, and the surface potential (Vr) of the photoconductor reached about −50 V after quenching. The surface potentials (Vd), (Vl) and (Vr) of each photoconductor were measured at the initial stage and after continuously making 2,000 copies.

The results are shown in TABLE 13.

TABLE 13

| | Initial Stage | | | After making 2,000 copies | | |
|---|---|---|---|---|---|---|
| | Vd(−V) | Vl(−V) | Vr(−V) | Vd(−V) | Vl(−V) | Vr(−V) |
| Ex. 38 | 850 | 135 | 50 | 830 | 140 | 55 |
| Ex. 39 | 855 | 130 | 50 | 835 | 135 | 55 |
| Ex. 40 | 850 | 130 | 55 | 830 | 135 | 60 |
| Comp. Ex. 38 | 855 | 130 | 50 | 810 | 180 | 80 |
| Comp. Ex. 39 | 850 | 130 | 50 | 755 | 135 | 65 |
| Comp. Ex. 40 | 845 | 125 | 45 | 725 | 120 | 50 |

EXAMPLE 41

[Formation of Intermediate Layer]

Three parts by weight of a commercially available alcohol-soluble polyamide (Trademark "CM-8000", made by Toray Industries, Inc.) was dissolved in 100 parts by weight of a mixed solvent of methanol and n-butanol with a volume ratio of 8:2 under the application of heat. Thus, a coating liquid for an intermediate layer was prepared.

The thus prepared intermediate layer coating liquid was coated on an aluminum plate (Trademark "A1080", made by Sumitomo Light Metal Industries, Ltd.) with a thickness of 0.2 mm, dried at 100° C. for 20 minutes, so that an intermediate layer with a thickness of 0.1 $\mu$m was formed on the electroconductive support.

[Formation of Charge Generation Layer]

Three parts by weight of a commercially available butyral resin (Trademark "S-Lec BL-1", made by Sekisui Chemical Co., Ltd.) was dissolved in 150 parts by weight of cyclohexanone. A mixture of 3.5 parts by weight of a disazo pigment of formula (I)-24 (shown in TABLE 1-(5)) and 3.5 parts by weight of a metal-free $\tau$-type phthalocyanine pigment was added to the above prepared resin solution and dispersed in a ball mill for 120 hours. With the addition of 300 parts by weight of cyclohexanone, the dispersion was continued for further 3 hours. Thus, a coating liquid for a charge generation layer was prepared.

The charge generation layer coating liquid was coated on the previously obtained intermediate layer, and dried at 130° C. for 10 minutes, so that a charge generation layer with a thickness of 0.25 $\mu$m was provided on the intermediate layer.

[Formation of Charge Transport Layer]

Eight parts by weight of a charge transporting material of formula (b), 10 parts by weight of a polycarbonate resin (Trademark "Z-300", made by Mitsubishi Gas Chemical Company, Inc.), and 0.002 parts by weight of a silicone oil (Trademark "KF-50", made by Shin-Etsu Chemical Co., Ltd.) were dissolved in 85 parts by weight of tetrahydrofuran, so that a coating liquid for a charge transport layer was prepared.

(Charge Transporting Material)

(b)

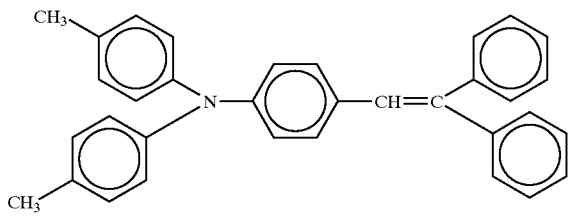

The thus prepared charge transport layer coating liquid was coated on the above obtained charge generation layer, and dried at 130° C. for 20 minutes, so that a charge transport layer with a thickness of 20 μm was provided on the charge generation layer.

Thus, an electrophotographic photoconductor No. 41 according to the present invention was obtained.

EXAMPLE 42

The procedure for preparation of the electrophotographic photoconductor No. 41 in Example 41 was repeated except that the disazo pigment (I)-24 for use in the charge generation layer coating liquid in Example 41 was replaced by the disazo pigment (I)-29 (shown in TABLE 1-(6)).

Thus, electrophotographic photoconductor No. 42 according to the present invention was obtained.

EXAMPLE 43

The procedure for preparation of the electrophotographic photoconductor No. 41 in Example 41 was repeated except that the metal-free τ-type phthalocyanine pigment for use in the charge generation layer coating liquid in Example 41 was replaced by a commercially available metal-free X-type phthalocyanine pigment (Trademark "Fastgen blue 8120B", made by Dainippon Ink & Chemicals, Incorporated).

Thus, an electrophotographic photoconductor No. 43 according to the present invention was obtained.

EXAMPLE 44

The procedure for preparation of the electrophotographic photoconductor No. 42 in Example 42 was repeated except that the metal-free τ-type phthalocyanine pigment for use in the charge generation layer coating liquid in Example 42 was replaced by a commercially available metal-free X-type phthalocyanine pigment (Trademark "Fastgen blue 8120B", made by Dainippon Ink & Chemicals, Incorporated).

Thus, an electrophotographic photoconductor No. 44 according to the present invention was obtained.

EXAMPLE 45

The procedure for preparation of the electrophotographic photoconductor No. 41 in Example 41 was repeated except that the metal-free τ-type phthalocyanine pigment for use in the charge generation layer coating liquid in Example 41 was replaced by the titanyl phthalocyanine pigment synthesized in Synthesis Example 2.

Thus, an electrophotographic photoconductor No. 45 according to the present invention was obtained.

EXAMPLE 46

The procedure for preparation of the electrophotographic photoconductor No. 42 in Example 42 was repeated except that the metal-free τ-type phthalocyanine pigment for use in the charge generation layer coating liquid in Example 42 was replaced by the titanyl phthalocyanine pigment synthesized in Synthesis Example 2.

Thus, an electrophotographic photoconductor No. 46 according to the present invention was obtained.

EXAMPLE 47

The procedure for preparation of the electrophotographic photoconductor No. 41 in Example 41 was repeated except that the metal-free τ-type phthalocyanine pigment for use in the charge generation layer coating liquid in Example 41 was replaced by the titanyl phthalocyanine pigment synthesized in Synthesis Example 3.

Thus, an electrophotographic photoconductor No. 47 according to the present invention was obtained.

EXAMPLE 48

The procedure for preparation of the electrophotographic photoconductor No. 42 in Example 42 was repeated except that the metal-free τ-type phthalocyanine pigment for use in the charge generation layer coating liquid in Example 42 was replaced by the titanyl phthalocyanine pigment synthesized in Synthesis Example 3.

Thus, an electrophotographic photoconductor No. 48 according to the present invention was obtained.

EXAMPLE 49

The procedure for preparation of the electrophotographic photoconductor No. 41 in Example 41 was repeated except that the metal-free τ-type phthalocyanine pigment for use in the charge generation layer coating liquid in Example 41 was replaced by the titanyl phthalocyanine pigment synthesized in Synthesis Example 4.

Thus, an electrophotographic photoconductor No. 49 according to the present invention was obtained.

EXAMPLE 50

The procedure for preparation of the electrophotographic photoconductor No. 42 in Example 42 was repeated except that the metal-free τ-type phthalocyanine pigment for use in the charge generation layer coating liquid in Example 42 was replaced by the titanyl phthalocyanine pigment synthesized in Synthesis Example 4.

Thus, an electrophotographic photoconductor No. 50 according to the present invention was obtained.

COMPARATIVE EXAMPLE 41

The procedure for preparation of the electrophotographic photoconductor No. 41 in Example 41 was repeated except that the disazo pigment (I)-24 for use in the charge generation layer coating liquid in Example 41 was replaced by a disazo pigment of the following formula (k), and the metal-free τ-type phthalocyanine pigment for use in the charge generation layer coating liquid in Example 41 was replaced by a trisazo pigment of the following formula (1):

(k)
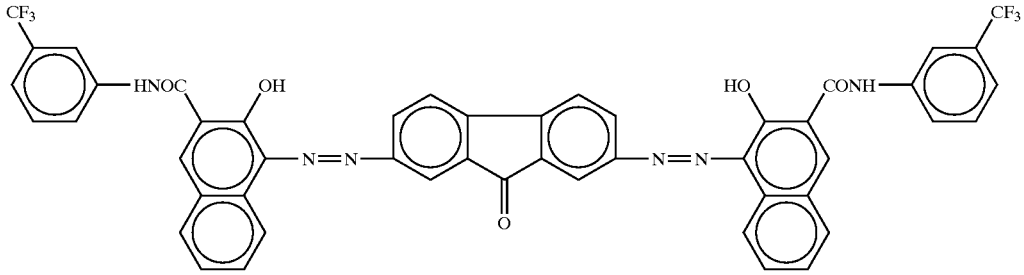
(l)
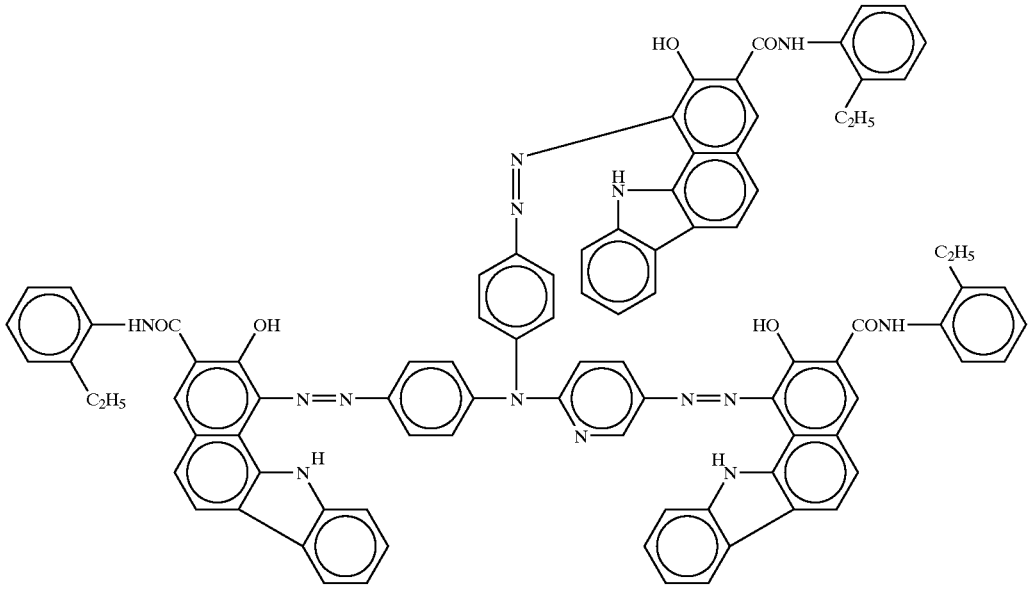
Thus, a comparative electrophotographic photoconductor No. 41 was obtained.
COMPARATIVE EXAMPLE 42
The procedure for preparation of the electrophotographic photoconductor No. 41 in Example 41 was repeated except that the disazo pigment (I)-24 for use in the charge generation layer coating liquid in Example 41 was replaced by a disazo pigment of the following formula (m):
(m)
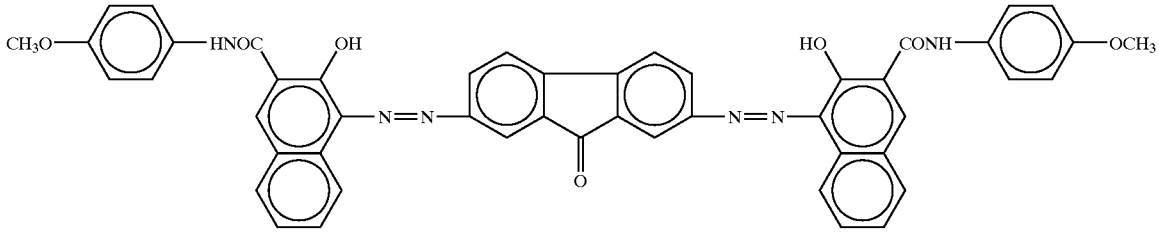

Thus, a comparative electrophotographic photoconductor No. 42 was obtained.

COMPARATIVE EXAMPLE 43

The procedure for preparation of the electrophotographic photoconductor No. 41 in Example 41 was repeated except that the disazo pigment (I)-24 for use in the charge generation layer coating liquid in Example 41 was replaced by a disazo pigment of the following formula (m), and the metal-free τ-type phthalocyanine pigment for use in the charge generation layer coating liquid in Example 41 was replaced by a metal-free X-type phthalocyanine pigment:

(m)

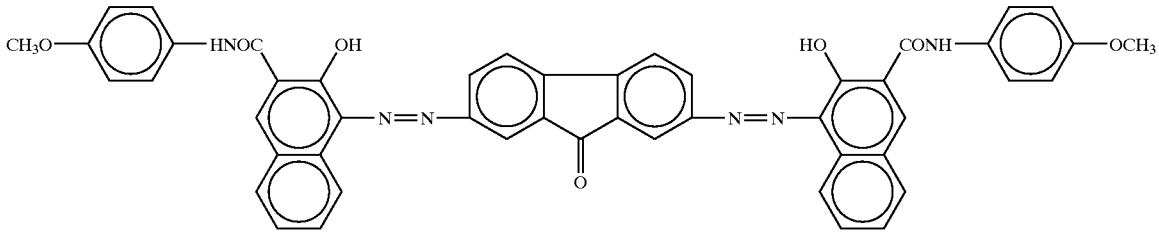

Thus, a comparative electrophotographic photoconductor No. 43 was obtained.

COMPARATIVE EXAMPLE 44

The procedure for preparation of the electrophotographic photoconductor No. 42 in Example 42 was repeated except that the metal-free τ-type phthalocyanine pigment for use in the charge generation layer coating liquid in Example 42 was replaced by a disazo pigment of the following formula (n):

(n)

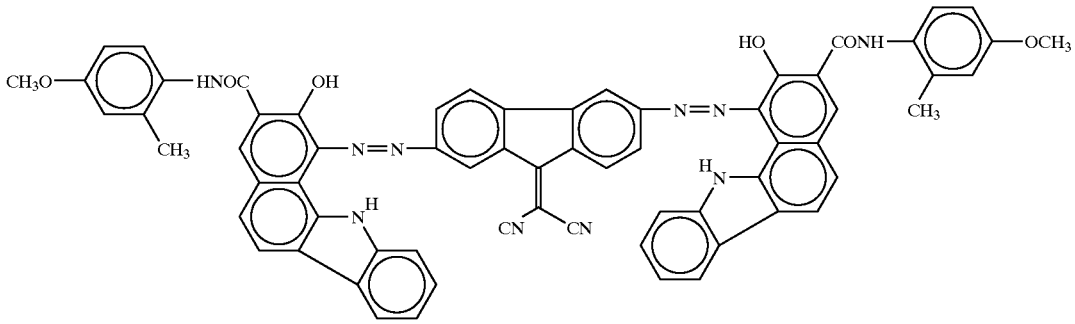

Thus, a comparative electrophotographic photoconductor No. 44 was obtained.

COMPARATIVE EXAMPLE 45

The procedure for preparation of the electrophotographic photoconductor No. 41 in Example 41 was repeated except that the disazo pigment (I)-24 for use in the charge generation layer coating liquid in Example 41 was replaced by a disazo pigment of the following formula (o), and the metal-free τ-type phthalocyanine pigment for use in the charge generation layer coating liquid in Example 41 was replaced by the titanyl phthalocyanine pigment synthesized in Synthesis Example 2:

(o)

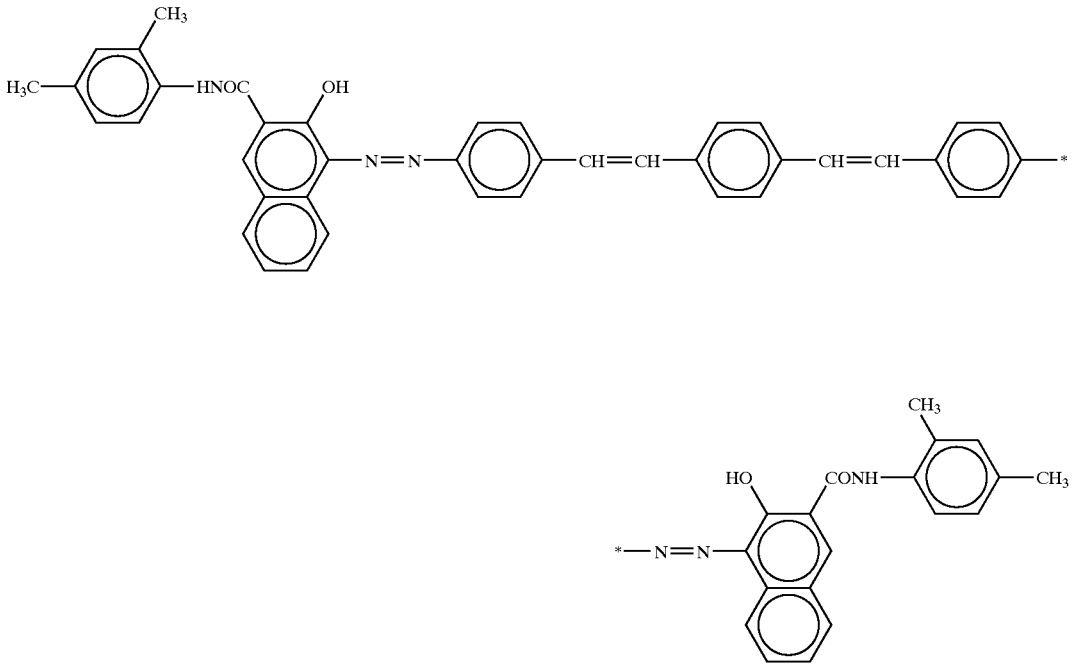

Thus, a comparative electrphotographic photoconductor No. 45 was obtained.

COMPARATIVE EXAMPLE 46

The procedure for preparation of the electrophotographic photoconductor No. 41 in Example 41 was repeated except that the disazo pigment (I)-24 for use in the charge generation layer coating liquid in Example 41 was replaced by a disazo pigment of the following formula (o), and the metal-free τ-type phthalocyanine pigment for use in the charge generation layer coating liquid in Example 41 was replaced by the titanyl phthalocyanine pigment synthesized in Synthesis Example 3:

(o)

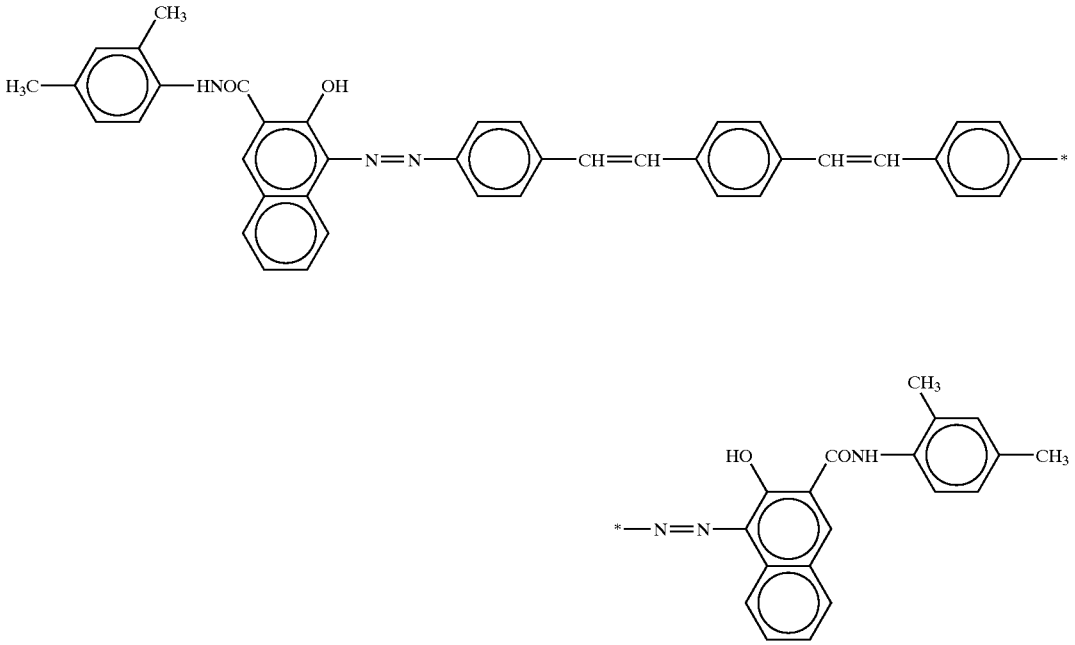

Thus, a comparative electrophotographic photoconductor No. 46 was obtained.

COMPARATIVE EXAMPLE 47

The procedure for preparation of the electrophotographic photoconductor No. 41 in Example 41 was repeated except that the disazo pigment (I)-24 for use in the charge generation layer coating liquid in Example 41 was replaced by a disazo pigment of the following formula (o), and the metal-free τ-type phthalocyanine pigment for use in the charge generation layer coating liquid in Example 41 was replaced by the titanyl phthalocyanine pigment synthesized in Synthesis Example 4:

(o)

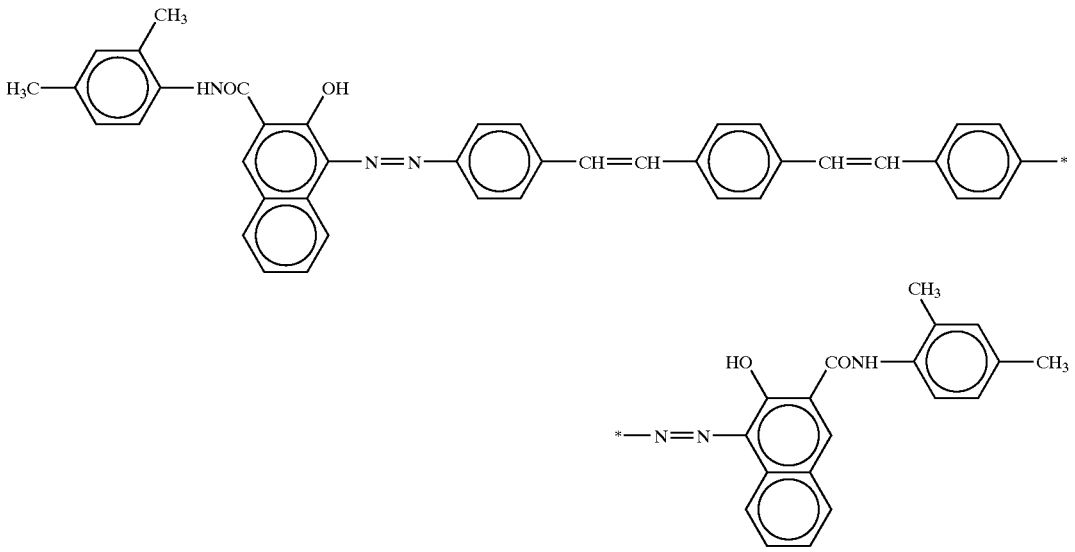

Thus, a comparative electrophotographic photoconductor No. 47 was obtained.

The dynamic electrostatic properties of each of the electrophotographic photoconductors No. 41 to No. 50 according to the present invention and the comparative electrophotographic photoconductors No. 41 to No. 47 were measured by using a commercially available test apparatus (Trademark "EPA-8100", made by Kawaguchi Electro Works Co., Ltd.).

More specifically, each photoconductor was charged negatively in the dark under application of −6 kV by corona charge for 5 seconds. The surface potential $V_2$ (−V) of each photoconductor was measured 2 seconds after the initiation of charging. Then, each photoconductor was allowed to stand in the dark without applying any charge thereto. When the surface potential of the photoconductor reached −800 V, the photoconductor was illuminated by a tungsten light with a color temperature of 2856° K. in such a fashion that the illuminance on the illuminated surface of the photoconductor was 5.3 lux. The exposure $E_{1/10}$ (lux·sec) required to reduce the surface potential of −800 V to 1/10 the surface potential, that is, −80 V, was measured.

Thereafter, each photoconductor was allowed to stand at 20° C. and 30% RH for two days with the concentration of $NO_x$ being controlled to 50 ppm. After two days, the electrostatic properties of each photoconductor were evaluated in the same manner as mentioned above.

The gas resistance of the photoconductor was expressed by $\Delta V_2$, that is, ($V_2$ obtained before exposure to $NO_x$ gas)−($V_2$ obtained after exposure to $NO_x$ gas), and $\Delta E_{1/10}$, that is, ($E_{1/10}$ obtained after exposure to $NO_x$ gas)−($E_{1/10}$ obtained before exposure to $NO_x$ gas).

The results are shown in TABLE 14.

TABLE 14

| | Δ V2 | Δ $E_{1/10}$ |
|---|---|---|
| Ex. 41 | −70 | 0.04 |
| Ex. 42 | −80 | 0.04 |
| Ex. 43 | −60 | 0.04 |
| Ex. 44 | −65 | 0.04 |

TABLE 14-continued

| | Δ V2 | Δ $E_{1/10}$ |
|---|---|---|
| Ex. 45 | −50 | 0.03 |
| Ex. 46 | −55 | 0.03 |
| Ex. 47 | −50 | 0.03 |
| Ex. 48 | −55 | 0.03 |
| Ex. 49 | −35 | 0.02 |
| Ex. 50 | −40 | 0.02 |
| Comp. Ex. 41 | −350 | * |
| Comp. Ex. 42 | −170 | 0.16 |
| Comp. Ex. 43 | −150 | 0.12 |
| Comp. Ex. 44 | −300 | * |
| Comp. Ex. 45 | −210 | 0.18 |
| Comp. Ex. 46 | −200 | 0.18 |
| Comp. Ex. 47 | −170 | 0.14 |

*It was impossible to obtain the value of Δ $E_{1/10}$ because the surface potential of the photoconductor did not reach −800 V after dark decay.

EXAMPLE 51

[Formation of Intermediate Layer]

Three parts by weight of a commercially available alcohol-soluble polyamide (Trademark "CM-8000", made by Toray Industries, Inc.) was dissolved in 100 parts by weight of a mixed solvent of methanol and n-butanol with a volume ratio of 8:2 under the application of heat. Thus, a coating liquid for an intermediate layer was prepared.

The thus prepared intermediate layer coating liquid was coated on an aluminum plate (Trademark "A1080", made by Sumitomo Light Metal Industries, Ltd.) with a thickness of 0.2 mm, dried at 100° C. for 20 minutes, so that an intermediate layer with a thickness of 0.1 μm was formed on the electroconductive support.

[Formation of Charge Generation Layer]

Three parts by weight of a commercially available butyral resin (Trademark "XYHL", made by Union Carbide Japan K.K.) was dissolved in 150 parts by weight of cyclohexanone. 3.5 parts by weight of a disazo pigment of formula (I)-20 (shown in TABLE 1-(4)) and 2.5 parts by weight of a titanyl phthalocyanine pigment synthesized in Synthesis Example 3 were added to the above prepared resin solution and dispersed in a ball mill for 120 hours. With the addition of 300 parts by weight of cyclohexanone, the dispersion was continued for further 3 hours. Thus, a coating liquid for a charge generation layer was prepared.

The charge generation layer coating liquid was coated on the previously obtained intermediate layer, and dried at 130° C. for 10 minutes, so that a charge generation layer with a thickness of 0.25 μm was provided on the intermediate layer.

[Formation of Charge Transport Layer]

Eight parts by weight of a charge transporting material of formula (b), 10 parts by weight of a polycarbonate resin (Trademark "Z-200", made by Mitsubishi Gas Chemical Company, Inc.), and 0.002 parts by weight of a silicone oil (Trademark "KF-50", made by Shin-Etsu Chemical Co., Ltd.) were dissolved in 85 parts by weight of tetrahydrofuran, so that a coating liquid for a charge transport layer was prepared.

(Charge Transporting Material)

(b)

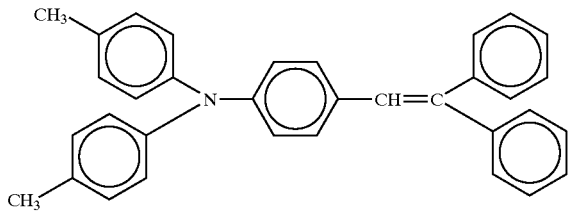

The thus prepared charge transport layer coating liquid was coated on the above obtained charge generation layer, and dried at 130° C. for 20 minutes, so that a charge transport layer with a thickness of 20 μm was provided on the charge generation layer.

Thus, an electrophotographic photoconductor No. 51 according to the present invention was obtained.

EXAMPLE 52

The procedure for preparation of the electrophotographic photoconductor No. 51 in Example 51 was repeated except that the disazo pigment (I)-20 for use in the charge generation layer coating liquid in Example 51 was replaced by a disazo pigment (I)-30 (shown in TABLE 1-(6)).

Thus, an electrophotographic photoconductor No. 52 according to the present invention was obtained.

COMPARATIVE EXAMPLE 48

The procedure for preparation of the electrophotographic photoconductor No. 51 in Example 51 was repeated except that the disazo pigment (I)-20 for use in the charge generation layer coating liquid in Example 51 was not employed, and the amount of the titanyl phthalocyanine pigment synthesized in Synthesis Example 3 for use in the charge generation layer coating liquid in Example 51 was changed from 2.5 to 3.0 parts by weight.

Thus, a comparative electrophotographic photoconductor No. 48 was obtained.

COMPARATIVE EXAMPLE 49

The procedure for preparation of the electrophotographic photoconductor No. 51 in Example 51 was repeated except that the disazo pigment (I)-20 for use in the charge generation layer coating liquid in Example 51 was replaced by a polycyclic quinone pigment of the following formula (c):

(c)

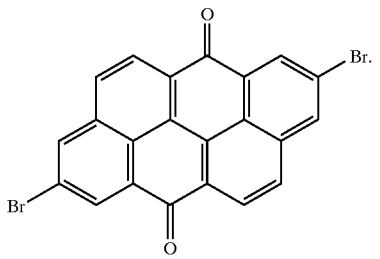

Thus, a comparative electrophotographic photoconductor No. 49 was obtained.

COMPARATIVE EXAMPLES 50 TO 52

The procedure for preparation of the electrophotographic photoconductor No. 51 in Example 51 was repeated except that the disazo pigment (I)-20 for use in the charge generation layer coating liquid in Example 51 was replaced by the following disazo pigments of formulae (d), (p) and (q) respectively in Comparative Examples 50, 51 and 52:

(d)

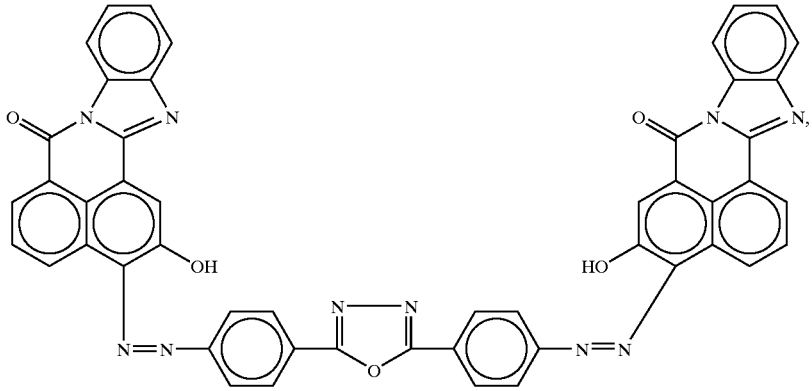

(p)

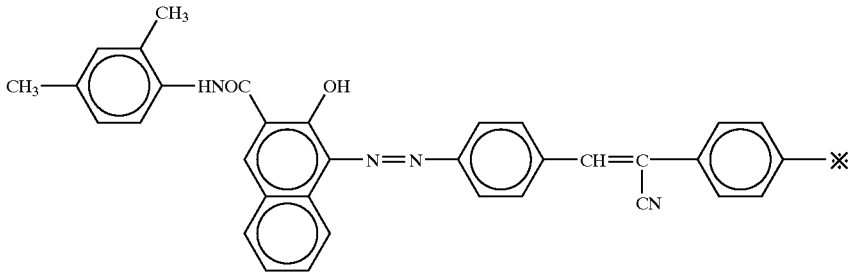

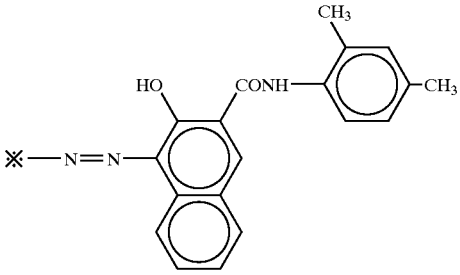

and (q)

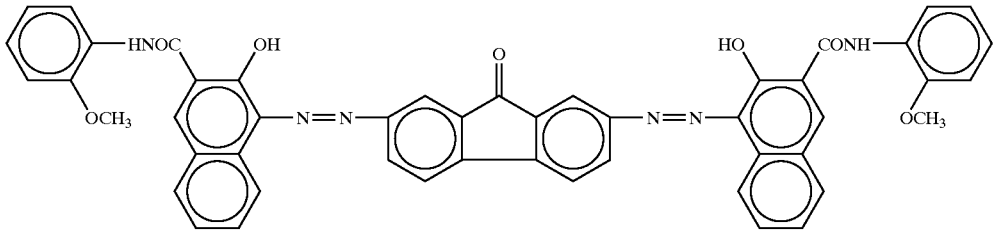

Thus, comparative electrophotographic photoconductors No. 50 to No. 52 were obtained.

The dynamic electrostatic properties of each of the electrophotographic photoconductors No. 51 and No. 52 according to the present invention and the comparative electrophotographic photoconductors No. 48 to No. 52 were measured by using a commercially available test apparatus (Trademark "EPA-8100", made by Kawaguchi Electro Works Co., Ltd.).

More specifically, each photoconductor was charged negatively in the dark under application of −6 kV by corona charge for 5 seconds. Then, each photoconductor was allowed to stand in the dark without applying any charge thereto. When the surface potential of the photoconductor reached −800 V, the photoconductor was illuminated by the light of 500 nm, 600 nm, 700 nm and 780 nm separated by use of a band pass filter. In each case, the exposure $E_{1/2}$ ($\mu J/cm^2$) required to reduce the surface potential to ½ the surface potential, that is, −400 V, was measured.

The results are shown in TABLE 15.

TABLE 15

| | Exposure $E_{1/2}$($\mu J/cm^2$) | | | |
|---|---|---|---|---|
| | 500 nm | 600 nm | 700 nm | 780 nm |
| Ex. 51 | 0.31 | 0.25 | 0.27 | 0.23 |
| Ex. 52 | 0.31 | 0.25 | 0.26 | 0.23 |
| Comp. Ex. 48 | 1.20 | 0.30 | 0.22 | 0.16 |
| Comp. Ex. 49 | 0.39 | 0.62 | 0.37 | 0.34 |
| Comp. Ex. 50 | 0.57 | 0.64 | 0.40 | 0.36 |
| Comp. Ex. 51 | 0.76 | 0.75 | 0.40 | 0.37 |

TABLE 15-continued

| | Exposure $E_{1/2}$ ($\mu J/cm^2$) | | | |
|---|---|---|---|---|
| | 500 nm | 600 nm | 700 nm | 780 nm |
| Comp. Ex. 52 | 0.59 | 0.53 | 0.40 | 0.36 |

EXAMPLE 53

The procedure for preparation of the electrophotographic photoconductor No. 51 in Example 51 was repeated except that the titanyl phthalocyanine pigment synthesized in Synthesis Example 3 for use in the charge generation layer coating liquid in Example 51 was replaced by a titanyl phthalocyanine pigment synthesized in Synthesis Example 4.

Thus, an electrophotographic photoconductor No. 53 according to the present invention was obtained.

EXAMPLE 54

The procedure for preparation of the electrophotographic photoconductor No. 52 in Example 52 was repeated except that the titanyl phthalocyanine pigment synthesized in Synthesis Example 3 for use in the charge generation layer coating liquid in Example 52 was replaced by the titanyl phthalocyanine pigment synthesized in Synthesis Example 4.

Thus, an electrophotographic photoconductor No. 54 according to the present invention was obtained.

COMPARATIVE EXAMPLE 53

The procedure for preparation of the electrophotographic photoconductor No. 53 in Example 53 was repeated except that the disazo pigment (I)-20 for use in the charge generation layer coating liquid in Example 53 was not employed and the amount of the titanyl phthalocyanine pigment synthesized in Synthesis Example 4 for use in the charge generation layer coating liquid in Example 53 was changed from 2.5 to 3.0 parts by weight.

Thus, a comparative electrophotographic photoconductor No. 53 was obtained.

COMPARATIVE EXAMPLE 54

The procedure for preparation of the electrophotographic photoconductor No. 53 in Example 53 was repeated except that the disazo pigment (I)-20 for use in the charge generation layer coating liquid in Example 53 was replaced by a polycyclic quinone pigment of the following formula (c):

(c)

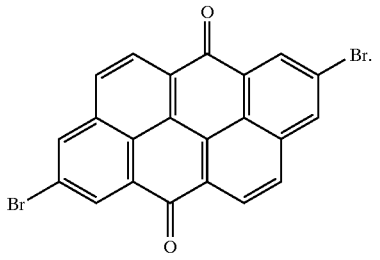

Thus, a comparative electrophotographic photoconductor No. 54 was obtained.

COMPARATIVE EXAMPLES 55 TO 57

The procedure for preparation of the electrophotographic photoconductor No. 53 in Example 53 was repeated except that the disazo pigment (I)-20 for use in the charge generation layer coating liquid in Example 53 was replaced by the following disazo pigments of formulae (d), (p) and (q) respectively in Comparative Examples 55, 56 and 57:

(d)

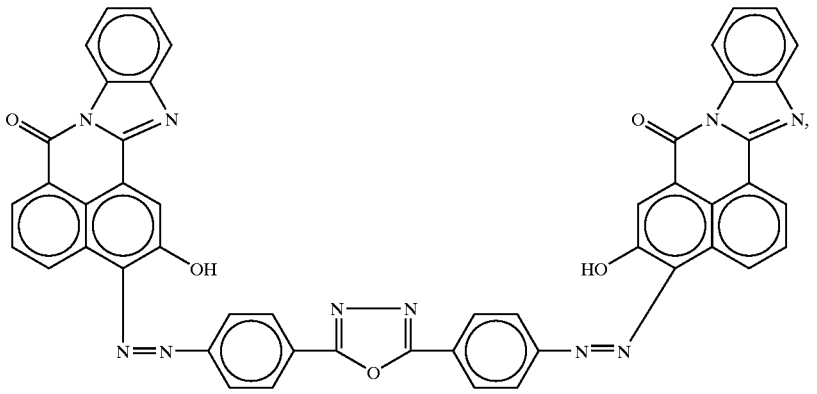

-continued (p)

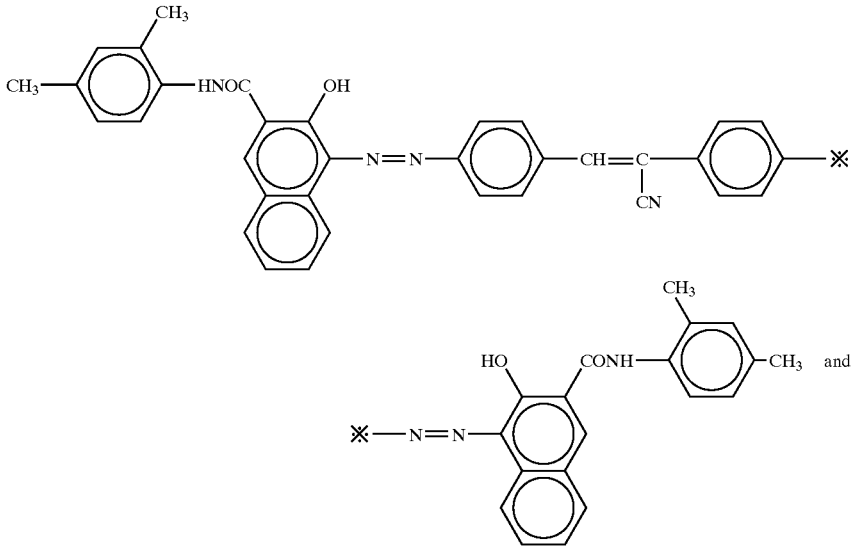

(q)

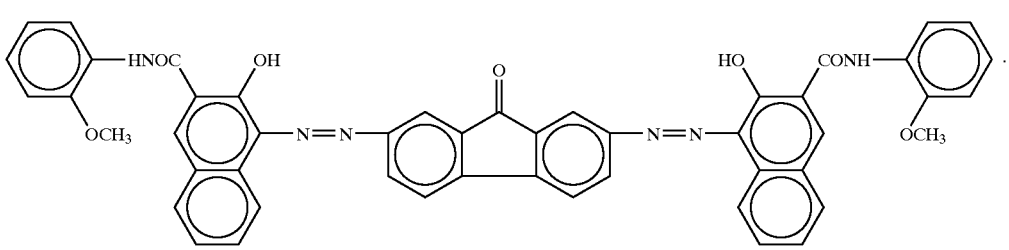

Thus, comparative electrophotographic photoconductors No. 55, No. 56 and No. 57 were obtained.

The dynamic electrostatic properties of each of the electrophotographic photoconductors No. 53 and No. 54 according to the present invention and the comparative electrophotographic photoconductors No. 53 to No. 57 were measured by using a commercially available test apparatus (Trademark "EPA-8100", made by Kawaguchi Electro Works Co., Ltd.).

More specifically, each photoconductor was charged negatively in the dark under application of −6 kV by corona charge for 5 seconds. Then, each photoconductor was allowed to stand in the dark without applying any charge thereto. When the surface potential of the photoconductor reached −800 V, the photoconductor was illuminated by the light of 500 nm, 600 nm, 700 nm and 780 nm separated by use of a band pass filter. In each case, the exposure $E_{1/2}$ ($\mu J/cm^2$) required to reduce the surface potential to ½ the surface potential, that is, −400 V, was measured.

The results are shown in TABLE 16.

TABLE 16

| | Exposure $E_{1/2}$($\mu J/cm^2$) | | | |
|---|---|---|---|---|
| | 500 nm | 600 nm | 700 nm | 780 nm |
| Ex. 53 | 0.31 | 0.25 | 0.26 | 0.22 |
| Ex. 54 | 0.31 | 0.26 | 0.26 | 0.24 |
| Comp. Ex. 53 | 1.22 | 0.32 | 0.22 | 0.16 |
| Comp. Ex. 54 | 0.39 | 0.62 | 0.37 | 0.33 |

TABLE 16-continued

| | Exposure $E_{1/2}$($\mu J/cm^2$) | | | |
|---|---|---|---|---|
| | 500 nm | 600 nm | 700 nm | 780 nm |
| Comp. Ex. 55 | 0.56 | 0.65 | 0.40 | 0.36 |
| Comp. Ex. 56 | 0.76 | 0.75 | 0.39 | 0.37 |
| Comp. Ex. 57 | 0.59 | 0.54 | 0.40 | 0.37 |

EXAMPLE 55

[Formation of Intermediate Layer]

Three parts by weight of a commercially available alcohol-soluble polyamide (Trademark "CM-8000", made by Toray Industries, Inc.) was dissolved in 100 parts by weight of a mixed solvent of methanol and n-butanol with a volume ratio of 8:2 under the application of heat. Thus, a coating liquid for an intermediate layer was prepared.

The thus prepared intermediate layer coating liquid was coated on an aluminum-deposited surface of an aluminum-deposited polyethylene terephthalate (PET) film with a thickness of 75 $\mu$m, dried at 100° C. for 20 minutes, so that an intermediate layer with a thickness of 0.1 $\mu$m was formed on the electroconductive support.

[Formation of Photoconductive Layer]

One part by weight of a titanyl phthalocyanine pigment synthesized in Synthesis Example 3, 1 part by weight of a disazo pigment of formula (I)-24 (shown in TABLE 1-(5)), and 100 parts by weight of tetrahydrofuran were dispersed in a sand mill for 2 hours. The thus obtained dispersion was mixed with a solution obtained by dissolving 7 parts by weight of a charge transporting material of formula (b) and 10 parts by weight of a polycarbonate resin (Trademark "Z-200", made by Mitsubishi Gas Chemical Company, Inc.) in 100 parts by weight of tetrahydrofuran. Thus, a coating liquid for a photoconductive layer was prepared.

(Charge Transporting Material)

(b)

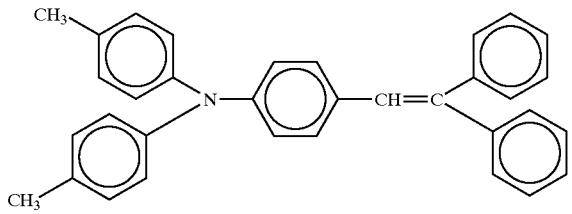

The photoconductive layer coating liquid was coated on the previously obtained intermediate layer, and dried at 130° C. for 15 minutes, so that a photoconductive layer with a thickness of 20 μm was provided on the intermediate layer.

Thus, an electrophotographic photoconductor No. 55 according to the present invention was obtained.

EXAMPLES 56 AND 57

The procedure for preparation of the electrophotographic photoconductor No. 55 in Example 55 was repeated except that the disazo pigment (I)-24 for use in the photoconductive layer coating liquid in Example 55 was replaced by disazo pigments (I)-29 and (I)-30 (shown in TABLE 1-(6)) respectively in Examples 56 and 57.

Thus, electrophotographic photoconductors Nos. 56 and 57 according to the present invention were obtained.

COMPARATIVE EXAMPLES 58 AND 59

The procedure for preparation of the electrophotographic photoconductor No. 55 in Example 55 was repeated except-that the disazo pigment (I)-24 for use in the photoconductive layer coating liquid in Example 55 was replaced by the following disazo pigments of formulae (d) and (p) respectively in COMPARATIVE EXAMPLES 58 and 59:

(d)

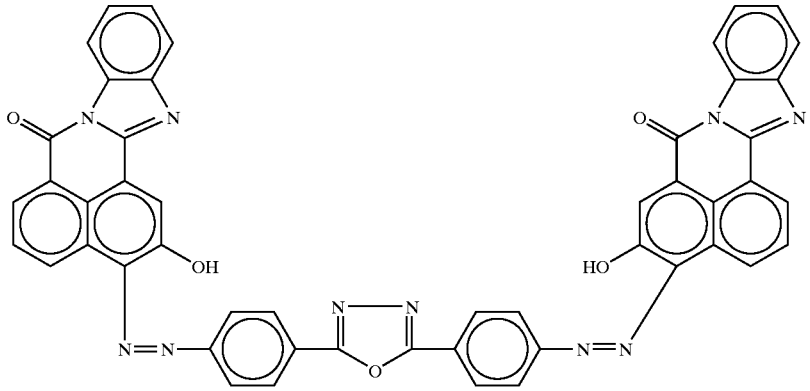

and (p)

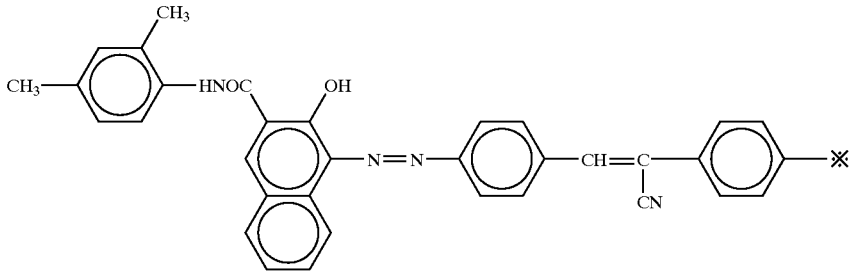

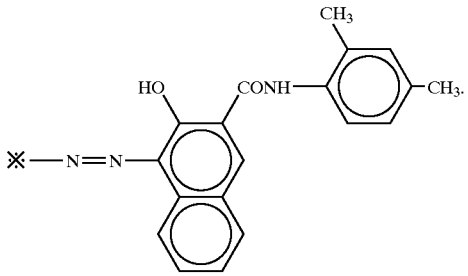

Thus, comparative electrophotographic photoconductors Nos. 58 and 59 were obtained.

The dynamic electrostatic properties of each of the electrophotographic photoconductors No. 55 to No. 57 according to the present invention and the comparative electrophotographic photoconductors No. 58 and No. 59 were measured by using a commercially available test apparatus (Trademark "EPA-8100", made by Kawaguchi Electro Works Co., Ltd.).

More specifically, each photoconductor was charged positively in the dark under application of +7 kV by corona charge for 5 seconds. Then, each photoconductor was allowed to stand in the dark without applying any charge thereto. When the surface potential of the photoconductor reached +800 V, the photoconductor was illuminated by the light of 500 nm, 600 nm, 700 nm and 780 nm separated by use of a band pass filter. In each case, the exposure $E_{1/2}$ ($\mu J/cm^2$) required to reduce the surface potential to ½ the surface potential, that is, +400 V, was measured.

The results are shown in TABLE 17.

TABLE 17

| | Exposure $E_{1/2}$($\mu J/cm^2$) | | | |
|---|---|---|---|---|
| | 500 nm | 600 nm | 700 nm | 780 nm |
| Ex. 55 | 0.34 | 0.30 | 0.26 | 0.23 |
| Ex. 56 | 0.36 | 0.33 | 0.29 | 0.26 |
| Ex. 57 | 0.37 | 0.33 | 0.35 | 0.35 |
| Comp. Ex. 58 | 0.70 | 0.61 | 0.53 | 0.46 |
| Comp. Ex. 59 | 0.95 | 0.92 | 0.64 | 0.60 |

EXAMPLES 58 TO 60

The procedure for preparation of each of the electrophotographic photoconductors Nos. 55, 56 and 57 in Examples 55, 56 and 57 was independently repeated except that the titanyl phthalocyanine pigment synthesized in Synthesis Example 3 for use in the photoconductive layer coating liquid in each Example was replaced by a titanyl phthalocyanine pigment synthesized in Synthesis Example 4.

Thus, electrophotographic photoconductors Nos. 58, 59 and 60 according to the present invention were obtained.

COMPARATIVE EXAMPLES 60 AND 61

The procedure for preparation of each of the comparative electrophotographic photoconductors Nos. 58 and 59 in Comparative Examples 58 and 59 was independently repeated except that the titanyl phthalocyanine pigment synthesized in Synthesis Example 3 for use in the photoconductive layer coating liquid in each Comparative Example was replaced by the titanyl phthalocyanine pigment synthesized in Synthesis Example 4.

Thus, comparative electrophotographic photoconductors Nos. 60 and 61 were obtained.

The dynamic electrostatic properties of each of the electrophotographic photoconductors No. 58 to No. 60 according to the present invention and the comparative electrophotographic photoconductors No. 60 and No. 61 were measured by using a commercially available test apparatus (Trademark "EPA-8100", made by Kawaguchi Electro Works Co., Ltd.).

More specifically, each photoconductor was charged positively in the dark under application of +7 kV by corona charge for 5 seconds. Then, each photoconductor was allowed to stand in the dark without applying any charge thereto. When the surface potential of the photoconductor reached +800 V, the photoconductor was illuminated by the light of 500 nm, 600 nm, 700 nm and 780 nm separated by use of a band pass filter. In each case, the exposure $E_{1/2}$ ($\mu J/cm^2$) required to reduce the surface potential to ½ the surface potential, that is, +400 V, was measured.

The results are shown in TABLE 18.

TABLE 18

| | Exposure $E_{1/2}$($\mu J/cm^2$) | | | |
|---|---|---|---|---|
| | 500 nm | 600 nm | 700 nm | 780 nm |
| Ex. 58 | 0.33 | 0.31 | 0.25 | 0.22 |
| Ex. 59 | 0.35 | 0.33 | 0.28 | 0.25 |
| Ex. 60 | 0.38 | 0.34 | 0.36 | 0.36 |
| Comp. Ex. 60 | 0.71 | 0.62 | 0.52 | 0.46 |
| Comp. Ex. 61 | 0.93 | 0.91 | 0.64 | 0.60 |

EXAMPLE 61

[Formation of Intermediate Layer]

Three parts by weight of a commercially available alcohol-soluble polyamide (Trademark "CM-8000", made by Toray Industries, Inc.) was dissolved in 100 parts by weight of a mixed solvent of methanol and n-butanol with a volume ratio of 8:2 under the application of heat. Thus, a coating liquid for an intermediate layer was prepared.

The thus prepared intermediate layer coating liquid was coated on an aluminum cylinder with a diameter of 80 mm, and dried at 100° C. for 20 minutes, so that an intermediate layer with a thickness of 0.1 $\mu$m was formed on the electroconductive support.

[Formation of Charge Generation Layer]

Three parts by weight of a commercially available butyral resin (Trademark "XYHL", made by Union Carbide Japan K.K.) was dissolved in 150 parts by weight of cyclohexanone. 3.5 parts by weight of a disazo pigment of formula (I)-24 (shown in TABLE 1-(5)) and 2.5 parts by weight of a titanyl phthalocyanine pigment synthesized in Synthesis Example 3 were added to the above prepared resin solution and dispersed in a ball mill for 120 hours. With the addition of 300 parts by weight of cyclohexanone, the dispersion was continued for further 3 hours. Thus, a coating liquid for a charge generation layer was prepared.

The charge generation layer coating liquid was coated on the previously obtained intermediate layer, and dried at 130° C. for 10 minutes, so that a charge generation layer with a thickness of 0.25 $\mu$m was provided on the intermediate layer.

[Formation of Charge Transport Layer]

Eight parts by weight of a charge transporting material of formula (b), 10 parts by weight of a polycarbonate resin (Trademark "Z-200", made by Mitsubishi Gas Chemical Company, Inc.), and 0.002 parts by weight of a silicone oil (Trademark "KF-50", made by Shin-Etsu Chemical Co., Ltd.) were dissolved in 85 parts by weight of tetrahydrofuran, so that a coating liquid for a charge transport layer was prepared.

(Charge Transporting Material)

(b)

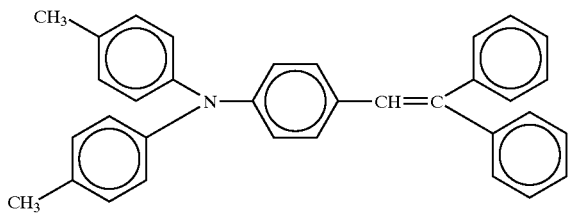

The thus prepared charge transport layer coating liquid was coated on the above obtained charge generation layer, and dried at 130° C. for 20 minutes, so that a charge transport layer with a thickness of 20 μm was provided on the charge generation layer.

Thus, an electrophotographic photoconductor No. 61 according to the present invention was obtained.

EXAMPLES 62 AND 63

The procedure for preparation of the electrophotographic photoconductor No. 61 in Example 61 was repeated except that the disazo pigment (I)-24 for use in the charge generation layer coating liquid in Example 61 was replaced by disazo pigments (I)-20 and (I)-29 (shown in TABLES 1-(4) and 1-(6)), respectively in Examples 62 and 63.

Thus, electrophotographic photoconductors Nos. 62 and 63 according to the present invention were obtained.

EXAMPLE 64

The procedure for preparation of the electrophotographic photoconductor No. 61 in Example 61 was repeated except that the titanyl phthalocyanine pigment synthesized in Synthesis Example 3 for use in the charge generation layer coating liquid in Example 61 was replaced by a titanyl phthalocyanine pigment synthesized in Synthesis Example 4.

Thus, an electrophotographic photoconductor No. 64 according to the present invention was obtained.

EXAMPLES 65 AND 66

The procedure for preparation of the electrophotographic photoconductor No. 64 in Example 64 was repeated except that the disazo pigment (I)-24 for use in the charge generation layer coating liquid in Example 64 was replaced by disazo pigments (I)-20 and (I)-29 (shown in TABLES 1-(4) and 1-(6)), respectively in Examples 65 and 66.

Thus, electrophotographic photoconductors Nos. 65 and 66 according to the present invention were obtained.

COMPARATIVE EXAMPLES 62 TO 67

The procedure for preparation of each of the comparative electrophotographic photoconductors Nos. 49, 50, 51, 54, 55 and 56 in Comparative Examples 49, 50, 51, 54, 55 and 56 was independently repeated except that the aluminum plate (Trademark "A1080", made by Sumitomo Light Metal Industries, Ltd.) used as the electroconductive support in each Comparative Example was replaced by an aluminum cylinder with a diameter of 80 mm.

Thus, comparative electrophotographic photoconductors Nos. 62 to 67 were obtained.

To evaluate the electrophotographic properties, each of the electrophotographic photoconductors Nos. 61 to 66 according to the present invention and the comparative electrophotographic photoconductors Nos. 62 to 67 was placed in a commercially available digital copying machine (Trademark "IMAGIO MF530", made by Ricoh Company, Ltd.) employing as a quenching light source a halogen lamp emitting the light of less than 650 nm.

The voltage applied to the photoconductor in the charging process, the light quantity of a laser beam with a wavelength of 780 nm employed in the exposure process, and the light quantity of the halogen lamp in the quenching process were respectively controlled in such a manner that the surface potential (Vd) of the photoconductor reached about −850 V by charging, the surface potential (Vl) of the photoconductor reached about −130 V after exposure, and the surface potential (Vr) of the photoconductor reached about −50 V after quenching. The surface potentials (Vd), (Vl) and (Vr) of each photoconductor were measured at the initial stage and after continuously making 3,000 copies.

The results are shown in TABLE 19.

TABLE 19

| | Initial Stage | | | After making 3,000 copies | | |
|---|---|---|---|---|---|---|
| | Vd(−V) | Vl(−V) | Vr(−V) | Vd(−V) | Vl(−V) | Vr(−V) |
| Ex. 61 | 850 | 130 | 50 | 830 | 135 | 55 |
| Ex. 62 | 855 | 135 | 50 | 830 | 140 | 60 |
| Ex. 63 | 850 | 130 | 50 | 830 | 140 | 60 |
| Ex. 64 | 850 | 130 | 45 | 825 | 130 | 50 |
| Ex. 65 | 855 | 125 | 50 | 835 | 130 | 60 |
| Ex. 66 | 855 | 130 | 55 | 830 | 140 | 65 |
| Comp. Ex. 62 | 845 | 135 | 50 | 800 | 195 | 85 |
| Comp. Ex. 63 | 850 | 125 | 45 | 735 | 135 | 70 |
| Comp. Ex. 64 | 845 | 130 | 50 | 700 | 140 | 70 |
| Comp. Ex. 65 | 850 | 135 | 55 | 800 | 200 | 90 |
| Comp. Ex. 66 | 855 | 130 | 50 | 740 | 135 | 70 |
| Comp. Ex. 67 | 850 | 135 | 55 | 695 | 145 | 75 |

As previously explained, the electrophotographic photoconductors according to the present invention can exhibit remarkably high photosensitivities in a broad wave range from the visible region extending to the near infrared region. In addition to this, the surface potential is stable during the repeated electrophotographic operations.

Further, the resistance to acid gases such as ozone and $NO_x$ can be improved.

Japanese Patent Applications Nos. 05-301292 and 05-301293 filed on Nov. 5, 1993, Japanese Patent Application No. 06-183923 filed on Jul. 13, 1994 and Japanese Patent Application No. 06-290470 filed on Oct. 31, 1994 are hereby incorporated by reference.

What is claimed is:

1. An electrophotographic photoconductor comprising an electroconductive support and a photoconductive layer formed thereon, which comprises a phthalocyanine pigment and a disazo pigment of formula (I):

(I)

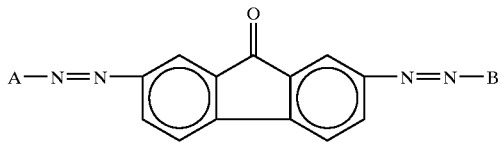

wherein A and B are coupler radicals having different structures, and wherein said disazo pigment is a compound of formula (II):

(II)

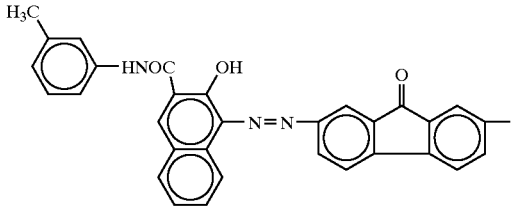

-continued

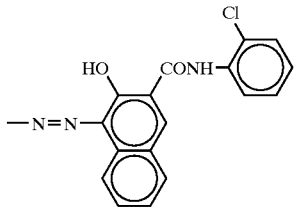

wherein said phthalocyanine pigment for use in said photoconductive layer is a metal-free τ-type phthalocyanine pigment.

2. The electrophotographic photoconductor as claimed in claim 1, wherein said photoconductive layer comprises a charge generation layer and a charge transport layer, wherein said charge generation layer comprises said phthalocyanine pigment and said disazo pigment of formula (II).

* * * * *